US011052978B2

(12) United States Patent
Yuan et al.

(10) Patent No.: US 11,052,978 B2
(45) Date of Patent: Jul. 6, 2021

(54) FLOATING STRUCTURE, AND BASIC MODULE OF FLOATING STRUCTURE

(71) Applicants: TANGSHAN REMOVABLE ISLAND MARINE HEAVY INDUSTRY CO., LTD., Hebei (CN); Dan Hong

(72) Inventors: Xiaoji Yuan, Hebei (CN); Quanming Miao, Hebei (CN); Shizhao Wang, Hebei (CN); Zengguang Zhang, Hebei (CN); Guangkun Yang, Hebei (CN); HeHe Wu, Hebei (CN); Nan Gu, Hebei (CN); Bei Liu, Hebei (CN); Yunmei Hong, Hebei (CN)

(73) Assignee: TANGSHAN REMOVABLE ISLAND MARINE HEAVY INDUSTRY CO., LTD., Hebei (CN)

( * ) Notice: Subject to any disclaimer, the term of this patent is extended or adjusted under 35 U.S.C. 154(b) by 0 days.

(21) Appl. No.: 16/613,558

(22) PCT Filed: May 12, 2018

(86) PCT No.: PCT/CN2018/086625
§ 371 (c)(1),
(2) Date: Nov. 14, 2019

(87) PCT Pub. No.: WO2018/210197
PCT Pub. Date: Nov. 22, 2018

(65) Prior Publication Data

US 2020/0070938 A1 Mar. 5, 2020

(30) Foreign Application Priority Data

May 16, 2017 (CN) ..... 201710343352.0
May 16, 2017 (CN) ..... 201710343946.1
May 16, 2017 (CN) ..... 201710344426.2

(51) Int. Cl.
*B63B 35/44* (2006.01)
*B63B 35/38* (2006.01)

(52) U.S. Cl.
CPC ..... *B63B 35/44* (2013.01); *B63B 35/38* (2013.01); *B63B 2035/4426* (2013.01)

(58) Field of Classification Search
CPC ..... B63B 35/00; B63B 35/003; B63B 35/34; B63B 35/38; B63B 35/44;
(Continued)

(56) References Cited

U.S. PATENT DOCUMENTS

2005/0115484 A1* 6/2005 Leitch ..... B63B 35/44 114/61.12
2005/0163572 A1* 7/2005 Keron ..... B63B 35/4413 405/210
2008/0238103 A1 10/2008 Montgomery

FOREIGN PATENT DOCUMENTS

CN 1657360 A 8/2005
CN 1769134 A 5/2006
(Continued)

OTHER PUBLICATIONS

English Abstracts of Cited Non-English Patent Documents, p. 1-6.
(Continued)

*Primary Examiner* — Daniel V Venne
(74) *Attorney, Agent, or Firm* — Helios IP

(57) ABSTRACT

A floating structure and basic module of a floating structure are presented. The floating structure includes multiple lower floating bodies, an upper structure, and intermediate connection structures. The multiple lower floating bodies include multiple distributed elongated floating bodies. The floating bodies are spaced from each other by a certain distance. The sum of the displacement volumes of the floating bodies is greater than the displacement volume when the floating structure as a whole is fully loaded. The
(Continued)

intermediate connection structures include at least multiple connection structures in a first direction, the first direction intersecting the horizontal plane. A connection structure in the first direction corresponds to a single elongated floating body connected to three or more spaced structures. The cross-section width of each intermediate connection structure in the horizontal direction is less than the width of the corresponding elongated floating body.

11 Claims, 26 Drawing Sheets

(58) Field of Classification Search
CPC .... B63B 2035/4426; B63B 2035/4433; B63B 2035/4473; B63B 2035/448; B63B 2035/4486; B63B 2035/4493; B63B 35/50; B63B 35/53
USPC ..... 114/256, 258, 261, 264, 265, 266, 267
See application file for complete search history.

(56) References Cited

FOREIGN PATENT DOCUMENTS

| | | | |
|---|---|---|---|
| CN | 201205974 | Y | 3/2009 |
| CN | 102145736 | A | 8/2011 |
| CN | 202783721 | U | 3/2013 |
| CN | 106167077 | A | 11/2016 |
| CN | 106428447 | A | 2/2017 |
| CN | 106564571 | A | 4/2017 |
| CN | 106985981 | A | 7/2017 |
| CN | 107097913 | A | 8/2017 |
| CN | 107097914 | A | 8/2017 |
| CN | 206871319 | U | 1/2018 |
| CN | 206871320 | U | 1/2018 |
| CN | 206871321 | U | 1/2018 |
| JP | 2001281084 | A | 10/2001 |

OTHER PUBLICATIONS

English Transiation of Notification to Grant Patent Right for invention CN201710344426.2, p. 1-2.
English Translation of Office Action No. 2 of Priority Document CN201710344426.2, p. 1-5.
English Translation of ISR, Aug. 9, 2018, p. 1-3.
First Search of Priority Document CN201710344426.2, p. 1.
International Search Report, dated May 12, 2018, p. 1-5.
Notification to Grant Patent Right for Invention CN201710344426.2, p. 1.
Office Action No. 1 of Priority Document CN201710344426.2, dated Apr. 27, 2018, p. 1-5 ((Chinese Language).
Office Action No. 2 of Priority Document CN201710344426.2, dated Sep. 5, 2018, p. 1-3 (Chinese Language).
Written Opinion of the International Search Authority, dated Aug. 9, 2018, p. 1-5 (Chinese Language).

* cited by examiner 31
31
31

FLOATING STRUCTURE, AND BASIC MODULE OF FLOATING STRUCTURE

TECHNICAL FIELD

The present disclosure relates to a floating structure, in particular to a novel floating structure and a basic module of a floating structure in ocean engineering.

BACKGROUND ART

The so-called floating structure refers to a floating structure having a larger dimension than conventional floating structures, with a main function of providing a large-area operation space, for example, offshore artificial floating islands and floating airports. In the prior art, one of the floating structures that can be stable in marine environments and survive in storms is large ship. It adopts a common large waterplane structure and is suitable for load navigation. The stress analysis of the ship structure can be analogized to placing a box-shape beam on an elastic foundation, and with increase of longitudinal and horizontal dimensions (i.e., a total volume) of the ship, increase of a wave load will be greater than the increase of the ship structure's load resistance capacity, therefore, there is a limit to develop large dimension for existing ship types. The highest level of dimension range of the ship's load check in Rules for Classification of Sea-going Steel Ships is 350 meters <length L<500 meters.

Offshore safety generally can be divided into the following two categories or systems: 1. Structural safety of offshore structures, wherein the structural safety refers to a structure's ability to remain intact and solid under the effect of various external forces, focusing on structural strength, fatigue resistance, sinking resistance, stability, etc., and can be checked according to the rules used in Classification Society or credible direct calculation specifications; 2. Life safety at sea, for the purpose of ensuring life safety of personnel, focusing on subdivision, stability, electromechanical equipment, fire prevention, escape and lifesaving, wireless communication and so on. International convention can be formulated by World Maritime Organization, and laws, decrees and norms can be formulated by maritime authorities of signatory countries for supervision.

Various types of existing ships and floating structure platforms have limited safety (including structural safety and life safety of personnel). As their buoyancy is provided by empty cabins, once a certain degree of accidental damage or personnel misoperation occurs, there are risks of overturning and sinking; in addition, metacentric heights of all ships and ocean platforms are quite small, the draught varies greatly under unloaded state and full load state. Under unloaded state, the draught is very shallow, and the center of gravity is very high, then the stability cannot meet standard requirements, and ballast water must be added for ballast. A floating cabin must simultaneously have the function of a cargo hold or a water ballast tank, and it is absolutely impossible to use a solid cabin. Therefore, partial damage will lead to buoyancy loss and stability reduction, and large-scale damage will inevitably cause asymmetric buoyancy loss, resulting in overturning or sinking. In addition, all accidents such as rock striking, stranding, and incontrollable heading put the floating structure at the risk of overturning.

In general, all of prior art ships, semi-submersible platforms, and truss platforms mentioned above, under the condition of meeting safety standards, still have potential safety hazards of overall structural overturning and sinking under extreme environments and unexpected conditions and how to ensure the life safety of personnel thereon. How to definitely ensure no overturning and no sinking of the floating structure, and further ensure the life safety of personnel on the floating structure is an unsolved worldwide problem.

On the other hand, in deep sea and open sea, model selection of floating structures (VLFS) usually adopts a semi-submersible structure as a basic module, and is formed by hinging three or more basic modules through connectors, with a single module generally having a scale below 400 meters, and it is a "multi-rigid body" complex system with flexible connection, for example, the Chinese invention patent "Mobile Offshore Base" (patent number ZL98808856.8) filed by US McDermott Technology INC.

An overall system composed of semi-submersible structure basic modules has a series of insurmountable technical problems, safety problems and economic problems. Despite huge and urgent ocean development and military needs, and nearly two decades of research of the world's maritime powers with investment of a large amount of resources, no key breakthrough has been achieved so far, and engineered practice of the floating structures has not yet been implemented so far.

Main technical problems of the above semi-submersible structure basic module are reflected in the several following aspects:

First, the basic module has a relatively small main scale.

The semi-submersible structure basic module adopts a typical waterplane structure form, and its main scale can hardly exceed 300 meters due to limitations of many factors such as structural form, connector load, and ballast system implementation. In order to meet the main scale requirement at kilometer level, it is necessary to connect more than three basic modules at least twice, which greatly increases the difficulty of implementation and safety risks of the connection.

Second, the stability of the basic module is quite sensitive to load changes (excluding wave load), anti-swing stable stiffness is quite low, and the swaying amplitude is relatively large and the restoring period is long under the effect of external interferences.

The basic characteristic of the semi-submersible structure basic module is that a heave period is much longer than a wave spectral peak period, and thus has better performance in waves, but just because of this, its floating status is extremely sensitive to load changes. Under the effect of load changes, the basic module will move with relatively large amplitude value and has a relatively long motion cycle, therefore, use convenience of the basic module will be greatly restricted, and at the same time, the implementation difficulty of the connection between the basic modules will be greatly increased.

Due to restriction of the above inherent properties, when a plurality of semi-submersible structure basic modules are connected into a floating structure (VLFS), motion analysis (including interaction analysis of floating body motion among the modules) forecasting of its multiple rigid bodies, connector load forecasting, safety risk control of the connection process, etc. will become extremely difficult.

Third, the basic module must have a complex and huge ballast system.

The semi-submersible structure basic module is a typical column-stabilized structure, and typical working conditions thereof include migration working conditions, storm self-storage working conditions and normal operation working conditions. It must depend upon a complex ballast system and a ballast control system to achieve various functions thereof. For the floating structure (VLFS), transition between its migration state and operation state, material loading and unloading, external load changes, etc. must rely on a large number of complex ballasting/deballasting operations. The amount of ballasting/deballasting operations required to cope with large load changes is difficult to achieve in engineering.

Fourth, the basic modules need to be connected through a very complicated connection device and a connecting process is dangerous.

In the process of connecting the semi-submersible structure basic modules, in addition to their own motion caused by wave excitation, load changes caused by the connecting process also will cause them to move evidently, and this movement is quite complicated and will last for a relatively long period of time. When the two motions are superimposed together, the synthesized motion characteristics are more difficult to predict and control effectively. For the above reasons, the connector problem is hard to solve.

Fifth, use of the basic module and the floating structure (VLFS) formed by connecting the basic modules is quite restricted.

Due to restriction of inherent characteristics of the semi-submersible structure basic module, it is in a semi-submersible status during operation, substantially having no navigation capability, and not allowing large ships to directly berth; even if multiple basic modules are connected into the floating structure (VLFS), it still has no navigation capability.

Main safety problems of the above semi-submersible structure basic module are reflected in several following aspects:

First, the basic module has relatively poor stability. Both intact stability and damage stability of the semi-submersible structure basic module are designed according to the principle of meeting relevant current norms and standards. It is unable to sail in an operation state, has no ability to evade storms by maneuvering navigation, and only can carry out migration operation under relatively small sea conditions. Moreover, the basic module has quite small initial stability height (GM), and relatively poor migration safety, then when encountering extreme events such as storms, collisions, and rock striking, it may cause overturning and sinking.

The semi-submersible structure basic module has a relatively small stability redundancy due to limitation of structural form principle. As demanded by existing standard stability check, the intact stability checking condition wind speed is 100 knots, while the damage stability checking wind speed is only 50 knots. If the damage stability is checked by utilizing the intact stability checking condition, it is quite hard to meet requirements, indicating that it is quite difficult to ensure safety, if the damage occurs, under the extreme environmental conditions. Apparently, it is unsuitable to use the semi-submersible structures as basic modules to combine the floating structure (VLFS) that demands higher safety.

Second, management and operation of the ballast system of the basic module are complex. Various use functions and working conditions of the semi-submersible structure basic module mainly depend on the complex ballast system and a large amount of ballast operations, and if the ballast is not adjusted timely or correctly, it will cause large heel of the basic module, dramatic deterioration of structural stress response, and even occurrence of serious accidents. Failure of the ballast system will bring about catastrophic consequences.

Third, the basic module has small overall structural safety redundancy. The overall structure of the semi-submersible structure basic module is less redundant, and accidental collision or accidental damage of an upright column (lower floating body) may cause disintegration or overturning or sinking.

Fourth, safety of the basic module is quite affected by human factors.

The semi-submersible structure basic module demands extremely high quality of operators. As its overall operation management is relatively complex, and safe operation is highly uncertain, once human misoperation occurs, it is quite likely to cause major safety accidents.

The main economic problems of the above semi-submersible structure basic module are reflected as follows: a single basic module's ballast system, equipment, operation management and etc. are highly complex, substantial costs of manpower, material resources and financial resources need to be invested, which synthetically results in poor economics; after multiple basic modules are connected, various problems above are more complicated (they need to overcome mutual interference and work synergistically), thus causing further deterioration of economy.

In summary, taking the semi-submersible structure as basic module of the floating structure that is movable has inherent defects in all aspects of technology, safety and economy, which is an important reason why engineered implementation of the floating structure so far has not been achieved yet. There is an urgent need to develop a new basic module, such that engineered implementation of the floating structure can be achieved earlier.

SUMMARY

One main object of the present disclosure lies in providing a floating structure that can be very large and have good performance in waves and stability in an operable water environment, to overcome at least one defect in the above prior art.

Another main object of the present disclosure lies in providing a floating structure that, under the condition of realizing a very large main scale, still can ensure overall effectiveness of the floating structure and does not overturn or sink under foreseeable extreme natural environment conditions and extreme accidental conditions, to overcome at least one defect in the above prior art.

Another main object of the present disclosure lies in providing a floating structure, which has improved multiple safety redundancies in terms of integrity, unsinkability and overturning resistance of the overall structure, and still can ensure overall effectiveness, non-overturning, and no sinking of the floating structure under foreseeable extreme natural environment conditions and extreme accidental conditions, while effectively reducing the wave load and providing quite good wave-resistant stability, to overcome at least one defect in the above prior art.

Another main object of the present disclosure lies in providing a floating structure, to overcome at least one defect in the above prior art, such that the operation and manipulation of the floating structure is relatively simple, there are less safety hazards of the accidents caused by human factors, and even if relevant accidents occur, it will not lead to catastrophic consequence of threatening life safety of the crew.

Another main object of the present disclosure lies in providing a floating structure, to overcome at least one defect in the above prior art. Even in the events of encountering the most unfavorable sea conditions that are foreseeable and occurring the most unfavorable collisions, rock striking, stranding, abnormal displacement of goods, etc. that are recorded, persons on board still do not need to abandon the ship, but the floating structure itself still can continue to effectively provide the persons thereon with safer guarantee of life than ship abandonment and escape.

Another main object of the present disclosure lies in providing a basic module of a floating structure (VLFS), to overcome at least one defect in the above prior art, wherein the basic module can effectively solve following main technical problems of the above basic module: small scale, the need to splice more than two modules to construct the floating structure, difficult in forecasting multi-module motion and connector load, sensitivity to load changes, the need for complex ballast operations, poor navigation capacity in operation working conditions and so on.

Another main object of the present disclosure lies in providing a basic module of a floating structure (VLFS), to overcome at least one defect in the above prior art, wherein the basic module can effectively solve following main safety problems of the above basic module: poor stability, poor overall structural safety, poor safety of complex ballast system, dangerous and complex connecting operation and so on.

An embodiment of the present disclosure provides a floating structure, including multiple lower floating bodies, an upper structure and intermediate connection structures; the multiple lower floating bodies include more than three horizontally arranged elongated floating bodies, each floating body is spaced apart by a certain distance, and a sum of displacement volumes of respective floating bodies is greater than a displacement volume when the floating structure is in a full-load state; the upper structure is a frame structure or a box structure; the intermediate connection structure at least includes connection structures in a first direction, wherein the first direction intersects a horizontal plane; the connection structures in the first direction include a plurality of floating bodies that extend upward, the connection structures in the first direction are correspondingly connected with more than three single elongated floating bodies, a horizontal-direction sectional breadth of each floating body of the connection structures in the first direction in a horizontal direction is smaller than a breadth of the corresponding elongated floating body; the intermediate connection structure is connected with the multiple lower floating bodies and the upper structure.

According to an embodiment, an outer contour dimension of the multiple lower floating bodies is greater than 150 meters in at least one direction.

According to an embodiment, a maximum height dimension of a section of a single floating body in the multiple lower floating bodies is smaller than ½ of a maximum wave height dimension of an applicable water area, and a maximum breadth dimension is no larger than 2 times the maximum height dimension of the section; a clear spacing between adjacent floating bodies of the multi-floating body is greater than 0.5 times a sectional breadth dimension of one floating body of two adjacent floating bodies which has a larger breadth dimension.

According to an embodiment, a total volume of respective floating bodies in the multiple lower floating bodies is less than 2 times an equivalent water volume of full weight when the floating structure is fully loaded.

According to an embodiment, length and breadth distribution dimensions (wherein the length distribution dimension refers to the total length of the multiple lower floating bodies; similarly, the breadth distribution dimension refers to the total breadth of the multiple lower floating bodies) of the multiple lower floating bodies of the floating structure in the horizontal plane are equal to or greater than 4 times a height from a center of gravity to a still water surface when the floating structure is unloaded state.

According to an embodiment, the floating structure is mounted with a driving device and a direction control device.

According to an embodiment, some floating bodies located at the outer side in the multiple lower floating bodies are provided therein with a plurality of watertight compartments, or internally filled with a non-absorbent material with a lighter specific gravity than water, a sum of displacement volumes of the above some floating bodies is greater than an equivalent water volume when the floating structure is fully loaded; and/or some floating bodies, located at the outer side, of the intermediate connection structures are internally provided with a plurality of watertight compartments, or internally filled with the non-absorbent material.

According to an embodiment, an overall sectional area of the connection structures in the first direction in a horizontal direction is about 10% to 30% of a static waterline area of the multiple lower floating bodies.

According to an embodiment, the multiple lower floating bodies is in a very large waterplane area contour profile.

In another aspect, an embodiment of the present disclosure provides taking a single floating structure mentioned above as basic module, and connecting two of the basic modules once to form a floating structure (Floating Structure, VLFS), that is movable, with a scale of 800 m to 1600 m.

An embodiment of the present disclosure provides a floating structure, including lower floating body structures, an upper structure and intermediate connection structures; the lower floating body structures include five or more single floating bodies, each floating body is spaced apart by a certain distance; the lower floating body is in a very large waterplane area contour profile, and at least some floating bodies located at the outer side adopt solid-like floating cabins; a sum of displacement volumes of the solid-like floating cabins is greater than an equivalent water volume of full weight when the floating structure is fully loaded; the upper structure is a frame structure or a box structure; the intermediate connection structures are arranged in a spatially dispersed manner, including a structure intersecting a horizontal plane and providing a safe righting force; the intermediate connection structures are integrally connected with the upper structure and the lower floating body structures; a minimum distribution dimension of an outer contour of the lower floating body structures in a horizontal direction is equal to or greater than 4 times a height from a center of gravity to a still water surface when the floating structure is in unloaded state.

According to an embodiment, an outer contour dimension of the lower floating body structures is greater than 140 meters in at least one direction.

According to an embodiment, a sectional height dimension of any floating body in the lower floating body structures is smaller than ½ of a maximum wave height dimension of an applicable water area.

According to an embodiment, the solid-like floating cabin adopts a floating cabin structure with high density subdivision inside (wherein cabins of high density are obtained by subdivision), and/or the solid-like floating cabin is filled therein with a light water blocking material or assembled with a removable light water blocking material.

According to an embodiment, in a full-load draught state, a ratio of a waterplane area of the floating bodies in the outer contour of the lower floating body structures to an area of the outer contour of the floating body structures is not greater than 0.7.

According to an embodiment, a whole structure of the floating structure spans four or more spans in any horizontal direction.

According to an embodiment, various members and/or components composing the intermediate connection structure have connection members and/or connection components arranged in a horizontal direction therebetween.

According to an embodiment, outer members of the intermediate connection structure use a solid-like floating cabin structure.

According to an embodiment, the floating structure is mounted with a driving device and a direction control device.

According to an embodiment, the floating structure as a whole is a hyperstatic combined space structure composed of a plurality of hyperstatic units.

According to an embodiment, the floating structure is, in any direction, a continuous combination of at least four hyperstatic spatial structural units.

Regarding the above embodiments of the floating structure, the following illustration is made:

A. The floating structure provided in the present disclosure is advantageous to reduce the wave load response under extreme sea conditions, and exert the contribution and effectiveness of the material to the overall strength, such that the structure thereof still can be ensured to have enough overall strength redundancy when a main scale of the platform is very large.

It is defined in the present disclosure that a sectional height dimension of any floating body in the lower floating body structures is smaller than ½ of the maximum wave height dimension of the applicable water area, therefore, a single floating body has a relatively small sectional dimension. Meanwhile, it is defined that each floating body in the floating body structures is spaced apart by a certain distance, therefore, each floating body is arranged in a dispersed manner in the space, and the dispersedly arranged floating bodies create a condition of fluid motion and energy release for the waves to cross (pass by) the floating bodies, ensuring smooth flowing of the waves between the floating bodies, so as to reduce the destructive load of huge waves on the floating bodies.

It is exemplified that when the main scale of a section of a single floating body is smaller than the main scale of the maximum wave height (such as 0.5 times), at the maximum wave height, some of the waves will cross the floating bodies, some of the floating bodies will break away from the waves, and the wave load will no longer significantly increase with the increase of the wave height, that is, the response of the platform wave load to the wave height appears nonlinear, thus the wave load of the floating structure during large waves can be greatly reduced. Obviously, for floating structures with the same scale, compared with ship structures, the wave load received by the floating structure in the present disclosure will be reduced greatly, such that its structural design has higher overall structural safety than ship's box structure, under the condition of meeting the same specifications and criterions. The reason is that when an external environment load is increased due to unexpected factors (record-breaking waves, hurricanes and the like), the wave load received by the floating structure in the present disclosure is hardly increased or is increased very little, but the wave load received by a common ship will be increased sharply and greatly, therefore, the floating structure in the present disclosure has higher structural safety reserve.

B. The floating structure provided in the present disclosure is a hyperstatic combined space structure, and can ensure that the overall structure still has definite safety that structural integrity will not be lost even if local structure is damaged in the event of encountering the most unfavorable sea conditions that are foreseeable and occurring the most unfavorable collisions, rock striking, stranding, abnormal displacement of goods and other accidents that are recorded.

The floating structure in the present disclosure as a whole is a hyperstatic combined space structure. Its overall structure is a combination of the upper box structure, the intermediate connection structures and the lower floating body structures.

The whole structure of the floating structure defined in the present disclosure spans four or more spans in any horizontal direction, wherein one span herein refers to a distance between two adjacent floating bodies and a distance between two adjacent intermediate connection structures. Therefore, the floating structure is a unitary structure at least composed of five floating bodies, 25 upright columns and one spatially continuous upper box structure (hyperstatic unit). According to the knowledge of structural mechanics, 2 lower floating bodies, 4 upright columns and corresponding part of the upper box structure (which can be analogized to a semi-submersible platform) can form an airtight hyperstatic spatial structural unit, therefore, the floating structure of the present disclosure is, in any direction, a continuous combination of at least four hyperstatic spatial structural units, and viewed on the whole, the floating structure of the present disclosure is a combined structure at least composed of 16 hyperstatic spatial structural units, and damage of some of the units (local structural failure) caused by accidents such as collisions and rock striking will not pose a threat to the overall structural safety. Therefore, the whole structure has very large accident safety redundancy in terms of disintegration resistance.

From the structural composition analysis of the floating structure, it can be found that the lower floating body structures, the intermediate connection structures and the upper structure thereof are all in a large number and arranged in a dispersed manner. When the structure is stressed, each built-up member works synthetically in a relatively "balanced" manner. In the event of encountering the most unfavorable sea conditions that are foreseeable and occurring the most unfavorable accidents, such as collisions, rock striking, stranding, abnormal displacement of goods, etc. that are recorded, even if some members of a certain or even several hyperstatic spatial structural units are damaged and out of service, the remaining structure is still a combined structure composed of the hyperstatic spatial structural units, and still can work normally.

In the design of the present disclosure, upon reasonable analysis by retrieving statistical data of various sea conditions and accidents, extreme loads of bad sea conditions and destructive extremums of various recorded accident forms are predicted, and as the recorded samples of the modern shipwreck accidents are enough and typical, it is credible to analyze the accident contour profile and extremum according to these accidents, and it also can be achieved by technicians in the industry. Thus, it can provide a basis for the design of the overall structure of the platform, so as to ensure that the present disclosure will not suffer from continuous destruction of a plurality of local units under extreme conditions, further ensuring that the floating structure of the present disclosure has definite safety performance of integrity of the whole structure under the above conditions.

For the ships and the ocean platforms in the conventional technology, key components, important components, secondary members and the like are classified according to importance of the members and different stressed states. However, various stressed members of the present disclosure are of substantially equivalent importance, and can support each other, without the risk of successive failures and overall collapse of relevant structures due to failure of "soft spot" components.

Distinguished from the semi-submersible platform, subdivision of the semi-submersible platform floating body is limited, and when the floating body or the upright column is damaged to a relatively great extent, a floating cabin will be damaged and a large amount of water will enter, at this time, if an inflow water flow is greater than a discharge capacity of an emergency drainage system, an overall floating status of the platform will inevitably change, leading to a series of chain reactions such as deterioration of structural stress, eventually, it may cause catastrophic consequences of heeling, rupture or even overturning or sinking.

C. Each floating body of the lower floating body structures of the floating structure provided in the present disclosure has a relatively small scale and is arranged in a dispersed manner, and has the characteristic of a very large waterplane area contour profile, with relatively small draught change under unloaded state and full load state, then the influence on stability is negligibly small.

It is defined in the present disclosure that the sectional height dimension of any floating body is less than ½ of the size of the maximum wave height, each floating body in the lower floating body structures is spaced apart by a certain distance, and a sum of displacement volumes of the solid-like floating cabins is larger than an equivalent water volume of full weight when the floating structure is fully loaded, meanwhile, it is defined that in a full-load draught state, a ratio of a waterplane area of the floating bodies in the outer contour of the lower floating body structures to an area of the outer contour of the floating body structures is not greater than 70%.

For example, in the harshest sea environment in North Atlantic waters, the maximum wave height recorded is about 30 meters, then the maximum sectional height of a single floating body is less than about 15 meters, therefore, the scale of the floating body is relatively small. At the same time, the displacement volume of the solid-like floating cabins is defined to be larger than the equivalent water volume of the full weight when the floating structure is fully loaded, therefore, the static waterline of the floating structure is necessarily within a height range of the floating body, such that the overall draught of the floating structure is quite shallow, and the distance from the static waterline of the floating body thereof to the top of the floating body is also small.

A single floating body has a relatively small sectional dimension, then each floating body has a relatively small volume, therefore, the floating body should have a certain length and quantity to have a certain total volume. If the floating bodies are arranged together without an interval, it is a "bamboo raft" type, flat-box floating body structure, and combined with the bearing capacity requirements, the flat floating body structure must have a very large waterplane area, and its waterplane area will be much larger than conventional ships and floating platforms. It should be emphasized that a very large waterplane area necessarily is generally accompanied by a very large response to the wave load, while a very large waterplane area and a relatively small response to the wave load are simultaneously achieved skillfully in the present disclosure with the dispersed arrangement of the multiple floating bodies. The waterplane area herein refers to the area of a section formed by the intersection of the horizontal plane at the waterline and the floating bodies, and the referred waterline refers to static waterline.

Regarding the ratio of a total displacement volume to a total waterplane area, the waterplane area and waterplane area distribution are very large in the present disclosure. If the conventional ships are large-waterplane structures compared with the small-waterplane semi-submersible platform, the floating structure in the present disclosure is "very large waterplane area" structure compared with the conventional ships. The flat structure has the characteristics of a very low center of gravity and very high metacenter, and the GM value of the present disclosure can be more than two orders of magnitude higher than those of conventional platforms and ships. The stability problem is no longer a key factor of overall safety. Besides, for the same reason as the above, in the present disclosure, the heave period is much less than the peak spectral period at the maximum waves, about 5 seconds. Apart from excellent wave-resistant stability in large waves, the floating status is extremely insensitive to various load changes such as substantial increase and decrease of load weight, position movement of heavy objects, and external push and pull, thus having unique "anti-swing stiffness".

D. The floating structure provided in the present disclosure can realize reliable non-sinking characteristic.

It is selected in the present disclosure that at least some floating cabins located at the outer side in the lower floating body structures adopt solid-like floating cabins, and a sum of displacement volumes thereof is greater than an equivalent water volume of the full weight when the floating structure is fully loaded, therefore, regardless of the kind of local damage to which the structure is subjected, as long as the overall structure of the floating structure is not disintegrated, it can be definitely ensured that the overall structure cannot be sunk.

E. The floating structure provided in the present disclosure, as a whole, is in an ultra-flat state, has a great metacentric height, and can ensure no overturning of the whole structure in the event of encountering the most unfavorable sea conditions that are foreseeable and occurring the most unfavorable collisions, rock striking, stranding, abnormal displacement of goods and other accidents that are recorded, providing a basic condition for guaranteeing lift safety of personnel.

In the present disclosure, the minimum distribution dimension of the outer contour of the lower floating body structures in the horizontal direction is selected to be equal to or greater than 4 times the height from the center of gravity to the still water surface when the floating structure is in unloaded state.

The floating structure as a whole is in an ultra-flat state. By proposing multiple between the minimum distribution scale in the horizontal direction and the distance from the structural center to the static waterline, meanwhile requiring the waterplane area of the lower floating body to be distributed in a dispersed manner, the floating structure in the present disclosure has great righting force and righting moment, such that the overall structure is allowed to have a great metacentric height (2 to 3 orders of magnitude higher than the industry standard) and an extremely large righting arm, then under extreme conditions, no overturning still can be realized.

The lower floating body structures of the floating structure in the present disclosure, adopting a plurality of floating bodies with a relatively small scale that are arranged in a dispersed manner and function in combination, can provide an enough displacement volume and a very large waterplane area, have a very big waterplane area moment of inertia, a very long stability radius, quite great metacentric height, quite great initial stability height, relatively small draught change and negligible influence on stability under no-load and full-load working conditions, therefore, the large-capacity ballast tank may not need to be configured.

The floating structure in the present disclosure has a very high breadth draught ratio, and has a very large righting arm at a small heeling angle; as the intermediate structure and the upper structure have relatively large reserve buoyancy, they still have a very large righting arm at a big angle; besides, a wind pressure moment arm of the floating structure in the present disclosure is relatively small compared with the righting arm, and a rolling angle is also relatively small; various index of intact stability and damage stability are much higher than criterion values, and the height value of the extreme allowable center of gravity is quite large.

Meanwhile, it is defined in the present disclosure that at least some floating bodies located at the outer side in the lower floating structure adopt solid-like floating body, therefore, in the event of encountering the most unfavorable sea conditions that are foreseeable and occurring the most unfavorable collisions, rock striking, stranding, abnormal displacement of goods and other accidents that are recorded, it still can ensure that the damage stability is approximately equal to the intact stability.

The floating structure as a whole is in an ultra-flat state, with the center of gravity of the floating structure as an upper apex, and the outer contour of the static waterline of the lower floating body structures as a lower bottom surface, forming a stable irregular space cone, wherein a maximum angle between this space cone and the horizontal plane is 27 degrees, equivalent to defining that the floating structure as a whole has a large chassis with a lower center of gravity. In rough storms, maximum wave steepness is 1/7, and a corresponding wave inclination is 16 degrees, and under the most unfavorable working conditions, the floating structure is transversely placed on the wave surface of the waves, but it still can ensure that the floating structure does not tip over under the effects of wind heeling moment and wave load. In the case of stranding, due to the scale limitation requirements of the floating structure in the horizontal direction, under the effect of wave reciprocating, the structure can be completely detached from the shoal without turning over or overturning. When the shoal angle is too large, only a collision will occur, but no rest at large inclination. When the floating structure encounters a gentler underwater reef or sea floor (such as an angle of slope less than 20 degrees), if the floating structure is rested on an inclined plane with a certain slope, due to the effect of the stable irregular space cone, the floating structure can be ensured to not overturn.

It is defined in the present disclosure that the intermediate connection structure of the floating structure provides reserve buoyancy when entering water, ensuring the continuity of upward distribution of the buoyancy providing structure. In the event of an unexpected large inclination (when the water enters all or part of the peripheral floating bodies on a certain side), the righting arm still has a positive value, ensuring that under extreme conditions, the floating structure still can have high enough stability safety redundancy, so as to maintain reliable anti-overturning capacity. In combination with the characteristics of disintegration, no water inlet or sinking when damaged mentioned in the preceding, the damage stability is substantially the same as the intact stability, therefore, the present disclosure provides a novel, unique and most fundamental safety condition for ensuring lift safety of personnel thereon.

F. The floating structure provided in the present disclosure can have a considerable overall scale and operation space, and meanwhile has extremely high wave-resistant stability, and provides a relatively loose safety condition for the overall layout design of function and facility.

It is defined in the present disclosure that the outer contour dimension of the lower floating body structures is greater than 140 meters in at least one direction. It is exemplified that the floating structure has a total length of 400 meters, a molded depth of about 40 meters, a height of center of gravity of about 15 meters under unloaded state, and a total breadth of 120 meters, then its deck area is about 48000 square meters. In contrast, for a 400-meter-long cargo ship, its molded breadth is about 35 meters at the maximum, and its deck area is about 14000 square meters. Obviously, the floating structure in the present disclosure has an enormous operation space, and it is very easy to realize the arrangement in the horizontal direction for the overall functional arrangement, without the need for a multi-layer arrangement in the vertical direction due to narrow site. Compared with the multi-layer arrangement, it is more conducive to the isolation design and evacuation arrangements of personnel in the event of fire-like accidents.

Meanwhile, in the sea conditions of 5-6 level in which routine operations can be carried out, a wavelength length corresponding to the wave spectral peak period is less than about 100 meters, and the floating structure's swing amplitude is mainly related to a ratio of the wavelength to the total length of the floating structure. In order to maintain relatively good wave-resistant stability of the platform in each direction, especially reduce the wave motion response of the platform in the workable sea conditions, the floating structure is defined to have a scale of greater than 140 meters in at least one direction, then the floating structure is stable and has good performance in waves in the operation environment.

G. The floating structure provided in the present disclosure has relatively good navigation performance and ability to adjust the heading.

It is defined in the present disclosure that the floating structure is mounted with a driving device and a direction control device, and as the draught is very shallow, if the floating body adopts a slender shape, the resistance is relatively small, and it is also easy to reach a navigational speed of no less than 6 knots under the condition of large scale. In terms of power configuration, specifically, a plurality of full-revolving propellers can be arranged in the bow portion and the stern portion of each floating body of the lower floating body structures. These propellers have a certain distance in the front and back and can rotate omnidirectionally, can generate a huge yaw moment according to needs while generating an omnidirectional thrust. Specifically, the floating structure further can be provided with a sail, a direct-push propeller, a rudder and so on, such that the platform can be enabled to have good omnidirectional navigation performance and extremely strong ability of heading control, and can effectively avoid typhoon by escaping in advance. An encounter angle between the platform and the waves also can be effectively adjusted according to the need of changing the wave load. Besides, even if the platform completely loses power, as the main scales of the platform in each direction is very large, it will automatically deflect to the transverse wave direction in storms, which is the most dangerous state for the conventional ships, but as the present platform has extremely good transverse stability, with no possibility of overturning, the automatic transverse wave state instead will greatly reduce the longitudinal bending moment load which is greatest threat posed by the storms to the structure of the present platform, becoming a unique adaptive structural safety performance.

In another aspect, an embodiment of the present disclosure provides a basic module of a floating structure, including lower floating body structures, an upper structure and intermediate connection structures; the lower floating body structures as a whole is in a very large waterplane area contour profile; the lower floating body structure includes more than five elongated floating bodies, and each of the elongated floating bodies is spaced apart by a certain distance; a sectional height of each of the elongated floating bodies is smaller than a maximum wave height of an applicable water area; a sum of displacement volumes of each of the elongated floating bodies is greater than an equivalent water volume of full weight when the basic module is fully loaded; the upper structure is a frame structure or a box structure; the intermediate connection structures are arranged in a dispersed manner between the lower floating body structures and the upper structure, the intermediate connection structure is a small waterplane structure intersecting with a horizontal plane, each of the elongated floating bodies has more than five of the intermediate connection structures; the intermediate connection structures are integrally connected with the upper structure and the lower floating body structures, to form a hyperstatic combined space structure.

The basic module has quite strong characteristics of reducing the wave load, quite strong capacity of resisting wave-excited motion, and quite strong anti-swing stable stiffness, and can greatly increase the main scale of the basic module, can greatly reduce the motion amplitude value of the basic module in the waves, and further greatly reduces relative swaying motion of a splicing process between the basic modules and the connector load after the splicing, thereby greatly reducing the difficulty of the connection problem. Under various working conditions, the basic module has the capability of autonomous omnidirectional navigation.

According to an embodiment, length and breadth distribution dimensions of the lower floating body structures of the basic module in a horizontal plane are equal to or greater than 4 times a height from a center of gravity to a still water surface when the basic module is in unloaded state.

According to an embodiment, the basic module has a length greater than 400 meters, and less than 800 meters. The scale of a single basic module in a length direction is more than 400 meters, and upon scientific and reasonable design, its scale can reach about 600-800 meters, the basic module itself is a floating structure, and a floating structure (VLFS) of the kilometer level can be realized just by splicing two basic modules once.

According to an embodiment, a sectional height dimension of any one of the elongated floating bodies in the lower floating body structures is less than ½ of a maximum wave height dimension of an applicable water area.

According to an embodiment, in a full-load draught state, a ratio of a waterplane area of the elongated floating bodies in an outer contour of the lower floating body structures to an area of an outer contour of the floating body structures is not greater than 0.7.

According to an embodiment, under the effect of the maximum total longitudinal bending moment, the deflection of the basic module is less than 1/400 of the dimension in its length direction, "hydroelasticity" phenomenon caused by a total displacement amount thereof is not significant and is negligible, while the basic module can still be designed according to "rigid body".

According to an embodiment, the basic module is mounted with a full-revolving propelling device.

According to an embodiment, two or more cable traction devices for connection are provided in a bow portion, a stern portion and/or a shipboard of the basic module.

According to an embodiment, connection devices for connecting and separating the modules are provided in the bow portion, the stern portion and/or the shipboard of the basic module.

According to an embodiment, the connection devices are magnetic connection devices and/or mechanical connection devices.

According to an embodiment, the basic module as a whole is a hyperstatic combined space structure composed of a plurality of hyperstatic units.

According to an embodiment, the basic module is, in any direction, a continuous combination of at least four hyperstatic spatial structural units.

According to an embodiment, an overall sectional area of the intermediate connection structures intersecting with the horizontal plane in horizontal direction is about 10% to 30% of the static waterline area of the lower floating body structures.

It can be seen from the above technical solutions that the principle and beneficial effects of the floating structure provided in the embodiments of the present disclosure lie in:

1. The floating structure of the embodiment of the present disclosure can have a large scale (a small-section floating body has the characteristic of nonlinear response, and can reduce the wave load). Referring to FIG. 11, by analyzing calculation and experimental results, it can be found that for the floating structure of the embodiment of the present disclosure, when the wave amplitude is small, that is, when waves do not cross the floating body, the wave bending moment and the linear frequency domain wave bending moment have substantially the same value; when the wave amplitude is relatively large, that is, after the waves cross the floating body, the increasing rate of the wave bending moment gradually slows down with the increase of the wave height, showing relatively evident characteristic of nonlinear response, and at the limit wave height, it is greatly reduced compared with the bending moment of linear wave response, providing favorable conditions for the large scale of the floating structure.

2. The floating structure of the embodiment of the present disclosure has excellent performance in waves, and has a larger main scale than a common wavelength of a corresponding peak spectral period; the heave period is approximately less than or equal to 5 seconds, much smaller than the peak spectral period of waves, therefore no harmonic oscillation (resonance) will appear.

3. The floating structure of the embodiment of the present disclosure has a large load carrying capacity, and compared with Mr. Yuan Xiaoji's invention patent in 2004, the floating body spacing is reduced, that is, the spacing is reduced from one fold to 0.5 fold, but the characteristic of reducing the wave load still can be possessed, and specific materials and diagrams—FIG. 12 are provided, therefore, more floating bodies can be arranged under the same breadth condition, thus obtaining a greater load carrying capacity.

4. A lower portion of the floating structure of the embodiment of the present disclosure is an elongated multi-floating-body structure that is dispersedly arranged, with a very high breadth draught ratio of the structure, and has a very big waterplane area moment of inertia, the overall equivalent cross section is in an ultra-flat state, with a very long transverse stability radius, and the metacentric height (GM value) is increased by orders of magnitude compared to conventional structures. As the intermediate structure in the present disclosure also has certain waterplane area and displacement volume, when heel at a large angle, the intermediate structure will enter water, and provide buoyancy and a righting moment; therefore, reliable anti-overturning capacity still can be maintained even if wind, waves and other heeling factors are simultaneously superimposed and function on the floating structure.

5. The floating structure of the embodiment of the present disclosure has "absolute insinkability", which is mainly realized by solid-like floating cabins, and a sum of displacement volumes of the solid-like floating cabins is larger than an equivalent water volume when this floating structure is fully loaded.

6. The floating structure of the embodiment of the present disclosure has the characteristic of "absolutely not overturning", and a structurally stable triangle is formed using an overall ultra-flat contour profile.

7. The floating structure of the embodiment of the present disclosure has multiple redundancy of overall structural integrity, and the intermediate connection structure connects the multiple lower floating bodies and the upper structure with a plurality of dispersed structural members. When a local structure fails, the overall structure will not fail.

8. The floating structure of the embodiment of the present disclosure has a structural form for "improving material utilization rate", and the overall structural form of the upper structure, the intermediate connection structures and the multiple lower floating bodies are analogized to an I-shaped section with relatively high structural strength material utilization efficiency.

9. The floating structure of the embodiment of the present disclosure has relatively small draught change under unloaded state and full load state, and has a quite high transverse metacentric height, requiring no conventional large-capacity ballast tank.

10. The floating structure of the embodiment of the present disclosure has good survivability in storm environments, because the breadth of the floating structure has a certain scale, and after the transverse metacenter reaches a certain value, when various unfavorable factors such as wind heeling moment and wave heeling moment are comprehensively applied to the overall structure, sufficient stability still can be ensured. Under extreme adverse conditions, even if the power is lost, it automatically turns to a beam wave state, and the structure as a whole can still ensure safety (ships do not have this characteristic, and only can guarantee safety by adjusting heading in head waves.)

11. The floating structure of the embodiment of the present disclosure has a wave shielding effect, forming a good berthing condition on water. The floating structure has a large overall scale. The dispersed floating bodies have a wave-absorbing characteristic, and form a static wave region of relatively large area on a leeward and backwave side of the structure. The structure itself has good stability, can provide large enough mooring restraint capacity, and can provide conditions for ships to directly berth.

12. The floating structure of the embodiment of the present disclosure greatly enhances humans' ability to develop and utilize the ocean. Due to the large scale, large load carrying capacity, high stability, and high safety, it actually provides a "land on the sea", which enables more types of land-based technologies, equipment, operating methods and personnel to be relatively easily transplanted to operation at sea. Compared with conventional ships and existing ocean platform technologies, it can provide larger and stronger carrying capacity that is not available from conventional ships and offshore platforms.

13. The floating structure of the embodiment of the present disclosure moves little in waves, meanwhile has little changes in floating status caused by unbalanced loading, thus facilitating the reduction (simplification) of the difficulty of cargo loading and tying, and improving the loading efficiency. Due to the characteristics of large scale, large carrying capacity, and high stability, the floating structure is enabled to be insensitive to uneven load—inclination caused by unbalanced loading is relatively small. Compared with ship loading, the requirements are greatly reduced, the operating specification is simplified, and the cost is reduced.

14. The floating structure of the embodiment of the present disclosure has good navigation performance and maneuverability, and under the premise that the main scale is substantially equivalent, it has shallower draught and smaller resistance compared than large barges and semi-submersible platforms, so as to achieve a higher navigational speed, better navigation stability and passability and extremely strong ability of heading control. The basic navigational speed of 8 to 10 knots required to avoid typhoon can be easily obtained. The angle of encounter between the platform and the waves also can be effectively adjusted according to the need to change the wave load.

15. With the multiple small-section, elongated floating bodies arranged in a dispersed manner, under the condition of the same displacement, the more the number of floating bodies is, the smaller the sectional area of a single body is. When the sectional scale of the floating body is much smaller than the maximum wave height, the linear theory of commonly used wave load analysis is inapplicable, because according to this theory, the wave induced load of the floating body is proportional to the square of the wave height. But when the floating structure of the embodiment of the present disclosure is in large waves, some of the waves will cross the top of the floating bodies, and lower parts of some of the floating bodies will break away from the waves (see FIG. 2), at this time, the wave load no longer increases sharply with the increase of the wave height, nonlinear response of the floating body load to the wave height change will appear (see FIG. 11), which can greatly reduce the limit value of the load response. At the same time, the dispersed arrangement of the small floating bodies has a unique effect on reducing "attached mass" of the heave motion state of the floating bodies. This effect appears when the spacing between respective floating bodies is greater than 0.5 D (see FIG. 12). Referring to FIG. 12, when there is no spacing and a spacing of more than 0.5 D between the cylindrical elongated floating bodies, the heave additional mass varies with the circular frequency of the vibration, and it can be seen that the value of the dispersed multi-floating bodies with no spacing is much larger than with a spacing, and this difference no longer changes significantly with increased spacing after 0.5 D.

The above effect enables the total wave load response of the floating structure of the embodiment of the present disclosure to be reduced greatly in large waves, laying a foundation for the floating structure to break the large scale in the conventional sense. With the increase of the main scale of the platform, the performance in waves of the floating structure of the embodiment of the present disclosure further will be greatly improved, and motion response of the floating bodies in the waves is in turn reduced. It also greatly reduces the inertial force load of the floating structure.

16. Another characteristic of the multi-floating body is having an extra-large waterplane area, and each floating body is arranged in a dispersed manner, the draught changes little under unloaded state and full load state, then influence on stability can be neglected. Therefore, solidification filling of the multi-floating body is allowable with corresponding light non-influent material, realizing that even if a shell of the floating body is damaged, loss of buoyancy will not occur, so that any damage stability is approximately equal to intact stability.

17. One of the main functions of the upper structure is to make it have substantially equivalent contribution as the sectional area of the multiple lower floating bodies to the cross-section moment of inertia of the floating structure, such that the overall strength structural distribution is more reasonable; a second function is to provide a large-space cabin for operation on water and an upper surface deck of a large area. The upper structure may be realized in two ways: a space frame structure and a box (conventional shell) structure. The space frame structure refers to a structure in which beams and columns are connected with each other in a rigid connection manner to form a load-bearing system, and the beams and columns jointly resist various loads that appear during use. The use of the space frame structure enables the design of the upper structure more flexible, and at the same time it greatly reduces the design difficulty of the structure as a whole.

18. The floating structure has quite high safety.

As multiple dispersed floating bodies are used to form a hyperstatic spatial combination structure that is ultra-flat as a whole, meanwhile the multi-floating body is a very large waterplane structure, and further the multiple lower floating bodies can be filled with a non-absorbent material with a lighter specific gravity than water, there is reliable redundancy in terms of overall structural strength and stability, which can ensure that local structural damage will not affect the overall structural safety; at the same time, local structural damage will not produce a chain reaction that causes continuous damage of the floating structure as a whole, thus having higher safety. The floating structure as a whole is an ultra-flat form. By proposing multiple between the scale in the horizontal direction and the distance from the structural center of gravity to the static waterline, the overall structure is allowed to have an extremely great metacentric height (2 to 3 orders of magnitude higher than the industry standard) and an extremely large righting arm, then under extreme conditions, no overturning still can be guaranteed, and definite basic safety can be provided.

19. The anti-overturning capability of existing ships and ocean platforms is limited, and all of external effects and human misoperations causing overturning are random and can only be handled by probabilistic methods. However, in the present disclosure, by combining the structures such as the ultra-flat space structure, multiple floating bodies that can be solidified, and the intermediate connection structure capable of providing reserve buoyancy, the anti-overturning capability is ensured under the most unfavorable sea conditions and "extreme accident conditions", realizing changes of anti-sinking and anti-overturning capabilities from "probabilistic" to "definite". For the most basic safety norms, especially personnel life safety norms, of ships and ocean platforms, large-scale adjustment, simplification and exemption can be made with reference to terrestrial-related norms, which can revolutionarily change human marine activities.

In summary, the main characteristics of the floating structure of the present disclosure are: small wave load, large scale, large bearing capacity, shallow draught, good performance in waves, high safety, and capability of forming a large operation space.

It can be seen from the above technical solutions that the beneficial effects of the floating structure in the present disclosure lie in:

1. The floating structure has a variety of beneficial high-safety characteristics, and solves the basic problems of exploring and developing the sea world.

The floating structure of the present disclosure as a whole adopts a hyperstatic spatial combination structure, which is ultra-flat on the whole, and combined in a manner of combining the lower floating body structures, the upper structure and the intermediate connection structures, and some of floating bodies located at the outer side in the lower floating body structures are solid-like floating bodies, a sum of the displacement volumes of the above solid-like floating bodies is larger than the equivalent water volume of the full weight of the floating structure, and the lower floating body structures are arranged in a dispersed manner and is a very large waterplane area structure. The above technical measures are organically integrated and combined to function, so that the floating structure of the present disclosure has small response to wave load, small motion response, good performance in waves and loading capacity. At the same time, the floating structure has excellent stability, can greatly simplify the stability calculation and check, reduces the design workload, is insensitive to sea conditions and operating load changes, and greatly simplifies the cumbersome loading and ballast requirements set for ensuring structural "stability", without the need to provide a large-capacity ballast tank and complex ballast operation due to stability problem, while large-capacity ballast tank is closely related to safety, and when the large-capacity ballast tank is damaged out of specifications, it may cause overturning and sinking. If the void compartment of the ship is sealed to be solid, the ship cannot be ballasted when it is in unloaded state, then the draught is too shallow, and stability cannot be ensured; similarly, for the semi-submersible platform, if the lower floating bodies and the upright column void compartment are sealed to be solid, it also cannot be ballasted, and transition between semi-submersible and non-semi-submersible working conditions cannot be realized, (in the semi-submersible state, migration cannot be carried out, and in the non-semi-submersible state, operation cannot be carried out). Therefore, ships and semi-submersible platforms, if they are to realize their functions, must be equipped with a ballast tank.

The structural overall safety of the floating structure of the present disclosure is determined, and the structural failure mode thereof is essentially different from those of ships and semi-submersible platforms. In the event of encountering the most unfavorable sea conditions that are foreseeable and occurring the most unfavorable collisions, rock striking, stranding, abnormal displacement of goods and other accidents that are recorded, although the structure may be locally damaged, it subsequently will not cause worse conditions, thus fundamentally completely eliminating overall fracture and disintegration of the entire floating structure, such that after an accident occurs, personnel can still rely on the huge safety space provided by the structure itself and a relatively large amount of resources to maintain survival of more persons, and wait for rescue, greatly avoiding life-threatening hazards for personnel caused by disappearance of personnel and limited time to sustain life that may occur during the escape and rescue process and after ship abandonment, thus providing the most basic and reliable guarantee conditions for ensuring life safety of persons thereon.

The anti-overturning capability and anti-sinking performance of existing ships and ocean platforms are both limited, and all of external effects and human misoperations causing overturning and sinking are random and can only be handled by probabilistic methods. However, in the present disclosure, by combining the technical means such as the ultra-flat, hyperstatic spatial combination structure, solid-like floating bodies, the intermediate connection structures that are arranged in a dispersed manner and provide a safe righting force, and the lower floating body structures in a very large waterplane area contour profile, it is realized the anti-overturning and anti-sinking capabilities "in the event of encountering the most unfavorable sea conditions that are foreseeable and occurring the most unfavorable collisions, rock striking, stranding, abnormal displacement of goods and other accidents that are recorded", and it is realized that the anti-overturning and anti-sinking capabilities are changed from "probabilistic" to "definite". For the most basic safety norms, especially personnel life safety norms, of ships and ocean platforms, large-scale adjustment, simplification and exemption can be made with reference to terrestrial-related norms, which can revolutionarily change human marine activities.

2. Sensitivity of the safety of the floating structure to the influence of human factors is reduced, greatly simplifying the complexity of the management system and the running costs.

The structure itself of the floating structure in the present disclosure has high safety, and no matter what kind of function is correspondingly used, even if misoperation due to human factors occurs, it will not cause catastrophic consequences causing casualties. Therefore, the influence of misoperation on the overall safety of the floating structure can be greatly reduced, and the management system and running program of the floating structure can be effectively simplified. By improving the safety of the floating structure itself, it greatly facilitates market access, use, management, operation and so on.

3. The universality of the floating structure is greatly improved, such that the degree of the floating structure design depending on the use function is greatly reduced.

The upper structure of the floating structure in the present disclosure may be realized in two ways: a space frame structure and a box (conventional shell) structure. Use of the space frame structure enables the design of the upper structure more flexible.

The frame structure refers to a structure in which beams and columns are connected with each other in a rigid connection manner to constitute a load-bearing system, that is, the beams and columns forming the space frame jointly resist various loads that appear during use.

It should be understood that the beam-column structure of the upper structure may be in any beam-column structure form meeting requirements of the structural safety level. For example, a plurality of vertical or transverse truss type support structures may be utilized to form the upper structure, meanwhile, a plurality of functional compartments are separated.

When the upper structure is realized in a manner of forming the frame structure with the space beams and columns, structural design freedom (or flexibility) of the upper structure will be greatly increased compared with the designs of conventional ships and floating structures, and design and arrangement of the upper functional compartments can be changed flexibly. The modifiable space of the upper structure will be greatly increased, the main bearing structures are beams, columns and other supports (possibly none), and remaining members (split parts between decks and operation compartments, upper and lower plates of the operation compartments, etc.) can be designed as non-main bearing structures, and only bear local functional loads but do not participate in the overall structural stress of the floating structure. Due to the above characteristics, all the non-main bearing structures of the floating structure can be arbitrarily changed under the premise of satisfying the local functional load without affecting the overall structural stress; non-metallic materials also can be considered for the non-main bearing structures so as to greatly reduce the cost of corrosion protection; it also can be considered to connect the non-main bearing structures to the main bearing structures by means of assembling (non-welding).

4. The use safety and convenience of the floating structure is greatly improved.

In the present disclosure, the small-scale floating bodies that are arranged in a dispersed manner are used for the lower floating body structures, therefore, the floating structure has an extremely large waterplane area and an extremely large initial stability (GM) value, relatively small draught change under unloaded state and full load state, without the need to provide a large-capacity ballast tank, without the need to check the stability when the conventional integrity stability and the most unfavorable environmental factors are stacked, including the case where all the load mass is unbalancedly loaded intensively in a 50% region in any direction. The floating structure in the present disclosure has high safety, excellent "stability" and "performance in waves", and is insensitive to various load changes, and has unique stiff anti-swing capability. Therefore, the universality of the floating structure, relative to different use functions, can be greatly improved, which is distinguished from the characteristic that the prior art ships are severely restricted to use functions, for example, large vessels may be allowed to berth directly at the platform of the present disclosure in unshielded sea areas.

In the present disclosure, the overall structure of the floating structure is a center-hollowed space structure, the space of the intermediate connection structure above the waterline has a very small duty ratio, and air flow fields above and below the deck have little difference, thus it can reduce the variation of airflow fields on the floating structure deck, and can provide more safe and more stable air flow field conditions for takeoff and landing of various aircrafts than conventional box-type floating bodies (ships).

In the present disclosure, the floating structure has an upper surface space of an extra-large area and an upper operation compartment of an extra-large volume, meanwhile, an available space of extra-large volume is present between the upper structure and the lower floating bodies, and there is a working region of an extra-large area near the water surface, therefore, various operation functions such as carrying and hanging can be quite conveniently realized. The overall functional arrangement thereof can be dominated by arrangement along a plane. In circumstances where people are crowded on the floating structure, it is more conducive to the isolation design and evacuation arrangement of personnel in fire-like accidents, compared with the arrangement dominated by vertical arrangement of multiple floors.

In the present disclosure, the solid-like floating bodies of the floating structure can be filled in a removable manner, such that structural repair and regular maintenance are simple and easy.

In summary, the floating structure of the present disclosure is mainly characterized by high stability, high safety, and achieving the effect of not swaying dramatically, no disintegration, no overturning, and no sinking in the event of encountering the most unfavorable sea conditions that are foreseeable and occurring the most unfavorable collisions, rock striking, stranding, abnormal displacement of goods and other accidents that are recorded; great universality, with relatively low dependency of the whole structure on use function, and greatly improved design flexibility with the space frame form for the upper structure; good usability, with relatively loose requirements for overall quality of operators and overall operational management of the structure; as well as large scale, shallow draught, good performance in waves, and large operation area and large operation space.

The embodiment of the basic module of the above floating structure is described as follows: (technological significances corresponding to the technical features:)

A. The basic module proposed in the present disclosure is advantageous for reducing the wave load response, such that enough strength and stiffness still can be ensured when the main scale of the basic module is very large.

In the present disclosure, any floating body in the lower floating body structures is selected as a small sectional area elongated floating body, and meanwhile, each floating body in the floating body structures is selected to be spaced apart by a certain distance, therefore, each floating body is arranged in a dispersed manner in the space, and the dispersedly arranged floating bodies create a condition of fluid motion and energy release for the waves to cross (pass by) the floating bodies, ensuring smooth flowing of the waves between the floating bodies, so as to reduce the destructive load of huge waves on the floating bodies.

It is exemplified that the main scale of a section of a single lower floating body is selected to be smaller than the main scale of the maximum wave height (such as 0.5 times), and at the maximum wave height, some of the waves will cross the floating bodies, some of the floating bodies will break away from the waves, and the wave load will no longer significantly increase with the increase of the wave height, that is, the response of the platform wave load to the wave height appears nonlinear, thus the wave load of the floating structure during large waves can be greatly reduced.

A cross section of the basic module of the embodiment of the present disclosure can be analogized to an I-shaped section, wherein the upper structure and the lower floating body structure are analogized to upper and lower flanges, and the intermediate connection structure is analogized to a web, therefore, the effect of the material can be sufficiently exerted.

As the basic module of the embodiment of the present disclosure can sufficiently exert the effect of the material and reduce the wave load, under a relatively large scale condition, it is easy to ensure enough strength and stiffness of the basic module, and avoid the complex influence of hydroelasticity phenomenon on the load calculation of the basic module. The basic module of the present disclosure may have a larger main scale than various conventional floating structures, and can be structurally designed as a "rigid body". For example, when the scale of the basic module of the present disclosure reaches about 600 meters, the strength specification requirements can still be met under extreme sea conditions, and under the effect of the maximum total longitudinal bending moment, the total longitudinal bending deflection thereof can be no more than 1/400 of the length of the basic module.

B. Each floating body of the lower floating body structures of the basic module of the embodiment of the present disclosure has a relatively small scale and is arranged in a dispersed manner, and has the characteristic of a very large waterplane area contour profile, with little influence of the draught changes on the stability under unloaded state and full load state, and has extremely high stability under both unloaded state and full load states.

Any floating body of the basic module of the embodiment of the present disclosure has a relatively small section height dimension, and each floating body in the lower floating body structures is spaced apart by a certain distance. Therefore, the static waterline of the basic module of the embodiment of the present disclosure is necessarily within a height range of the floating body, such that the overall draught of the basic module of the embodiment of the present disclosure is very shallow.

A single floating body has a relatively small sectional dimension, then each floating body has a relatively small volume, therefore, the floating body should have a certain length and quantity to have a certain total displacement volume. If the floating bodies are arranged together without an interval, it is a "bamboo raft" type, flat-box floating body structure, and combined with the bearing capacity requirements, the flat floating body structure necessarily have a very large waterplane area, and its waterplane area will be much larger than conventional ships and floating platforms. It should be emphasized that a large waterplane area necessarily is generally accompanied by a relatively large response to the wave load, while a quite large waterplane area and a relatively small wave load are simultaneously achieved skillfully in the present disclosure with the dispersed arrangement of the multiple floating bodies. The waterplane area herein refers to the area of a section formed by the intersection of the horizontal plane at the waterline and the floating bodies. As the waterline changes in the waves, and may exceed the range of the floating body height, the waterline referred to herein is a static waterline.

The length and breadth distribution dimensions of the multiple lower floating bodies of the basic module of the embodiment of the present disclosure in the horizontal plane are equal to or greater than 4 times the height from the center of gravity to the still water surface when the basic module is in unloaded state, therefore, the basic module as a whole is in an ultra-flat state, with the characteristics of a very low center of gravity and very high metacenter, and the GM value of the basic module can be more than two orders of magnitude higher than those of conventional platforms and ships.

In the basic module of the embodiment of the present disclosure, various floating bodies are arranged in a dispersed manner, and the distance from the static waterline to the top of the floating bodies is relatively small, which is favorable for waves to smoothly pass and cross the floating bodies, and can effectively reduce the wave load.

Under the excitation of the wave load, the basic module has a small motion response, roughly equivalent to the motion response of the semi-submersible platforms. It should be noted that the two are implemented by completely different principles. The semi-submersible platform is a typical small waterplane structure, and has very small anti-swing stable stiffness. The basic module of the embodiment of the present disclosure is a structure in a very large waterplane contour profile, and has extremely high anti-swing stable stiffness.

Meanwhile, as the basic module is a structure in a very large waterplane area contour profile, and the floating bodies are arranged in a dispersed manner, it has very strong righting force and righting moment, and when the load changes, the resulting motion change is quite small, then compared with the semi-submersible platforms, it has relatively high anti-swing stable stiffness, and the swaying motion response caused by load changes is at least one order of magnitude smaller.

C. The basic modules proposed in the present disclosure can be conveniently connected with each other.

The basic module proposed in the present disclosure is provided with two or more cable traction devices for connection in a bow portion, a stern portion and/or a broadside, and meanwhile, it is proposed that connection devices for connecting and separating the modules are provided in the bow portion, the stern portion and/or the broadside of the basic module.

In the connection process, the two or more cables are used for traction, meanwhile, full-revolving propelling devices of two basic modules are required to propel in opposite directions, such that the cables are always kept in tension, and by controlling a pulling force of the traction device and a thrust of propellers, it is realized that the two basic modules get close to each other in a controlled state, and positioning and guiding between the basic modules can be realized, such that a contact load between the basic modules with huge mass is minimized, preventing damage to the module structure caused by the contact load.

An implementation manner of connector device can adopt practices with mature engineering implementation experience such as mechanical structure and electromagnetic structure, and rapid connection and rapid separation can be conveniently realized. It should be noted that the connector device apparently can be provided at the broadside of the basic module so as to achieve lateral connection between the basic modules.

Through different combinations of setting positions and numbers of the connection devices in end portions of the basic modules, whether the basic modules are in "hinged connection" or "rigid connection" can be conveniently controlled. For example, four connection devices, eight connection devices in total, are respectively provided on an upper part and a lower part of the end portion of the basic module, and when only the upper four connection devices are connected, the "hinged connection" can be realized; when the upper and lower eight connection devices are simultaneously connected, "rigid connection" can be realized.

D. The basic module provided in the present disclosure has high safety.

The basic module provided in the present disclosure is a hyperstatic combined space structure, and can ensure that the overall structure still has definite safety that the structural integrity will not be lost even if local structure is damaged in the event of encountering the most unfavorable sea conditions that are foreseeable and occurring the most unfavorable collisions, rock striking, stranding, abnormal displacement of goods and other accidents that are recorded.

The basic module is a combination of the upper box structure, the intermediate connection structures and the lower floating body structures. The lower floating body structures are selected to include five or more elongated floating bodies, and each elongated floating body is selected to have five or more small waterplane structures intersecting the horizontal plane, therefore, the whole structure of the basic module spans four or more spans in any horizontal direction, wherein one span herein refers to a distance between two adjacent elongated floating bodies and a distance between two adjacent intermediate connection structures. Therefore, the basic module is a unitary structure at least composed of five elongated floating bodies, 25 upright columns and one spatially continuous upper box structure (hyperstatic unit). According to the knowledge of structural mechanics, 2 lower elongated floating bodies, 4 upright columns and corresponding part of the upper box structure (which can be analogized to a semi-submersible platform) can form an airtight hyperstatic spatial structural unit, therefore, the basic module of the present disclosure is, in any direction, a continuous combination of at least four hyperstatic spatial structural units, and viewed on the whole, the basic module of the present disclosure is a combined structure at least composed of 16 hyperstatic spatial structural units, and damage of some of the units (local structural failure) caused by accidents such as collisions and rock striking will not pose a threat to the overall structural safety. Therefore, the whole structure has very large accident safety redundancy in terms of disintegration resistance.

From the structural composition analysis of the basic module, it can be found that the lower floating body structures and the intermediate connection structures thereof are both in a large number and arranged in a dispersed manner. When the structure is stressed, each built-up member works synthetically in a relatively "balanced" manner. In the event of encountering the most unfavorable sea conditions that are foreseeable and occurring the most unfavorable accidents such as collisions, rock striking, stranding, abnormal displacement of goods, etc. that are recorded, even if some members of a certain or even several hyperstatic spatial structural units are damaged and out of service, the remaining structure is still a combined structure composed of the hyperstatic spatial structural units, and still can work normally.

For the ships and the ocean platforms in the conventional technology, key components, important components, secondary members and the like are classified according to importance of the members and different stressed states. However, various stressed members of the basic module of the embodiment of the present disclosure are of substantially equivalent importance, and can support each other, without the risk of successive failures and overall collapse of relevant structures due to failure of "soft spot" components.

Distinguished from the semi-submersible platform, subdivision of the semi-submersible platform floating body is limited, and when the floating body or the upright column is damaged to a relatively great extent, a floating cabin will be damaged and a large amount of water will enter, at this time, if an inflow water flow is greater than a discharge capacity of an emergency drainage system, an overall floating status of the platform will inevitably change, leading to a series of chain reactions such as deterioration of structural stress, eventually, it may cause catastrophic consequences of heeling, rupture or even overturning or sinking.

E. The basic module proposed in the present disclosure has full-time autonomous navigation capability under various working conditions.

As the basic module is mounted with the full-revolving propelling device, it has relatively good maneuverability.

In the present disclosure, the basic module is selected to be mounted with the full-revolving propelling device, and as the draught is very shallow, if the floating body adopts an slender shape, the resistance is relatively small, and it is also easy to reach a relatively high navigational speed under the condition of large scale. In terms of power configuration, specifically, a plurality of full-revolving propellers can be arranged on the bow portion and the stern portion of each elongated floating body of the lower floating body structures. These propellers have a certain distance in the front and back and can rotate omnidirectionally, can generate a huge yaw moment according to needs while generating an omnidirectional thrust, and has extremely strong ability of heading control. Specifically, the basic module further can be provided with a sail, a direct-push propeller, a rudder and so on, such that the basic module can be enabled to have good autonomous maneuverability including front-back, lateral, oblique and in-situ rotation. An encounter angle between the basic module and the wind waves also can be effectively adjusted according to the need of safety. The basic module has the ability to escape and evasive in advance, and can effectively avoid storms. Meanwhile, the basic module easily achieves dynamic positioning.

It can be seen from the above technical solutions that the beneficial effects of the basic module of the floating structure (VLFS) of the present disclosure lie in:

1. The basic module itself of the embodiment of the present disclosure can realize scale enlargement.

As the lower floating body structure is in a very large waterplane area contour profile, can reduce the wave load, and meanwhile has excellent stability, and as a whole presents an I-shaped-like section structure, the basic module itself of the embodiment of the present disclosure can have a large scale and excellent performance in waves. It should be noted that contrary to the semi-submersible platform, what is adopted in the present disclosure is designing an inherent motion cycle on a short-period side outside an area where the wave spectral energy is intensively distributed in a relatively large sea condition, wherein the inherent motion cycle of the basic module is about 5 seconds, while the distribution of the wave energy is very small below this cycle, achieving excellent performance in waves.

The scale of the basic module reaches 400-800 meters, therefore, it only needs to make the connection once to form a floating structure with a scale of 800 m to 1600 m.

2. The basic module of the embodiment of the present disclosure facilitates realizing the floating structure (VLFS).

The present disclosure and the semi-submersible small waterplane structure both have good performance in waves, but the present disclosure has greater advantages in the problem of splicing the basic modules of the floating structure. When the wave excitation and the load change act in combination, a motion amplitude value and a response cycle of the basic module both are relatively small, that is to say, it has relatively strong anti-swing stable stiffness, which is beneficial to the splicing operation between the modules. The swaying motion response caused by the load change will be at least one order of magnitude smaller than the semi-submersible structure. At the same time, once swaying occurs, the semi-submersible structure will stop only after several reciprocating cycles, while the basic module of the present disclosure will stop very quickly, which is advantageous to reduce relative movement between the modules during the complex operation of assembling the basic modules.

The basic module has quite strong characteristics of reducing the wave load, quite strong capacity of resisting wave-excited motion, and quite strong anti-swing stable stiffness, and can greatly reduce the motion amplitude value of the basic module in the waves, and further greatly reduces relative swaying motion of a splicing process between the basic modules and the connector load after the splicing. The connection process is simple, with low connection difficulty, and good operability. Without the need to adjust the balance with a large quantity of ballast water, the operational complexity of the floating structure (VLFS) is greatly simplified.

3. The basic module of the embodiment of the present disclosure can be used for large ships to directly berth.

The basic module of the embodiment of the present disclosure has a wave shielding effect, forming a good berthing condition on water. The basic module has a large scale, and the dispersed floating bodies, with a wave-absorbing characteristic, form a relatively large area of shielding region on a leeward and backwave side of the structure. The structure itself has good stability, can provide high enough mooring restraint ability for ship berthing, and can provide conditions for ships to directly berth.

4. The basic module of the embodiment of the present disclosure has quite strong universality, such that the degree of the structure design depending on use function is greatly reduced.

The upper structure of the basic module of the embodiment of the present disclosure may be realized in two ways: a space frame structure and a box (conventional shell) structure. The use of the space frame structure enables the design of the upper structure more flexible.

The frame structure refers to a structure in which beams and columns are connected with each other in a rigid connection manner to constitute a load-bearing system, that is, the beams and columns forming the space frame jointly resist various loads that appear during use.

It should be understood that the beam-column structure of the upper structure may be in any beam-column structure form meeting requirements of the structural safety level. For example, a plurality of vertical or transverse truss type support structures may be utilized to form the upper structure, meanwhile, a plurality of functional compartments are separated.

When the upper structure is realized in the manner of frame structure formed by the space beams and columns, the structural design freedom (or flexibility) of the upper structure will be greatly increased compared with the designs of conventional ships and floating body structures, and design and arrangement of the upper functional compartments can be changed flexibly. The modifiable space of the upper structure will be greatly increased, the main bearing structures are beams, columns and other supports (possibly none), and remaining members (split parts between decks and operation compartments, upper and lower plates of the operation compartments, etc.) can be designed as non-main bearing structures, and only bear local functional loads but do not participate in the overall structural stress of the basic module. Due to the above characteristics, all the non-main bearing structures of the basic module of the embodiment of the present disclosure can be arbitrarily changed under the premise of satisfying the local functional load, without affecting the overall structural stress; non-metallic materials also can be considered for the non-main bearing structures so as to greatly reduce the cost of corrosion protection; it also can be considered to connect the non-main bearing structures to the main bearing structures by means of assembling (non-welding).

The basic module of the embodiment of the present disclosure has the characteristics of excellent "stability" and insensitivity to load changes, therefore, the universality of the floating structure, relative to different use functions, can be greatly improved, which is distinguished from the characteristic that the prior art ships are severely restricted to use functions.

5. The use convenience and overall safety of the floating structure (VLFS) that is movable is greatly improved.

The small-scale floating bodies that are arranged in a dispersed manner are used for the lower floating body structures of the basic module of the embodiment of the present disclosure, therefore, there is a large waterplane area and a large initial stability height (GM), draught changes little under unloaded state and full load state, without the need to provide a large-capacity ballast tank.

The GM value of the basic module is up to several hundred meters, which is one to two orders of magnitude higher than that of conventional semi-submersible platforms, and increases an allowable limit height of center of gravity to the hundred-meter level, then it can easily provide large facilities with a relatively large height on the basic module, such as large-scale hoisting equipment, ultra-high radar antennas, sea ferris wheels, and sightseeing towers at any broadside, such that the floating structure (VLFS) that is movable has a wider application range, and has a significant commercial value.

The basic module of the embodiment of the present disclosure still has relatively small draught even in a full-load operation state, meanwhile, it has autonomous navigation capability, and therefore, it is used in a wide range of water area. However, the basic module of the semi-submersible structure is not suitable to operate in shallow sea, cannot navigate during deep-sea operation, and cannot operate during migration.

The overall structure of the basic module of the embodiment of the present disclosure is a center-hollowed space structure, the space of the intermediate connection structure above the waterline has a very small duty ratio, and the structure disturbs the air flow fields little, thus it can reduce variation of airflow field on the deck of the floating structure, and provide safer conditions for takeoff and landing of various aircrafts than conventional box-type floating bodies (ships).

The basic module in the embodiment of the present disclosure has an upper surface space of an extra-large area and an upper operation compartment of an extra-large volume, thus can quite conveniently realize various use functions, meanwhile, the overall functional arrangement thereof can be dominated by arrangement along a plane. In circumstances where people are crowded on the basic module of the embodiment of the present disclosure, it is more conducive to the isolation design and evacuation arrangement of personnel in fire-like accidents, compared with the arrangement dominated by vertical arrangement of multiple floors.

The basic module of the embodiment of the present disclosure has multiple layers of operation spaces that can be used for development, such as a high altitude area above the deck, an upper deck area, an intermediate compartment area, a water surface area, an underwater area, and a broadside area and the like, which can greatly enhance the use functions of the floating structures (VLFS) that is movable.

The solid-like floating bodies of the basic module of the embodiment of the present disclosure can be filled in a removable manner, such that structural repair and regular maintenance are simple and easy.

At least some of floating bodies located at the outer side in the basic module of the embodiment of the present disclosure adopt solid-like floating cabins, and a sum of displacement volumes thereof is greater than the equivalent water volume of full weight when the floating structure is fully loaded, and therefore, no matter the structure suffers from what kind of partial damage, as long as the overall structure of the basic module is not disintegrated, it can definitely ensure that the entire structure cannot sink, thus having the characteristic of good overall structural safety.

In summary, the main characteristics of the basic module of the floating structure (VLFS) that is movable of the present disclosure are as follows: the structure itself can have a large scale, small wave load, good performance in waves, good stability, and insensitivity to variable load changes; it is easy to form a floating structure (VLFS) by splicing, with a simple connection process, low connection difficulty, good operability, and small connector load; the universality is great, the whole structure has relatively low dependency on use function, and the design flexibility can be greatly improved with the space frame form for the upper structure; meanwhile, under various working conditions, it has autonomous omnidirectional navigation capability, maneuverability and better safety, and has multiple layers of operation spaces that can be used for development.

Explanation of Terms

"Floating body structure": It refers to integration of a plurality of floating bodies. It provides necessary buoyancy to the floating structure. The so-called necessary buoyancy refers to buoyancy required to maintain the bearing capacity and normal stability of the floating structure. The floating body structures in the present disclosure may be various combinations of a plurality of floating bodies, may be dispersed arrangement of a plurality of floating bodies on a horizontal plane, or may be a relatively independent three-dimensional space structure formed by assembling a plurality of floating bodies with necessary connection members. It should be noted that in order to provide the buoyancy, the floating body structures necessarily will bear the wave load, but in the present disclosure, it can be selected according to specific situations that the floating body structures are enabled to take part in the overall stress of the floating structure, or that the floating structure is only enabled to bear local wave load, but not take part in the overall stress of the floating structure.

"Solid-like floating body": It refers to a floating body that has quite low permeability (for example, the damage permeability is <10%) when being damaged, and neither stability nor anti-sinking performance will be affected even if the floating body is damaged. It includes a floating cabin structure with internal sealing measures and a light solid water blocking member directly connected with the intermediate connection structure of the floating structure.

"Hyperstatic combined space structure": It means that the floating structure as a whole is a three-dimensional space structure, and it is hyperstatic. Its overall structure is a combination of the upper box structure, the intermediate connection structures and the lower floating body structures. The upper box structure can be composed of a plate structure with reinforced ribs, wherein the reinforced ribs may be plates and/or various sectional materials, and wherein the various sectional materials may be I-steel, angle steel, channel steel and so on. The box structure can be composed of a frame structure formed by a larger number of beams and columns and/or supports and inner and outer plate structures with reinforced ribs. The upper box structure itself is a spatially continuous hyperstatic unit. The intermediate connection structure may be a frame structure formed by column structures and/or beam structures arranged in a dispersed manner, may be a space truss structure composed of rod structures arranged in a dispersed manner, or may be a reasonable combination of a frame structure and a truss structure. The floating body structures are formed by combining a plurality of floating bodies in a variety of manners, and it may be a hollowed, net-shape, sheet structure formed by a plurality of floating bodies arranged in a dispersed manner on a horizontal plane, or a relatively independent three-dimensional space structure formed by assembling a plurality of floating bodies with necessary connection members.

"Intermediate connection structure": It includes various structures or members connected between the lower floating body structures and the upper structure. The intermediate connection structure intersecting the horizontal plane provides a safe righting force.

"Safe righting force": When the floating structure sways with large inclination, the intermediate connection structure intersecting the horizontal plane enters water, has a certain displacement volume, can provide buoyancy, and thus forms a righting moment as having a relatively large righting arm, such that the total righting moment of the floating structure can be greater than the maximum overturning moment received by the floating structure under the possibly appeared combined action of wind, wave, etc., which can make the floating structure have the safety of not overturning, therefore, the righting force that can be provided by the intermediate connection structure intersecting the horizontal plane is called as "safe righting force".

"Elongated floating body" refers to a watertight housing with a dimension in the longitudinal direction much greater than a dimension in the transverse direction. It provides necessary buoyancy to the floating structure. The so-called necessary buoyancy refers to buoyancy required for enabling the floating structure to float on water surface.

"Reserve buoyancy": The "reserve buoyancy" in "the connection structures in the first direction include a plurality of upwardly extending floating bodies providing reserve buoyancy" in the present application means that when the floating structure is heeled at an extremely large angle, the floating bodies of the connection structures in the first direction enter water, and can provide a certain waterline area and buoyancy, and due to its relatively large dispersion distance, it is in turn has a relatively long righting arm, which can provide an extremely large righting moment.

"Very large waterplane area contour profile": It refers to a large waterplane area contour profile arranged in a dispersed manner. The waterplane area contour profile is an important feature of the present disclosure. In the field of ocean engineering, at present, there is not yet a specific definition for the waterplane area contour profile. The waterplane area contour profile described in the present disclosure focuses on the relationship between the total waterplane area and the total displacement (it is directly related to the magnitude of draught changes of the floating structure under unloaded state and full load state), as well as the relationship between the waterplane area distribution and the load distribution (it is directly related to the load distribution and the magnitude of the floating status change), further affecting important properties such as stability, the floating structure's response to load changes and performance in waves. Conventionally, in the field of ocean engineering, conventional ships are considered to be typical large waterplane structures, and their structural features are in large waterplane area contour profile; while "small waterplane structure" is to distinguish the large waterplane area morphological feature of conventional ships rather than specific waterplane area data, for example, the semi-submersible platform is a typical small waterplane structure; the "very large waterplane area contour profile" in the present disclosure is also directed to the large waterplane area contour profile of conventional ships, and the draught change of the floating body structures in the present disclosure is much smaller than that of the conventional ships and the floating bodies are arranged in a dispersed manner. In order to distinguish it from the conventional ships, this feature is called as very large waterplane area contour profile. In addition, natural periods of heaving, rolling and pitching of the floating structure in the "very large waterplane area contour profile" are all much smaller than wave spectral peak period during the largest sea condition.

"Full-load state" refers to a state when the floating structure is loaded at the maximum.

"Upper structure" refers to a space structural component that is required to be provided, for forming the whole structure of the floating structure, away from the water surface, and is not allowed to be touched by waves in large storms in a normal state. The upper structure may be a frame structure or a box structure. Its upper portion may be a deck, its inner portion may be an operation compartment, living compartment, various functional compartments and so on.

"Maximum wave height": The maximum wave heights in different water areas are different, and statistical data in the same water area is also different. The maximum wave height described in the present disclosure refers to the largest maximum wave height shown in various design references for an applicable water area.

"non-absorbent material": It refers to a material with a lighter specific gravity than water and having a very low water absorption.

When it is used to fill up the floating body, no damage to the floating body will cause buoyancy loss, therefore, the damage stability is substantially equal to the intact stability.

"Extreme accident condition" refers to a specific condition such as recorded collisions, rock striking, and stranding that may be encountered by the floating structure.

Anti-swing stable stiffness: It refers to stiffness of the righting force and moment caused by hydrodynamics, depending on the waterplane area and the waterplane area moment. The greater the waterplane area and the waterplane area moment is, the higher the anti-swing stable stiffness is, indicating strong resistance to external interference.

Load change: Loads other than environmental loads (such as wave loads, wind loads, etc.), such as loads caused by loading and unloading of heavy objects, cargo movement, splicing operation, lifting of heavy objects at broadside, ship berthing, aircraft takeoff and landing.

It should be indicated that for working conditions such as fire disasters and explosions, although they also seriously affect the structural safety of the floating structure and the safety of persons thereon, they are not specific to the floating body structures, and they are excluded in the present disclosure.

DETAILED DESCRIPTION OF EMBODIMENTS

Typical embodiments embodying features and advantages of the present disclosure will be described in detail in the following description. It should be understood that the present disclosure can have various modifications in different embodiments, and none of them depart from the scope of the present disclosure, moreover, the description and reference signs therein are substantively illustrative, rather than limiting the present disclosure.

An embodiment of the present disclosure provides a floating structure, which may be a floating comprehensive support base that can be used for various ships to directly berth, wherein a deck can be equipped with a large loading and unloading machine to provide loading and unloading, transshipment and storage functions. A basic contour profile thereof is selected to be an ultra-flat space structure, mainly including an upper structure, intermediate connection structures and multiple lower floating bodies (lower floating body structures). This is a new floating body type that is distinguished from all ships and ocean platforms.

Figure 1:
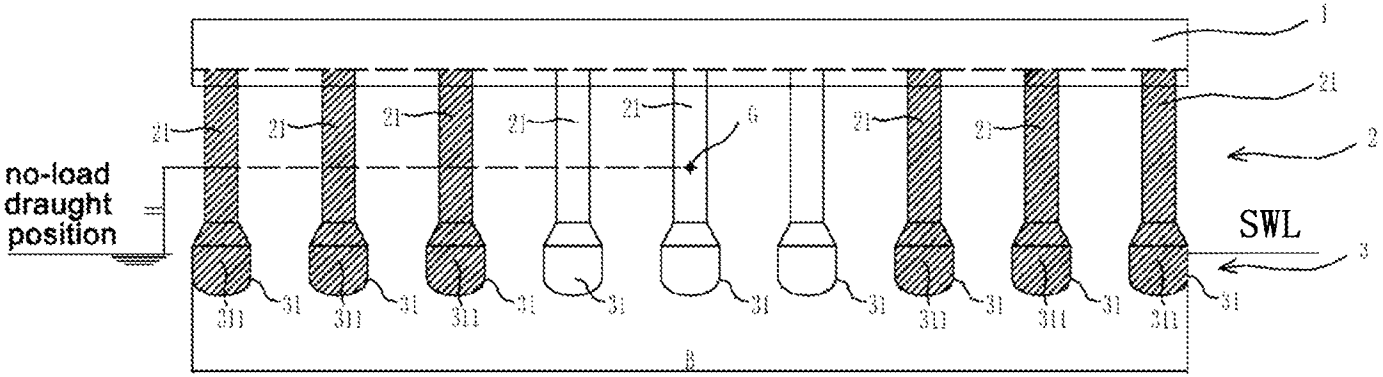
FIG. 1 is a structural schematic diagram of a front section of a floating structure in an embodiment of the present disclosure.
Figure 2:
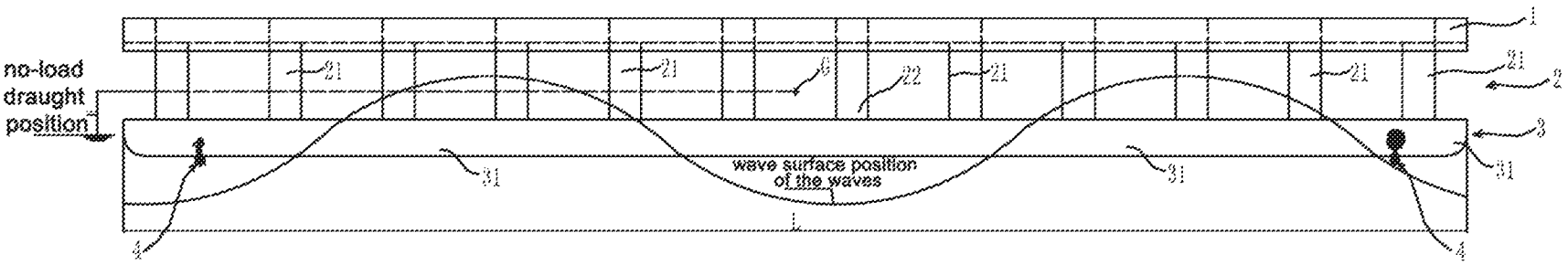
FIG. 2 is a side structural schematic diagram of the floating structure in an embodiment of the present disclosure.
Figure 3:
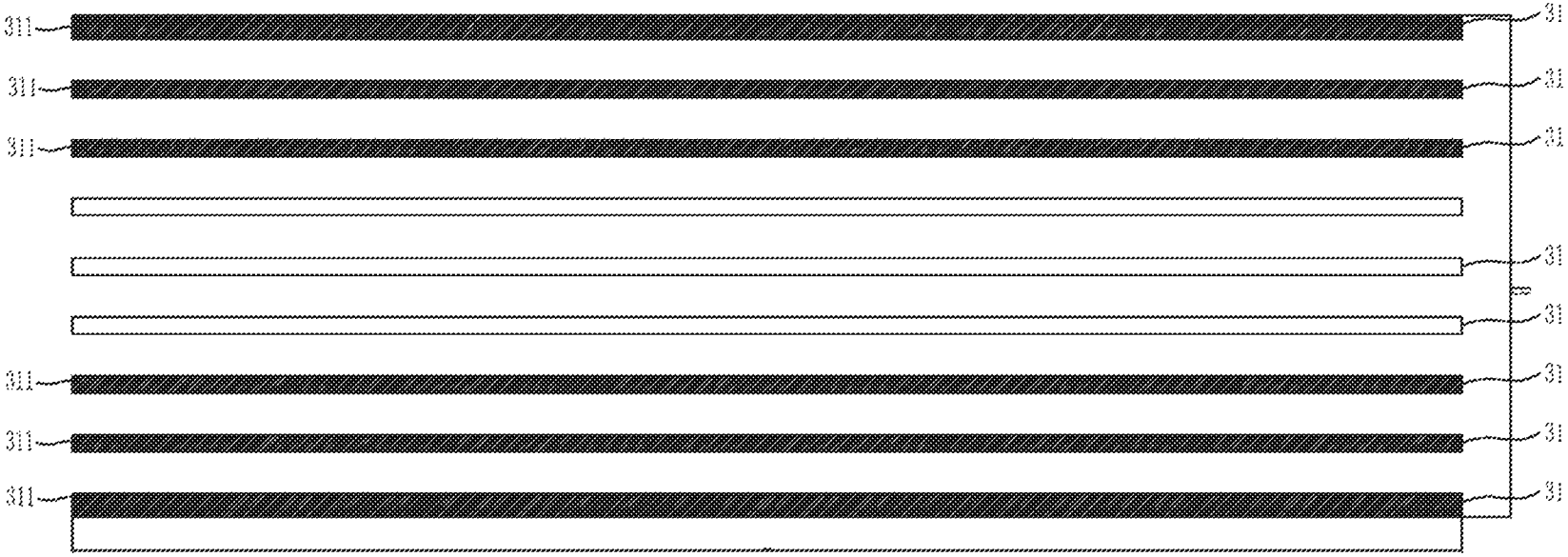
FIG. 3 is a structural schematic diagram of a top section of the floating structure in an embodiment of the present disclosure.

FIG. 1 is a structural schematic diagram of a front section of a floating structure in an embodiment of the present disclosure; FIG. 2 is a side structural schematic diagram of the floating structure in an embodiment of the present disclosure; FIG. 3 is a structural schematic diagram of a top section of the floating structure in an embodiment of the present disclosure. Referring to what is shown in FIG. 1 to FIG. 3, the floating structure in the embodiment of the present disclosure mainly includes an upper structure 1, intermediate connection structures 2, and multiple lower floating bodies 3 (lower floating body structures). Both length (L) and breadth (B) of the floating structure in a horizontal direction can be equal to or greater than 4 times a height (H) from a center of gravity to a still water surface when the floating structure is in unloaded state, and the whole has a flat shape, ensuring good "stability" of the floating structure.

An upper surface and a lower surface of the upper structure 1 are upper and lower decks, and an intermediate deck also can be added. The upper and lower decks participate in the overall structural stress. Referring to what is shown in FIG. 1 and FIG. 2, in an embodiment, the upper structure 1 may be a rigid structure realized by a frame structure, and a plurality of compartments can be selectively formed inside the upper structure 1.

The frame structure refers to a structure in which beams and columns are connected to constitute a load-bearing system, that is, the beams and columns forming the frame jointly resist a horizontal load and a vertical load that appear during use.

Referring to what is shown in FIG. 1 to FIG. 2, in an exemplary embodiment, in a height direction, single-layer distribution or multilayer distribution of at least two layers can be designed inside the upper structure 1. A plurality of compartments can be arranged in each layer, and the compartments may be arranged in a manner according to functional requirements. In the above, main structural supports of each compartment may be at least three upright columns in a vertical direction, and horizontal connecting beams in a top portion, and the connecting beams can be connected with the upright columns respectively in the top portion or a bottom portion. Transverse beams and upright columns can be connected with connectors, such as branched sleeve joints. The various components can be welded, riveted, bolted or quickly clamped. In this way, a main stable structural support is composed of the transverse beams and the upright columns. Of course, a pole-type bracing or a truss-type support structure also can be added between the transverse beams and the upright columns, such that an overall structure of the upper structure 1 meets the requirements of structural safety level.

Further, a rigid support structure can be composed of the transverse beams and the upright columns or other pole-type support structures inside the upper structure 1, for example, referring to room configuration manners of a building, individual functional compartments are formed by closing them with panels. As a wall panel is a non-bearing structure, lightweight panels can be chosen, for example, aluminum honeycomb panels, composite rock-wool panels, and light steel keel composite walls, but panels with flame retardant effect are preferred. Steel plates or other bearing plates can be chosen for the top plate and the floor.

It should be understood that the beam-column structure of the upper structure 1 may be in any beam-column structural form meeting the requirements of structural safety level. For example, a plurality of vertical or horizontal truss type support structures may be utilized to constitute the upper structure 1, and meanwhile, a plurality of functional compartments are separated.

When the upper structure is realized in the manner of the frame structural formed by the space beams and columns, structural design freedom (or flexibility) of the upper structure 1 will be greatly increased compared with designs of conventional ships and floating body structures, and design and arrangement of the upper functional compartments can be changed flexibly. The modifiable space of the upper structure 1 will be greatly increased, the main bearing structures are beams, columns and other supports (possibly none), and remaining members (split parts between operation compartments, upper and lower plates of the operation compartments, etc.) can be designed as non-main bearing structures, and only bear local functional loads but do not participate in the overall structural stress of the floating structure. Due to the above characteristics, all the non-main bearing structures of the floating structure can be arbitrarily changed under the premise of satisfying the local functional load without affecting the overall structural stress; non-metallic materials also can be considered for the non-main bearing structures so as to greatly reduce the cost of corrosion protection; it also can be considered to connect the non-main bearing structures to the main bearing structures by means of assembling (non-welding).

In another embodiment, the upper structure 1 also may be a rigid structural layer composed of a box structure, the main bearing structure is a space slab-beam structure, and members such as transverse bulkheads and longitudinal girders in the compartment, and upper and lower decks forming the compartment generally act as stressed structural members to participate in calculation of a total longitudinal strength.

The box structure referred to herein is a space box structure composed of a plurality of mutually constrained plates, and each plate is subjected to a local load, and is subjected to an undetermined distribution bending moment at four sides.

For example, the upper structure 1 may be a space box structure composed of a deck, a surrounding wall and several longitudinal and lateral bulkheads. There may be several layers of decks, for example, a main deck, an intermediate deck, and a lower deck. A main body of the upper structure 1 can be designed to have reserve buoyancy, that is, the main body of the upper structure 1 is watertight or has certain watertightness. The main body of the upper structure 1 may be an integral box structure, or may be a combination of several vertical and horizontal box structures, such as a "田 (a Chinese character)" shape, a "井 (a Chinese character)" shape, and a "Δ" shape.

For example, the structure of the upper structure 1 may be selected to have a vertical and horizontal hybrid skeleton form, main beams in each region have different directions, and at the same time, strong frames with different distances are arranged perpendicular to a length direction of the main beams, all main side wall skeletons are horizontally arranged, and all inner walls use vertical stiffener. As the frame structure is a common structural form of existing ships or offshore floating structural compartments, it is not redundantly described herein.

It should be understood that the upper structure 1 also may be selected to be formed by combining both the box structure and the frame structure. For example, longitudinal or horizontal slab beams are added to the frame structure, so as to further improve the structural strength. Of course, various upright columns and transverse beams also can be added, for strengthening, to the structure dominated by the box structure. For another example, the middle of the upper structure 1 adopts a frame structure, while an outer periphery and/or a bottom layer adopts a box structure.

The upper structure 1 of the embodiment of the present disclosure is entirely above the maximum wave height of the water area where it is used, and the plurality of compartments formed in the upper structure 1 may be selected as sealable compartments. In the case of a compartment structure with multiple layers and zones, at least compartments below the middle are normally hermetic, and existing cabin structures can be referred to. Thus, if encountering extreme situations, the upper structure 1 still can remain self-floating when the multiple lower floating bodies 3 fail.

Referring to what is shown in FIG. 1 to FIG. 2, in an embodiment, the intermediate connection structures 2 include connection structures 21 in a first direction intersecting a horizontal plane, the connection structures 21 in the first direction include a plurality of spaced-apart floating bodies that can be regarded as upward extension of the multi-floating body. This part of floating bodies belong to special function floating bodies. Under extreme conditions, when the floating structure as a whole heels at an extremely large angle, the plurality of spaced-apart floating bodies included in the connection structures 21 in the first direction are immersed in water, and can provide reserve buoyancy. As the righting arm is quite long, a relatively large righting moment is produced on the whole, which can enable the floating structure as a whole to have more reliable stability.

For example, according to current design calculation and experimental data, when a sum of sectional areas of the connection structures 21 in the first direction is greater than 5% of the waterplane area of the multiple lower floating bodies 3 at the static waterline, and when a distance from an outermost connection structure 21 in the first direction to the floating structure's center of gravity is greater than 2 times the distance from the floating structure's center of gravity to a water surface, a total righting moment of the floating structure can be greater than a maximum overturning moment received by the floating structure under the combined effect of possible wind, waves and the like, and the floating structure can be enabled to have the safety against overturning.

The plurality of floating bodies of the connection structures 21 in the first direction in the embodiment of the present disclosure may be a plurality of floating-body type connection structures intersecting at the water surface, and breadth of sections of these floating-body type connection structures in the horizontal plane is smaller than waterplane breadth of connected pontoons 31. The "breadth" refers to a dimension perpendicular to a length direction of the elongated pontoons 31. The plurality of floating bodies of the connection structures 21 in the first direction may be columnar structures, or a flat-sheet type hollowed connection structures extending upward and downward; but in the embodiment of the present disclosure, the plurality of floating bodies of the connection structures 21 in the first direction are spaced apart from each other for wave crossing, reducing an external load received by the floating structure as a whole, so as to ensure safety. The plurality of floating-body type connection structures referred to in this paragraph should be understood as meaning that each single pontoon 31 is correspondingly connected with more than three floating-body type connection structures that are spaced apart from each other.

The connection structure 21 in the first direction may include a plurality of vertical upright columns, and the upright columns are in a hollowed airtight structure. The upright columns can be divided, in terms of appearance, into round upright columns and square upright columns, equal-section upright columns and variable-section upright columns. The upright columns mostly may be equal-section round upright columns, and a few may be square upright columns. In the current analysis, the embodiment of the floating-body type connection upright columns have the advantage of bearing a small external load, and have better supporting strength. As the multiple lower floating bodies 3 include a plurality of elongated pontoons 31 arranged in a dispersed manner, the plurality of upright column-type floating bodies of the connection structures 21 in the first direction can be distributed on a plurality of rows, and various upright columns on each row are spaced apart by a certain distance, and an arrangement manner of the upright columns depends on an arrangement manner of individual pontoons 31 in the multiple lower floating bodies 3, and in principle, a plurality of upright columns are connected at intervals on each pontoon 31. A lead angle connection portion can be provided on a front side and a rear side of a joint of the upright column with the upper structure and the multiple lower floating bodies 3, and the lead angle connection portion is a hollowed structure. A standard box-type node structure can also be used at a joint of the upright column with the upper structure and the multiple lower floating bodies 3. Moreover, transport equipment such as elevators or stairs can also be installed inside the upright columns 21 so as to transport personnel or materials to the upper structure.

Figure 4:
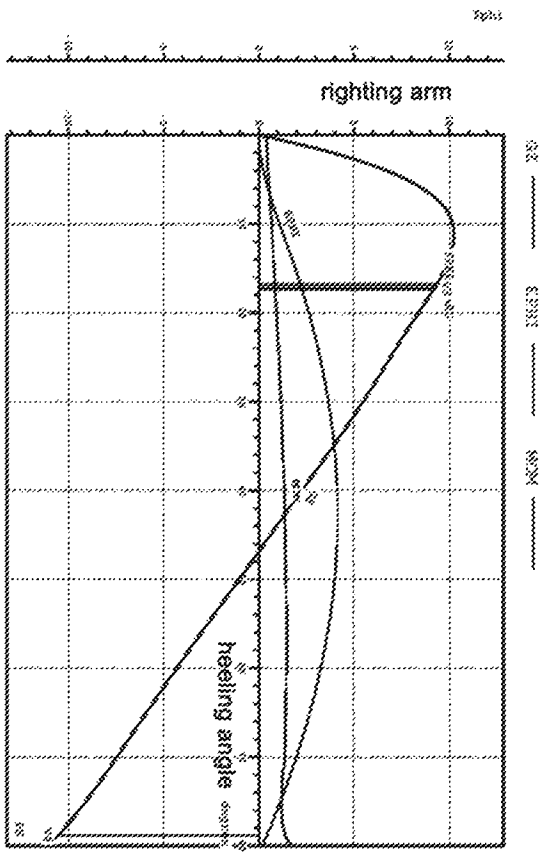
FIG. 4 shows data of overturning test when upright columns of the floating structure in an embodiment of the present disclosure provide no buoyancy.

FIG. 4 shows data of overturning test of the floating structure when the connection structures 21 in the first direction provide no buoyancy, wherein after a heeling angle exceeds 10 degrees, the righting arm of the floating structure will drop rapidly from a positive value, and after the heeling angle exceeds 45 degrees, the righting arm will have a negative value, which instead accelerates overturning of the floating structure. In the above, signs are explained as follows:

| sign | meaning | unit |
|---|---|---|
| V3, V4 | water entry | |
| GZ | righting arm | m |
| EPHI | area enclosed by a righting arm curve and a heeling angle coordinate axis | $m^2$ |
| MOM | wind heeling arm when a wind speed is 100 kn | m |
| FREEBOARD | freeboard | |

Figure 5:
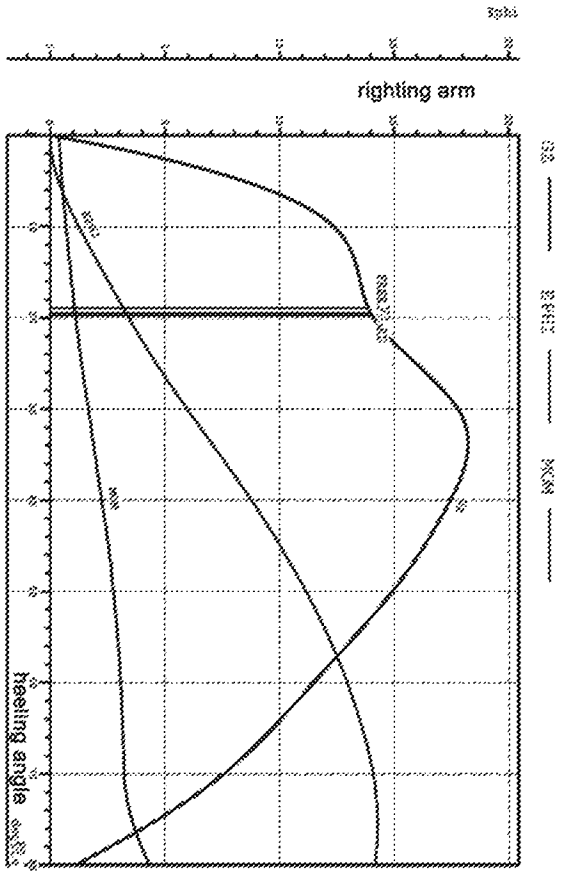
FIG. 5 shows data of overturning test when upright columns of the floating structure in an embodiment of the present disclosure provide buoyancy.

Referring to what is shown in FIG. 5, an overall sectional area of the floating-body type connection structure in the embodiment of the present disclosure is about 10% to 30% of the static waterline area of the multiple lower floating bodies 3, which can ensure continuity of upward distribution of the floating bodies, and the righting arm still has a positive value when the maximum inclination appears (the elongated floating bodies at one side all enter the water), ensuring that the floating structure still can maintain relatively good anti-overturning property under extreme conditions.

For example, the floating structure in the embodiment of the present disclosure may also be selectively provided with a plurality of connection structures 22 in a second direction, and the connection structures 22 in the second direction extend along a horizontal plane.

Figure 13:
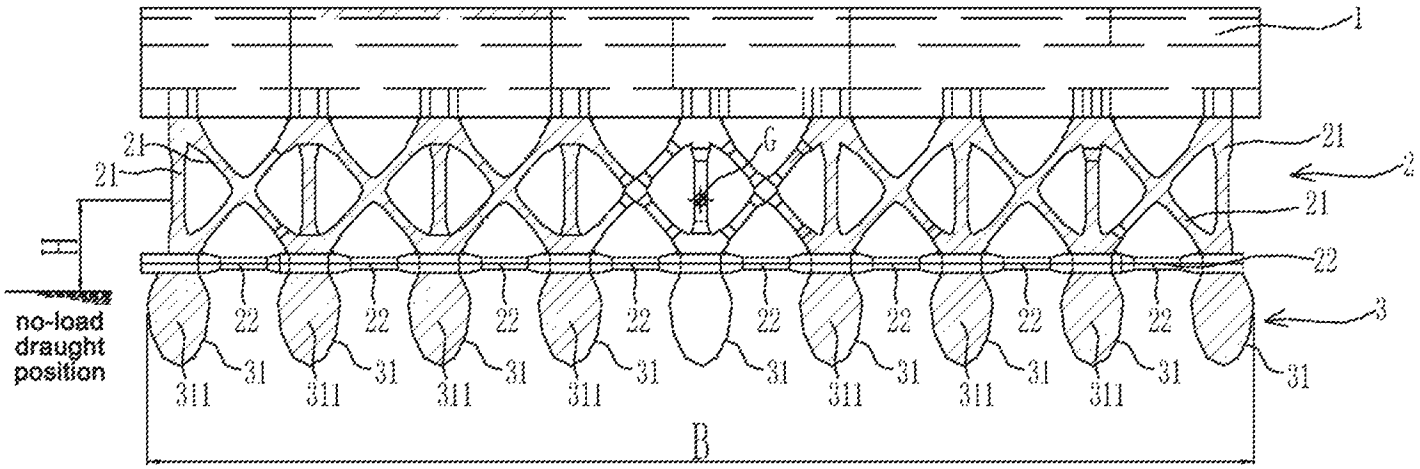
FIG. 13 is a structural schematic diagram of a front section of the large offshore floating platform exemplified according to a floating structure in an embodiment of the present disclosure.
Figure 14:
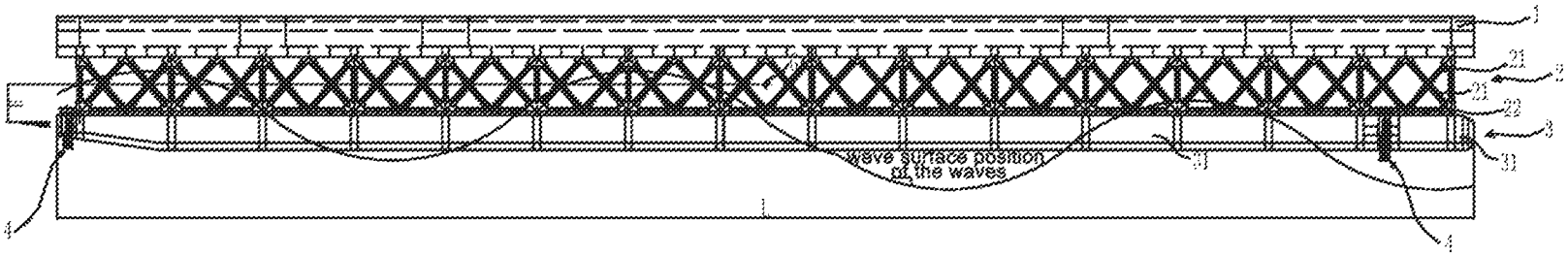
FIG. 14 is a side structural schematic diagram of the large offshore floating platform exemplified according to the floating structure in an embodiment of the present disclosure.
Figure 15:
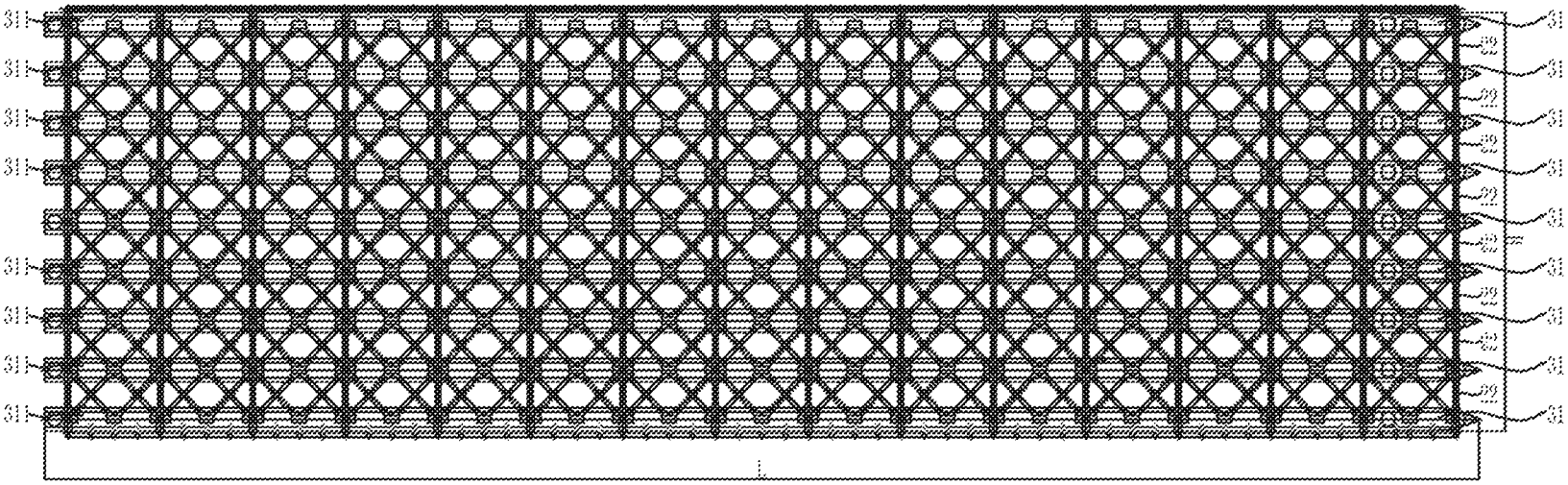
FIG. 15 is a structural schematic diagram of a top section of the large offshore floating platform exemplified according to the floating structure in an embodiment of the present disclosure.

In an embodiment of the present disclosure, upright columns of the connection structures 22 in the second direction can be formed by welding steel plates, and a shifting board or a reinforced ribbed plate can be disposed inside. For further example, in an embodiment as shown in FIG. 13 to FIG. 15, a plurality of connection structures 22 in the second direction can be connected between adjacent pontoons 31, and a plurality of connection structures 22 in the second direction may be arranged at intervals along a longitudinal direction of the pontoons 31. A connection rod perpendicular to an extending direction of the pontoons 31 may be included, and a connection rod that intersects the extending direction of the pontoons 31 also can be included. The connection structures 22 in the second direction may be connection rods with a hollowed airtight structure, and a sectional shape of the connection rods may be a waterdrop shape, a wing shape or other streamline shape, and the sectional shape of the connection rods may be parallel to the horizontal plane so as to reduce resistance during navigation. The connection rods can be integrally connected to each pontoon 31 and in fixed connection with the pontoons 31, and can be fixedly connected by welding, riveting or screwing. Of course, they also can integrally penetrate each pontoon 31 and be connected to structural beams in each pontoon 31. The connection rods may also be replaced by connection structures such as connection wings. The connection rods not only can be connected perpendicular to each pontoon 31, but also can be connected thereto in a manner of being inclined to the pontoons 31, in this way, structural stability of the multiple lower floating bodies 3 can be improved by the connection rods 22. As shown in FIG. 1 to FIG. 3, in an embodiment of the multiple lower floating bodies 3, the multiple lower floating bodies 3 include a plurality of elongated pontoons 31, and further, it may include at least three or more elongated pontoons 31, and these elongated pontoons 31 can be arranged in parallel at an interval of a certain distance. The overall requirement is that a sum of the displacement volumes of various floating bodies is greater than the displacement volume when the floating structure is in a full-load state, so as to ensure that the waterline is always located within a height range of the multiple lower floating bodies 3 no matter the floating structure is in a no-load state or in a full-load state. In this way, a relatively higher loading capacity is provided to a very large waterplane floating structure that is insensitive to load changes.

In the embodiment as shown in FIG. 1 to FIG. 3, a plurality of elongated pontoons 31 are all arranged longitudinally along a longitudinal direction of the floating structure, and arranged in parallel at an interval of a certain distance. Of course, the multiple lower floating bodies 3 may be in forms of various different shapes by combining a plurality of pontoons 31, or multiple lower floating bodies 3 also may be formed by floating bodies of different shapes intersecting vertically and horizontally, as long as respective pontoons 31 are left with appropriate intervals to eliminate wave effect.

Each pontoon 31 may be mainly composed of a plurality of vertical and horizontal reinforcing structures and a casing grillage to form a watertight housing. The structure needs to ensure watertightness and strength. The maximum height dimension of the section of a single pontoon 31 may be selected to be less than ½ of the maximum wave height dimension of an applicable water area, and the maximum breadth dimension may be selected to be no more than 2 times the maximum height dimension of the section; a clear spacing between various adjacent pontoons 31 of the multiple lower floating bodies 3 may be selected to be greater than 0.5 times the breadth dimension of the section of the pontoon 31 with a larger breadth dimension in two adjacent floating bodies.

The floating bodies have a small total volume, and dispersed into many floating bodies with a small dimension relative to the design wave height, which is advantageous for reducing the acting load of the waves on the floating structure. However, the floating structure of the present disclosure has a quite large main scale, large relative waterplane area, and quite small floating body freeboard, and still can provide enough stable moment. When the wave height of the waves is significantly smaller than the diameter of the cylindrical floating bodies, a distribution length of the cylindrical pontoons 31 can generally span a plurality of wavelengths, and a plurality of cylindrical floating bodies are juxtaposed in a breadth direction. Acting force of many waves on the floating structure are canceled by each other, therefore, the floating structure obviously is easy to maintain quite good attitude stability.

Further, a sum of the displacement volumes of various pontoons 31 is selected to be equal to or less than 2 times the equivalent water volume of the full weight when the floating structure is fully loaded, such that the static waterline of the floating structure is substantially located in an upper half of each pontoon 31. One option is that the displacement volume corresponding to the variable load of the floating structure is less than or equal to ¼ of the total volume of various pontoons 31. Within this range, as many floating bodies as possible can be tiled to increase the load of the floating structure.

In the specific embodiment as shown in the figures, the multiple lower floating bodies 3 may include a plurality of elongated pontoons 31 located in the same plane (although in the figures, the floating bodies of the same dimension are in the same plane, it also may be the case that the floating bodies are of different dimensions, and they are not necessarily located in the same plane). Various pontoons 31 are substantially the same in diameter and length, and various pontoons 31 are spaced apart by a certain distance. Herein, various pontoons 31 are arranged at intervals in the longitudinal direction along the longitudinal direction of the floating structure, herein the number of the pontoons 31 is 9, with one in the middle, and 4 symmetrically arranged on each of two sides. The pontoon 31 may have a section in a circular shape, an elliptical shape, a square shape or other geometrical shapes. Of course, various pontoons 31 may also be of different sizes, for example, the pontoons 31 of different outer contour dimensions are used in combination, so as to avoid consistent wave response or load response of the pontoons 31 of the same dimension, avoiding stress concentration or occurrence of resonance hazards.

Several outermost pontoons 31 of the multi-floating body are preferably filled therein with a non-absorbent material 311, for example, polystyrene foam, and in the specific embodiment as shown in the figures, three pontoons 31 are filled respectively on the left and right sides, six pontoons 31 are filled in total, and total buoyancy provided by the six pontoons 31 is about 1.1 times the displacement equivalent to the dead weight of the whole floating structure, such that the six filled pontoons 31 still will not lose buoyancy when housings of the floating bodies are damaged caused by collision or stranding of the floating structure, thus the structure of the floating structure will not overturn or sink due to loss of buoyancy of the floating bodies, possessing a great practical value.

In addition, each floating body of the connection structure 21 in the first direction can also be filled with a non-absorbent material, so as to ensure that water does not enter when it is damaged, and a righting moment still can be provided. The floating bodies may be all filled with a non-absorbent material, or it is also feasible to merely fill the floating-body type connection structures on the outer peripheral side with the non-absorbent material corresponding to the circumstance of the pontoons 31, thus the safety of the floating structure can be greatly improved.

In the floating structure of the embodiment of the present disclosure, the connection structures 21 in the first direction cooperate with the multiple lower floating bodies 3, forming a variable waterplane floating body structure with respect to the waves, and effectively reducing the wave load. The floating structure of the embodiment of the present disclosure is merely provided with the connection structures 21 in the first direction, and a large-area barrier-free water surface operation space can be formed between the floating bodies.

In the embodiment of the present disclosure, the floating structure is equipped with a driving device and a direction control device. Specifically, a plurality of propellers 4 may be arranged on each pontoon 31, and these propellers may be full-revolving propellers. When it is necessary to avoid extreme sea conditions, the floating structure can steer and navigate fast, and a navigational speed can reach 10 knots; the combined effect of the plurality of full-revolving propellers can realize a dynamic positioning function.

The floating structure provided in an embodiment of the present disclosure includes the upper structure 1 that is rigid as a whole, the intermediate connection structures 2 and the multiple lower floating bodies 3, and it generally can be analogized to an I-shaped section. The upper structure can be equivalent to an upper flange of the I-shaped section; the multiple lower floating bodies 3 are equivalent to a lower flange of the I-shaped section, and the intermediate connection structure 2 is equivalent to a web of the I-shaped section. Through reasonable structural design, for example, the sectional area of the multiple lower floating bodies 3 and the sectional area of the upper structure 1 have roughly equivalent contribution to the cross-section moment of inertia of a neutral axis of the floating structure, the moment of inertia of the section itself of the multiple lower floating bodies 3 and the moment of inertia of the section itself of the upper structure 1 are roughly equivalent, and the neutral axis of the present floating structure can be designed in a middle position of the structure of the floating structure, such that the upper structure 1 and the multiple lower floating bodies 3 (steel) both can function with the maximum efficiency, and obtain the maximum strength (including resisting combined effects such as tension, compression, bending, shearing, and torsion) with the smallest amount of steel used, greatly improving the utilization ratio of structural materials (steel).

Referring to FIG. 1 to FIG. 3, a specific application example provided in the present disclosure is as follows:

As exemplified in the figures, a statistical value of the maximum wave height that may occur in the sea area where the floating structure is used is about 28 meters. The upper structure of the floating structure is designed as a box structure with three layers of decks, forming a strength deck of this floating structure. For example, as shown in the figures, the upper structure may have a length of 600 meters, a breadth of 130 meters, and a height of 10 meters. An upper surface complete deck of 78000 square meters and an upper cabin of 234000 square meters can be provided.

The multiple lower floating bodies 3 of the floating structure are selected to be provided with 9 pontoons 31 (or called as elongated floating bodies) of the same shape that are independent from each other and longitudinally arranged, providing buoyancy for the whole floating structure. For example, as shown in the figures, the cross section of each pontoon 31 of the multiple lower floating bodies 3 can be designed with the same rounded rectangular shape, each pontoon 31 may have a length of 600 meters, a height of 11.5 meters, and a maximum breadth of 8.8 meters, and a spacing between the pontoons 31 may be 6 meters. An outer edge distribution breadth of 9 pontoons 31 may be 130 meters, and the multi-floating body provides a displacement volume of about 546000 cubic meters in total. A sum of the waterline areas of the multi-floating body may be 47400 square meters. A maximum displacement of the floating structure is about 335000 tons, in which the dead weight is about 175000 tons, and a design load capacity is about 185000 tons. In the design full-load state, the draught is about 7.7 meters, and the draught is about 4.7 meters under unloaded state. The draught change is about 2.9 meters between unloaded state and full load state. Under unloaded state, the height H from the floating structure's center of gravity G to the still water surface is about 23.4 meters. The length distribution dimension of the multi-floating body of this floating structure in the horizontal direction is equal to 25 times the height from the center of gravity to the still water surface when the floating structure is in unloaded state, and the distribution dimension in the breadth direction is equal to 5.56 times the height from the center of gravity to the still water surface when the floating structure is in unloaded state.

When the design wave (which is modified sine wave) height is 22 meters and the wavelength is 621 meters, a predicted value of a maximum total longitudinal bending moment of the floating bodies is about 9.76E10NM. A maximum structural stress of a midship is about 220 MP (an allowable stress is 320 MP), and an overall structural deflection is about 1/500, satisfying the condition of "rigid body".

The connection structures 21 in the first direction are hollowed rectangular upright column bodies with rounded angles, with a length of about 10 meters, a breadth of about 6 meters, and a height of about 28 meters. A single cross-section area thereof may be 60 square meters, and each elongated floating body is equidistantly distributed with 12 connection structures 21 in the first direction, 9 floating bodies in total having 108 connection structures in the first direction, with a total cross-section area of about 6048 square meters, which is 13% of the waterplane area of the multi-floating body.

A single pontoon 31 of this floating structure has a volume of 60720 cubic meters, and the displacement volume of full weight of the floating structure is 335000 cubic meters, therefore, inner spaces of six outermost pontoons 31 are all filled with the non-absorbent material 311, which has a displacement volume of approximately 364000 cubic meters, which is greater than the equivalent water volume of the full weight of the floating structure.

As shown in FIG. 2, a driving device and a direction control device 4 can be provided respectively in a bow portion and a stern portion of each pontoon 31. Specifically as shown in the figure, a set of electrical propulsion rudder propeller may be provided in the bow portion and the stern portion respectively, for example, 22 sets in total, providing an excellent driving power and an omnidirectional control capability for the floating structure.

Second Embodiment (301)

1. Overview

Figure 6:
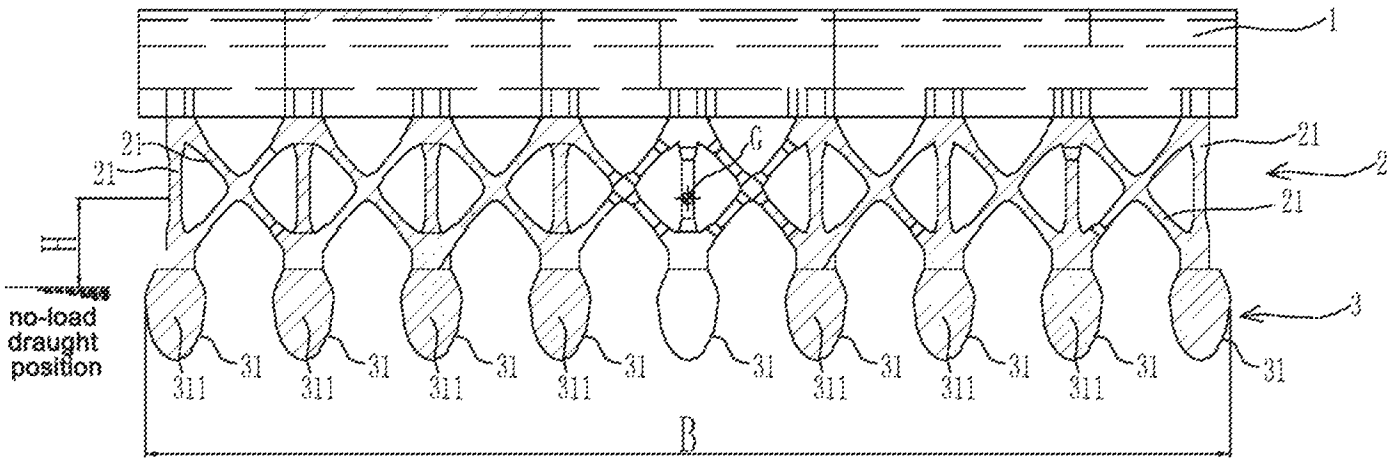
FIG. 6 is a structural schematic diagram of a front section of a large offshore floating platform exemplified according to the floating structure in an embodiment of the present disclosure.
Figure 7:
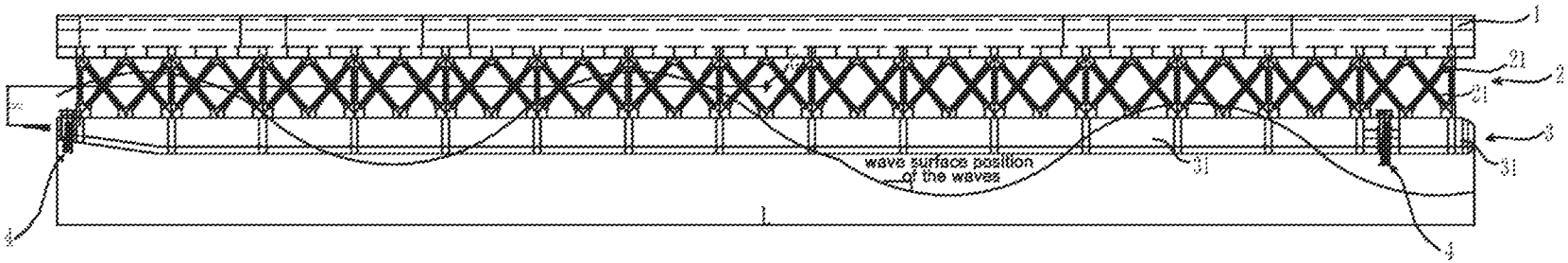
FIG. 7 is a side structural schematic diagram of the large offshore floating platform exemplified according to the floating structure in an embodiment of the present disclosure.
Figure 8:
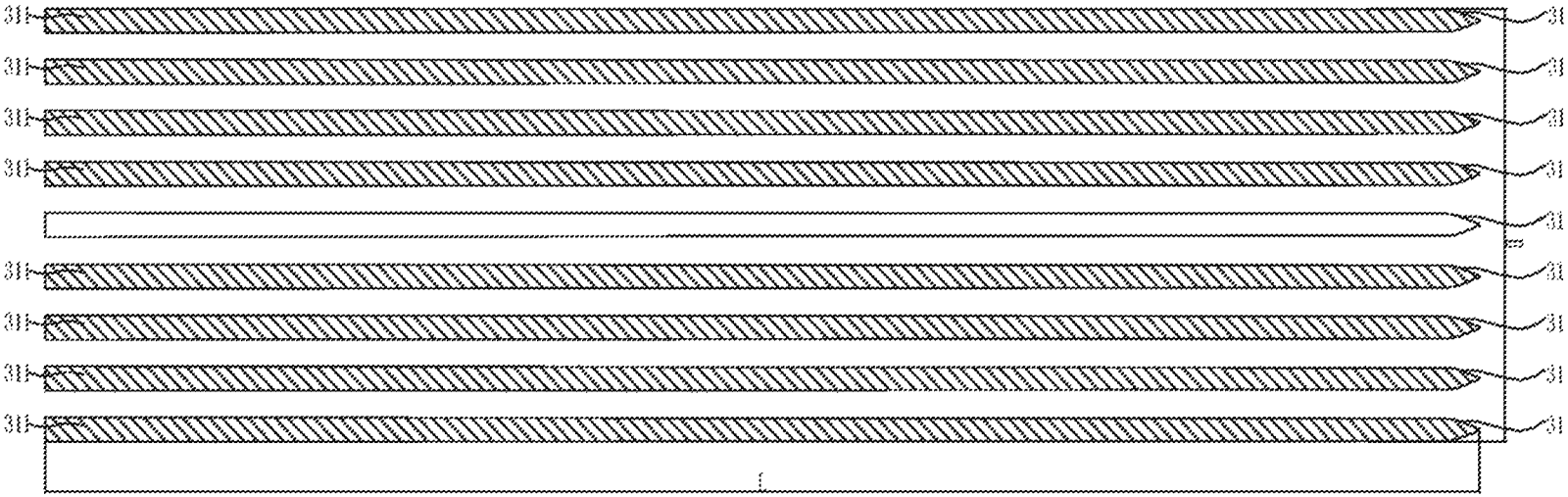
FIG. 8 is a structural schematic diagram of a top section of the large offshore floating platform exemplified according to the floating structure in an embodiment of the present disclosure.

FIG. 6, FIG. 7 and FIG. 8 show application of a very large offshore floating structure, wherein this floating structure is designed to be suitable for offshore navigation, and the large offshore floating structure is propelled by 18 full-revolving propellers 4, can be loaded with large objects, helicopters, containers, etc. on an outdoor upper deck or other decks, and also can provide oil reserves, refrigerated cargo reserves, personnel living facilities, etc.

2. Structural Form

An overall structure of this floating structure is designed with three distinct portions (see FIG. 6, FIG. 7 and FIG. 8), that is, an upper structure 1, multiple lower floating bodies 3, and an intermediate connection structure 2 connecting the upper structure 1 and the multiple lower floating bodies 3.

1) Upper Structure 1

The upper structure 1 of this floating structure is designed as a box structure in a structure with two layers of decks (from a deck A to a deck B), forming strength decks of this floating structure. The upper structure 1 has a length of 310 meters and a breadth of 90 meters, and can provide a flat complete upper deck with an area of 27900 square meters, for the storage site of large cargo and large container, helicopter parking, recreational sports venues (golf, etc.) and temporary cargo stacking and so on.

In the upper structure 1, there are mainly arranged: an oil separator compartment, a carbon dioxide compartment, a cabin local water-based fire equipment room, auxiliary equipment, a cooling water compartment, a daily fresh water compartment, a drinking water compartment, a windlass and hydraulic engine compartment, a sewage treatment equipment room, a sewage compartment, a rainwater purification equipment room, a desalination equipment room, a sewage treatment equipment room, a compressor compartment, a hydraulic pump room, etc.

2) Multiple Lower Floating Bodies 3

This floating structure is provided with 9 pontoons 31 of the same shape and streamlined contour that are independent from each other and longitudinally arranged, providing buoyancy for the whole floating structure. Each pontoon 31 of the multiple lower floating bodies 3 is designed with the same drop-shaped cross section, each pontoon 31 has a length of 310 meters, a height of 7.5 meters, and a maximum breadth of 5 meters. A spacing between the pontoons is 5.5 meters. The 9 floating bodies provide a displacement of 84500 tons in total. In the design full-load state, the draught is 6.0 meters, which can provide a displacement of 68000 tons.

A set of rudder propeller is provided respectively in a bow portion and a stern portion of each pontoon 31, providing an excellent driving power and a directional control capability for the floating structure.

3) Intermediate Connection Structure 2

The intermediate connection structures 2 mainly include a plurality of connection structures 21 in a first direction. The pontoons 31 and the upper structure 1 are connected therebetween with the connection structures 21 in the first direction. Each connection structure 21 in the first direction includes a vertical upright column and an inclined upright column, and the two further may constitute an overall truss support structure.

3. Main Scales

| | |
|---|---|
| total length | 310 m |
| length between two columns | 310 m |
| molded breadth | 90 m |
| molded depth | 22.3 m |
| summer load line draught (molded) | 6 m |
| structural draught (molded) | 6 m |
| displacement (during summer load line draught) | ~68000 t |

4. Function

The structural form of the present floating structure is designed to be spatially distributed, can provide a relatively large internal storage space and upper deck area, and can realize a wide range of civil and special purposes:

1) Providing ship berthing (below 10000-ton level), loading and unloading functions (hoisting, rolling, conveyor belt loading and unloading).

2) Providing condition guaranty for island development and construction; types of ships that can berth include: official vessels, supply vessels, transport vessels, fishing boats, yachts and other supporting vessels.

3) Providing material reserve, sorting, and transfer functions, wherein categories of goods may include: dry bulk cargos, containers, rolling goods, large structural parts, refrigerated goods, etc.

4) Providing power supply, material supply, and transportation to moored islands (due to difficult construction of coral island reef pile foundation, floating landing stage form are considered) and other living condition supports.

5) Providing replenishment function for offshore ships: fuel oil, fresh water, living materials, etc. can be replenished, extending a cruising and working cycle, and increasing cruising frequency and mobility.

6) Functioning as a communication base station at sea, increasing coverage of communication signals, and providing communication convenience services for marine police cruising and right-protecting crew and operators in surrounding sea areas, and fishermen.

7) Providing navigation safety and rescue support functions for operators at sea and islanders within a sea area surrounding the floating structure: medical center, emergency search and rescue (helicopter, fast ship) and rescue function are provided on the floating structure.

8) Providing condition guaranty for ship berthing and conditioning of maritime police on voyage (entertainment gym) and crew retention.

9) Providing helicopter take-off and landing, communication, monitoring, radar, navigation, helicopter hangar (provided on the deck).

5. Main Characteristics

Characteristics of this floating structure conforming to a preferred scope of the embodiment are as follows:

1) 9 elongated floating bodies are horizontally arranged for lower floating bodies of this floating structure, and a spacing between adjacent floating bodies is 5.5 meters. A total volume of respective floating bodies of this floating structure is 82400 cubic meters, greater than the displacement volume of 66340 cubic meters under full load. The upper structure of the floating structure is a box structure, and the intermediate connection structures include a truss structure composed of vertical upright columns, cross slant supports (inclined upright columns), transverse horizontal bars and horizontal supports. The three structural portions above are connected with each other to form an overall hyperstatic space structure.

2) This floating structure has a length of 310 meters, therefore, it conforms to the characteristic that an outer contour dimension is greater than 150 meters in at least one direction in the preferred scope of the embodiment.

3) A single floating body of this floating structure has a height of 7.5 meters and a breadth of 5.0 meters, and an applicable water area has a maximum wave height not lower than 23 meters, thus conforming to the characteristics that a maximum height dimension of a single floating body's section is smaller than ½ of the maximum wave height dimension of the applicable water area, and the maximum breadth dimension is no larger than 2 times the maximum height dimension of the section in the preferred scope of the embodiment; a clear spacing between adjacent floating bodies is 5.5 meters, conforming to the characteristic that the clear spacing between adjacent floating bodies is greater than 0.5 times a sectional breadth dimension of one floating body of two adjacent floating bodies which has a larger breadth dimension in the preferred scope of the embodiment.

4) A total volume of respective floating bodies of this floating structure is 82400 cubic meters, and the displacement volume is 66340 cubic meters under full load, conforming to the characteristic that a total volume of respective floating bodies is less than 2 times the equivalent water volume of the full weight when the floating structure is fully loaded in the preferred scope of the embodiment.

5) This floating structure has a length of 310 m (L) and a breadth of 90 m (B), the center of gravity is 14.5 m (H) from the still water surface under unloaded state, having the characteristic that the length and breadth distribution of the floating structure in the horizontal direction is equal to or greater than 4 times the height from the center of gravity to the still water surface when the floating structure is in unloaded state in the preferred scope of the embodiment above.

6) This floating structure is equipped with 18 full-revolving propellers 4, which can make the floating structure have self-propelled capability, and can control heading of the floating structure by adjusting an azimuth of the full-revolving propeller 5. This point conforms to the characteristic that the floating structure is mounted with a driving device and a direction control device in the preferred scope of the embodiment above.

7) A single floating body of this floating structure has a volume of 9156 cubic meters, and the displacement volume of the full weight of the floating structure is 66340 cubic meters, therefore, inner spaces of 8 floating bodies are all filled with the non-absorbent material 311, which has a displacement volume greater than the equivalent water volume of full weight of the floating structure, that is, conforming to the characteristic in the preferred scope of the embodiment above.

Regarding the above embodiments, the following illustration is made:

A. The floating structure provided in the present disclosure can have a considerable overall scale.

In the sea conditions of 4-5 level in which routine operations can be carried out, a wavelength length corresponding to the wave spectral peak period is less than about 100 meters, and the floating structure's swing amplitude is mainly related to a ratio of the wavelength to the total length of the floating structure. In order to maintain relatively good motion response of the floating structure in the longitudinal direction, a scale of the floating structure in the length direction is defined to be greater than 150 meters. Thus, the floating structure can have a large scale, and is stable in an operation environment.

Under extreme sea conditions, when the design wave height reaches 22 meters, and the wavelength is 621 meters, the floating structure of the present disclosure with the main scale reaching 600 meters still can be ensured to meet criteria of various specifications, and at the same time, satisfy the conditions of "rigid body".

B. An embodiment of the total volume of the multiple floating bodies, the reserve buoyancy and the waterline position of the floating structure is exemplified.

As the sum of displacement volumes of various floating bodies is required to be greater than the displacement volume when the floating structure is in a full-load state, and meanwhile, a sectional scale of the floating bodies is limited, the lower floating bodies necessarily are distributed with a small total height, a large number, and a flat shape as a whole, and the waterplane area thereof will be much larger than that of conventional ships and floating platforms.

It is exemplified that a total volume of the multiple floating bodies is not more than 2 times the equivalent water volume of the full weight when the floating structure is fully loaded. Therefore, when the floating structure is fully loaded, the reserve buoyancy of the floating bodies is not more than one time the full weight. When the sections of the floating bodies are consistent, the waterline is within the height range of the floating bodies; if the reserve buoyancy is about 1 time the full weight of the floating structure, it is apparent that the waterline is at about ½ of the floating bodies' height. Obviously, under the effect of variable loads, the draught of the floating structure changes much less than that of conventional ships; as the conventional ships are large waterplane structures, the floating structure of the present disclosure is a "very large waterplane" structure compared with the conventional ships.

C. The total volume of the floating bodies is dispersed on a plurality of floating bodies with a relatively small volume.

It is exemplified that the maximum height dimension of a single floating body's section is less than ½ of the maximum wave height dimension of an applicable water area, and that the maximum breadth dimension is no more than 2 times the maximum height dimension of the section; it is exemplified that a clear spacing between adjacent floating bodies of the multiple floating body layer is greater than 0.5 times the sectional breadth dimension of one floating body of two adjacent floating bodies which has a larger breadth dimension. Typically, the maximum wave height is about 30 meters, therefore, the maximum height dimension of a single floating body's section is no more than about 15 meters, the maximum breadth dimension is no more than about 30 meters, and a clear spacing between adjacent floating bodies is greater than about 15 meters. A small sectional dimension of the floating body results in a relatively small volume of each floating body, therefore, the floating bodies should have a certain total length and number, such that they can have a certain total volume. Meanwhile, it is required that various floating bodies are arranged in a dispersed manner, and the spacing between the floating bodies functions to ensure smooth flowing of waves between the floating bodies, so as to release the kinetic energy of the waves. It is exemplified that when a main scale of a single floating body's section is much smaller than the main dimension of the maximum wave height (such as 0.5 times), at the maximum wave height, some of the waves will cross the floating bodies, some of the floating bodies will break away from the waves, and the wave load will no longer linearly increase with the increase of the wave height, that is, the response of the floating structure wave load to the wave height appears nonlinear, thus the wave load of the floating structure during large waves can be greatly reduced. In addition, the static waterline is designed at an upper half of the floating bodies, and when the wave height is relatively high, the wave will cross upper edges of the floating bodies, such that a buoyancy value that the floating bodies instantaneously lose is not equal to the gravity value, and the floating bodies must sink (dive) vertically to a certain extent so as to reach a new balanced state, and in the new balanced state, as the kinetic energy of the waves will decrease as the water depth increases, the wave load will be further decreased relative to an original state.

At the same time, the small floating bodies enable the whole floating structure to have a quite shallow draught. The dispersed floating bodies create conditions for fluid motion for the waves to cross the floating bodies, and at the same time, make the waterplane area to be distributed in a dispersed manner, which has very large righting force and righting moment, which can ensure that the structure has relatively good stability. When a plurality of small floating bodies are arranged in a dispersed manner and function in combination, an enough displacement volume and a very large waterplane area can be provided, therefore, under the same load condition, the draught changes little under no-load and full-load working conditions, therefore, it may have extremely high stability, and may not need to be configured with a large capacity ballast tank. The elongated floating body refers to an elongated floating body structure, and its function on one hand is that it can naturally become a part of the force-receiving component of the overall structure of the floating structure, and on the other hand, it is advantageous to reduce the navigation resistance, and ensure that the heading stability can still be achieved with a relatively small wet surface aspect ratio.

D. The connection structures in the first direction in the intermediate connection structures are floating-body type connection structures.

It is exemplified that the connection structures in the first direction in the intermediate connection structures are floating-body type connection structures, which provide reserve buoyancy, and ensure continuity of upward distribution of the floating bodies, and the righting arm still has a positive value in the event of an unexpectedly large inclination (the elongated floating bodies at one side all enter the water), ensuring that under extreme conditions, the floating structure still can have high enough stability safety redundancy, so as to maintain reliable anti-overturning capacity.

E. The distribution scale of the floating structure in the horizontal direction is equal to or greater than 4 times the distance from the center of gravity to the still water surface when the floating structure is in unloaded state.

Figure 9:
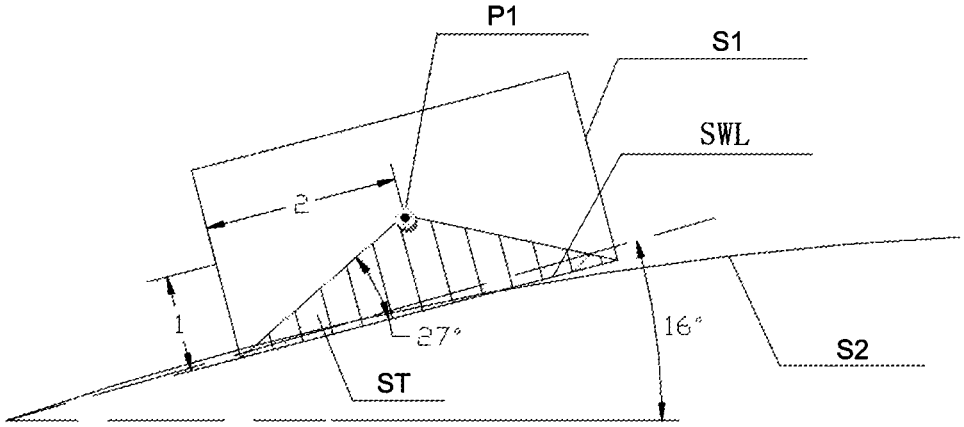
FIG. 9 is a schematic diagram of stability analysis of the floating structure, exemplified as being entirely disposed transversely on a wave surface of waves, in an embodiment of the present disclosure, wherein P1 means position of center of gravity of floating structure, S1 means outer contour of transverse section of floating structure, ST means stable triangle, and S2 means wave surface position of the waves (corresponding to maximum wave steepness)
Figure 10:
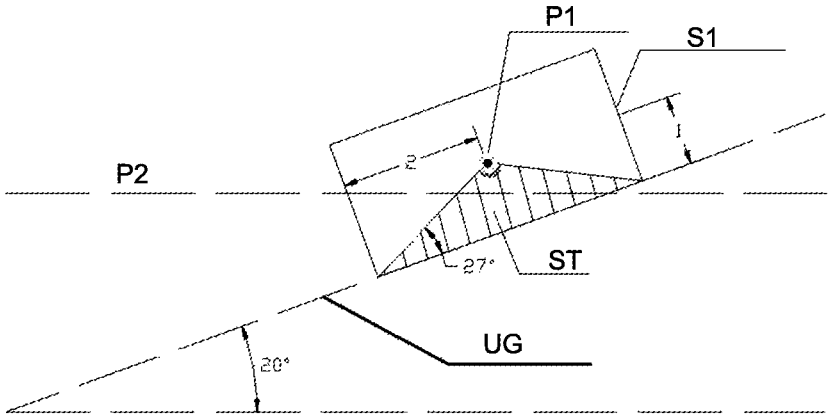
FIG. 10 is a schematic diagram of stability analysis of the floating structure in an embodiment of the present disclosure, exemplified as being in a stranded condition, wherein P1 means position of center of gravity of floating structure, S1 means outer contour of transverse section of floating structure, ST means stable triangle, and P2 means waterplane position, and UG means underwater gradient.
Figure 11:
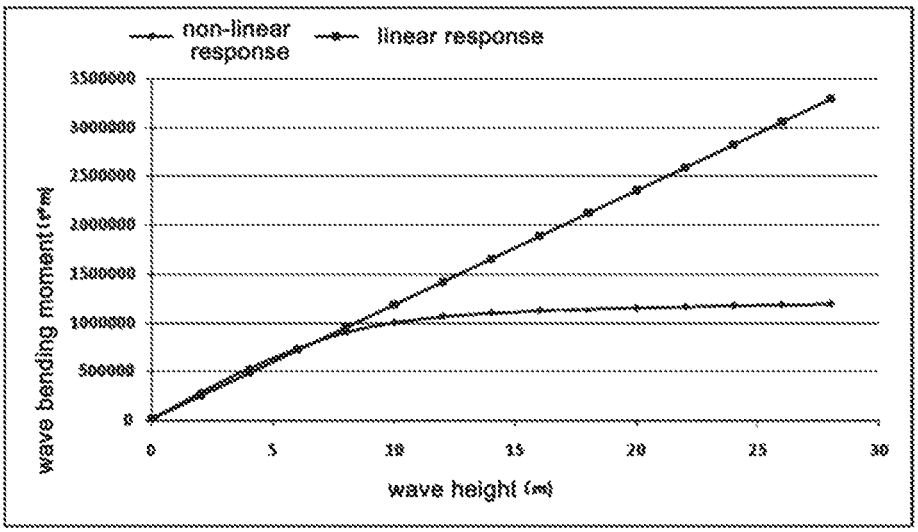
FIG. 11 is a schematic diagram exemplifying wave load analysis of the floating structure in an embodiment of the present disclosure.
Figure 12:
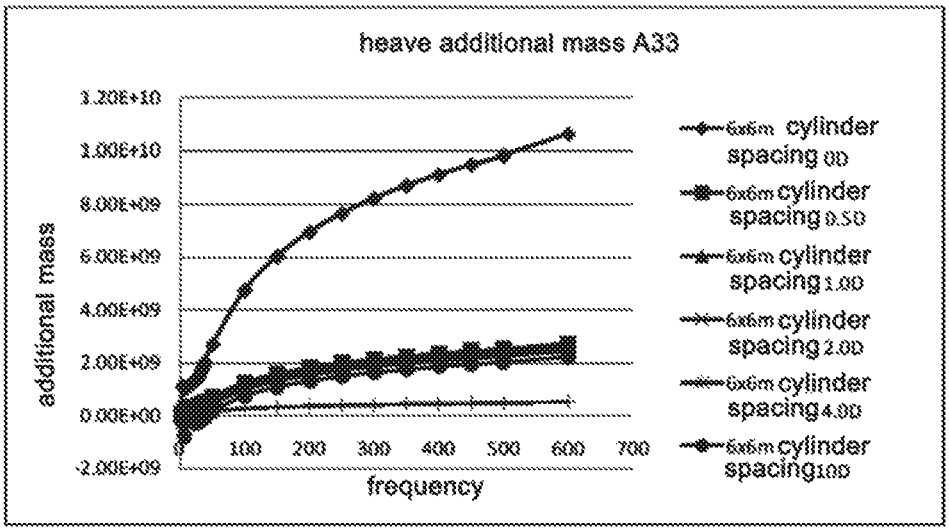
FIG. 12 is a schematic diagram exemplifying heaving analysis of the floating structure in an embodiment of the present disclosure.

Referring to what is shown in FIG. 9 to FIG. 10, the length and breadth distribution of the floating structure in the horizontal direction is equal to or greater than 4 times the distance from the center of gravity P1 to the still water surface when the floating structure is in unloaded state. It is equivalent to the fact that the floating body's scale in the breadth direction is greater than 4 times the distance from the center of gravity to the still water surface when the floating structure is in unloaded state, such that the transverse section of the floating structure as a whole has an ultra-flat shape. As shown in FIG. 9, the static waterline of the multi-floating body of the floating structure and two sides from two outermost points of the multi-floating body to the center of gravity form a stable triangle ST, where an angle of this triangle at most is 27 degrees. In rough storms, maximum wave steepness is 1/7, and a corresponding wave inclination is 16 degrees, and under the most unfavorable working conditions, the floating structure is transversely placed on the wave surface of the waves, but it still can ensure that the floating structure does not tip over under the effects of wind heeling moment and wave load.

When stranded in shoals at various angles, due to the restriction of the stable triangle ST, it can be ensured that the floating structure does not tip over. FIG. 10 is a schematic diagram showing the principle that the floating structure does not tip over when the floating structure is stranded on a shoal having a relatively large slope angle (for example, a slope angle of less than 20 degrees).

F. The floating structure has maneuverability and ability to adjust the heading.

It is exemplified that the floating structure is equipped with a driving device and a direction control device, specifically, a plurality of full-revolving propellers can be arranged in a bow portion and a stern portion of each floating body of the multi-floating body, and these propellers have a long distance from front to back and can rotate omnidirectionally, and can generate a huge yaw moment according to needs while generating an omnidirectional thrust.

Specifically, the floating structure further can be realized by providing thereon a sail, a direct-push propeller, a rudder and so on.

Third Embodiment (301)

1. Overview

FIG. 13, FIG. 14 and FIG. 15 show application of a very large offshore floating structure, wherein this floating structure is designed to be suitable for offshore navigation, and the large offshore floating structure is propelled by 18 full-revolving propellers 4, can be loaded with large objects, helicopters, containers, etc. on an outdoor upper deck or other decks, and also can provide oil reserves, refrigerated cargo reserves, personnel living facilities, etc.

2. Structural Form

An overall structure of this floating structure is designed with three distinct portions (see FIG. 6, FIG. 7 and FIG. 8), that is, an upper structure 1, multiple lower floating bodies 3, and an intermediate connection structure 2 connecting the upper structure 1 and the multiple lower floating bodies 3.

1) Upper Structure 1

The upper structure 1 of this floating structure is designed as a box structure in a structure with two layers of decks (from a deck A to a deck B), forming strength decks of this floating structure. The upper structure 1 has a length of 310 meters and a breadth of 90 meters, and can provide a flat complete upper deck with an area of 27900 square meters, for the storage site of large cargo and large container, helicopter parking, recreational sports venues (golf, etc.) and temporary cargo stacking and so on.

In the upper structure 1, there are mainly arranged: an oil separator compartment, a carbon dioxide compartment, a cabin local water-based fire equipment room, auxiliary equipment, a cooling water compartment, a daily fresh water compartment, a drinking water compartment, a windlass and hydraulic engine compartment, a sewage treatment equipment room, a sewage compartment, a rainwater purification equipment room, a desalination equipment room, a sewage treatment equipment room, a compressor compartment, a hydraulic pump room, etc.

2) Multiple Lower Floating Bodies 3

This floating structure is provided with 9 pontoons 31 of the same shape and streamlined contour that are independent from each other and longitudinally arranged, providing buoyancy for the whole floating structure. Each pontoon 31 of the multiple lower floating bodies 3 is designed with the same drop-shaped cross section, each pontoon 31 has a length of 310 meters, a height of 7.5 meters, and a maximum breadth of 5 meters. A spacing between the floating bodies is 5.5 meters. The 9 floating bodies provide a displacement of 84500 tons in total. In the design full-load state, the draught is 6.0 meters, which can provide a displacement of 68000 tons.

A set of rudder propeller is provided respectively in a bow portion and a stern portion of each pontoon 31, providing an excellent driving power and a directional control capability for the floating structure.

3) Intermediate Connection Structure 2

The intermediate connection structures 2 mainly include connection structures 21 in a first direction, and connection structures 22 in a second direction. The pontoons 31 and the upper structure 1 are connected therebetween with the connection structures 21 in the first direction, and the 9 pontoons 31 are connected by the connection structures 22 in the second direction. Each connection structure 21 in the first direction includes a vertical upright column and an inclined upright column, and the two further may constitute an overall truss support structure. The connection structures 22 in the second direction may be transverse trusses, can be arranged in a transverse section of the vertical upright column, and composed of cross slant supports, for connecting the nine pontoons 31.

3. Main Scales

| | |
|---|---|
| total length | 310 m |
| length between two columns | 310 m |
| molded breadth | 90 m |
| molded depth | 22.3 m |
| summer load line draught (molded) | 6 m |
| structural draught (molded) | 6 m |
| displacement (during summer load line draught) | ~68000 t |

4. Function

The structural form of the present floating structure is designed to be spatially distributed, can provide a relatively large internal storage space and upper deck area, and can realize a wide range of civil and special purposes:

1) Providing ship berthing (below 10000-ton level), loading and unloading functions (hoisting, rolling, conveyor belt loading and unloading).

2) Providing condition guaranty for island development and construction; types of ships that can berth include: official vessels, supply vessels, transport vessels, fishing boats, yachts and other supporting vessels.

3) Providing material reserve, sorting, and transfer functions, wherein categories of goods may include: dry bulk cargos, containers, rolling goods, large structural parts, refrigerated goods, etc.

4) Providing power supply, material supply, and transportation to moored islands (due to difficult construction of coral island reef pile foundation, floating landing stage form are considered) and other living condition supports.

5) Providing replenishment function for offshore ships: fuel oil, fresh water, living materials, etc. can be replenished, extending a cruising and working cycle, and increasing cruising frequency and mobility.

6) Functioning as a communication base station at sea, increasing coverage of communication signals, and providing communication convenience services for marine police cruising and right-protecting crew and operators in surrounding sea areas, and fishermen.

7) Providing navigation safety and rescue support functions for operators at sea and islanders within a sea area surrounding the floating structure: medical center, emergency search and rescue (helicopter, fast ship) and rescue function are provided on the floating structure.

8) Providing condition guaranty for ship berthing and conditioning of maritime police on voyage (entertainment gym) and crew retention.

9) Providing helicopter take-off and landing, communication, monitoring, radar, navigation, helicopter hangar (provided on the deck).

5. Main Characteristics

Characteristics of this floating structure conforming to a preferred scope of the embodiment are as follows:

1) 9 elongated floating bodies are horizontally arranged for lower floating bodies of this floating structure, and a spacing between adjacent floating bodies is 5.5 meters. A total volume of respective floating bodies of this floating structure is 82400 cubic meters, greater than the displacement volume of 66340 cubic meters under full load. The upper structure of the floating structure is a box structure, and the intermediate connection structures include a truss structure composed of vertical upright columns, cross slant supports (inclined upright columns), transverse horizontal bars and horizontal supports. The three structural portions above are connected with each other to form an overall hyperstatic space structure.

2) This floating structure has a length of 310 meters, therefore, it conforms to the characteristic that an outer contour dimension is greater than 150 meters in at least one direction in the preferred scope of the embodiment.

3) A single floating body of this floating structure has a height of 7.5 meters and a breadth of 5.0 meters, and an applicable water area has a maximum wave height not lower than 23 meters, thus conforming to the characteristics that a maximum height dimension of a single floating body's section is smaller than ½ of the maximum wave height dimension of the applicable water area, and a maximum breadth dimension is no larger than 2 times the maximum height dimension of the section in the preferred scope of the embodiment; a clear spacing between adjacent floating bodies is 5.5 meters, conforming to the characteristic that the clear spacing between adjacent floating bodies is greater than 0.5 times the sectional breadth dimension of one floating body of two adjacent floating bodies which has a larger breadth dimension in the preferred scope of the embodiment.

4) A total volume of respective floating bodies of this floating structure is 82400 cubic meters, and the displacement volume is 66340 cubic meters under full load, conforming to the characteristic that a total volume of respective floating bodies is less than 2 times the equivalent water volume of the full weight when the floating structure is fully loaded in the preferred scope of the embodiment.

5) This floating structure has a length of 310 m (L) and a breadth of 90 m (B), the center of gravity is 14.5 m (H) from the still water surface under unloaded state, having the characteristic that the length and breadth distribution of the floating structure in the horizontal direction is equal to or greater than 4 times the height from the center of gravity to the still water surface when the floating structure is in unloaded state in the preferred scope of the embodiment above.

6) This floating structure is equipped with 18 full-revolving propellers 4, which can make the floating structure have self-propelled capability, and can control heading of the floating structure by adjusting an azimuth of the full-revolving propeller 5. This point conforms to the characteristic that the floating structure is mounted with a driving device and a direction control device in the preferred scope of the embodiment above.

7) A single floating body of this floating structure has a volume of 9156 cubic meters, and the displacement volume of the full weight of the floating structure is 66340 cubic meters, therefore, inner spaces of 8 floating bodies are all filled with the non-absorbent material 311, which has a displacement volume greater than the equivalent water volume of full weight of the floating structure, that is, conforming to the characteristic in the preferred scope of the embodiment above.

Figure 16:
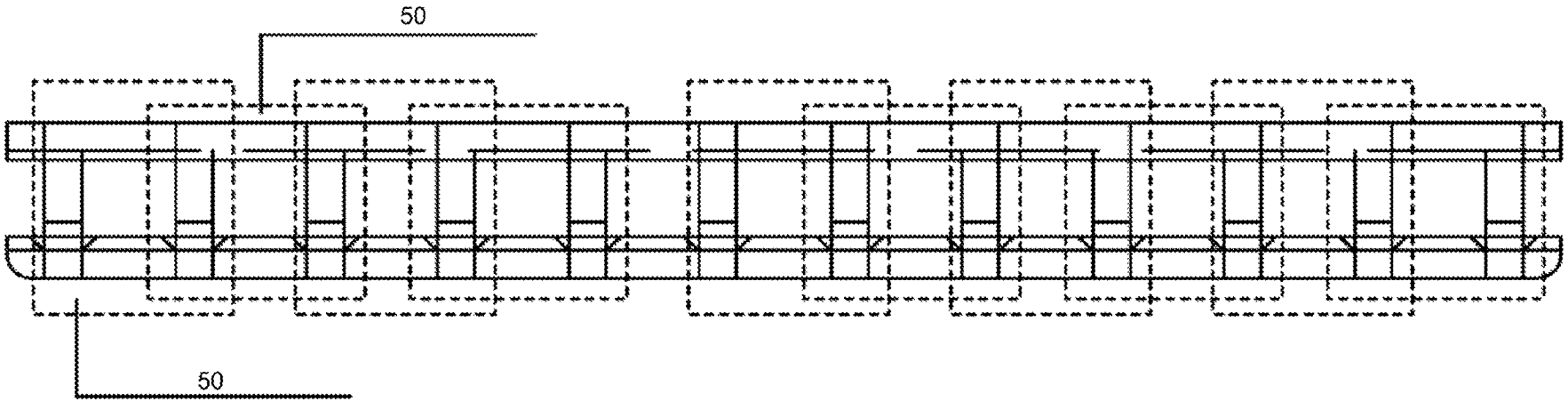
FIG. 16 is a first schematic diagram of a hyperstatic unit of the floating structure in an embodiment of the present disclosure.
Figure 17:
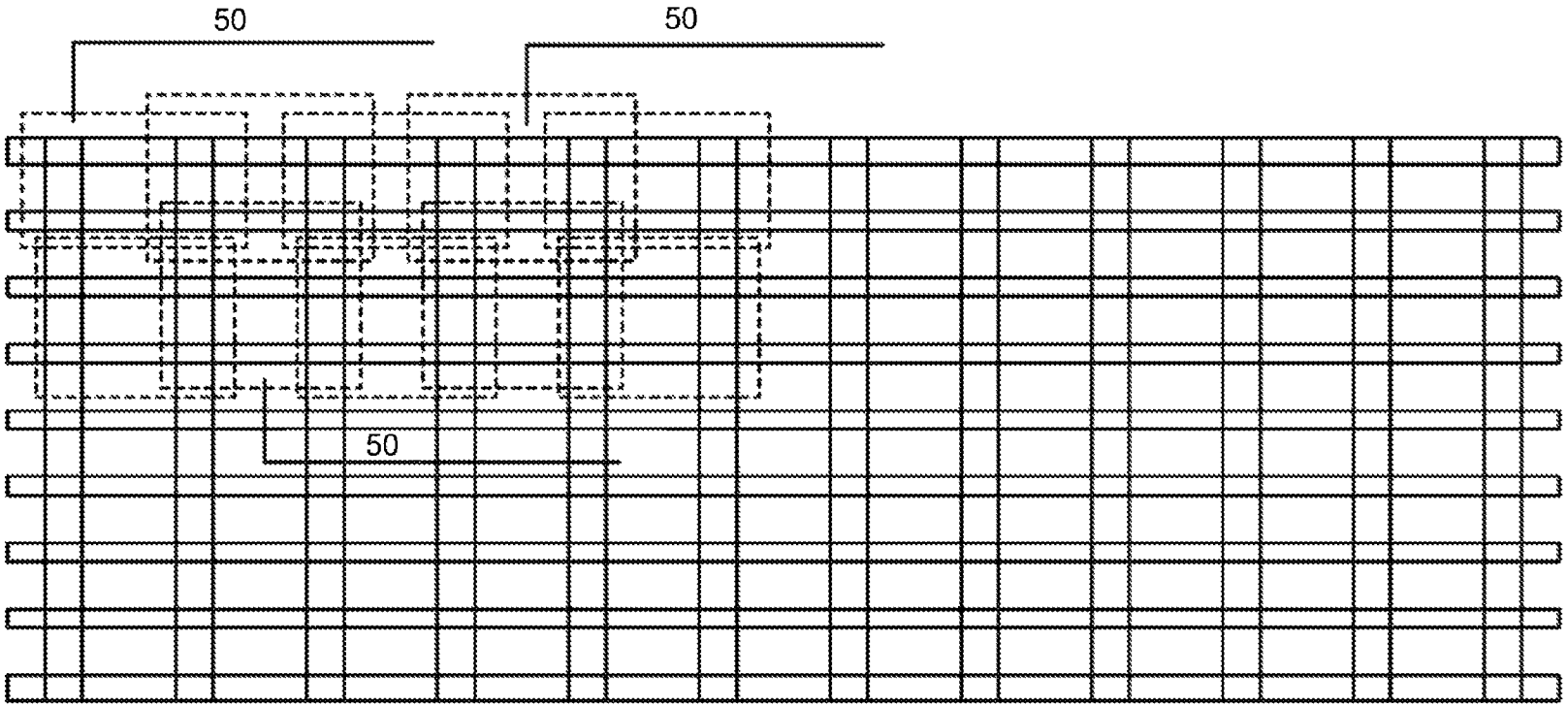
FIG. 17 is a second schematic diagram of the hyperstatic unit of the structure in an embodiment of the present disclosure.
Figure 18:
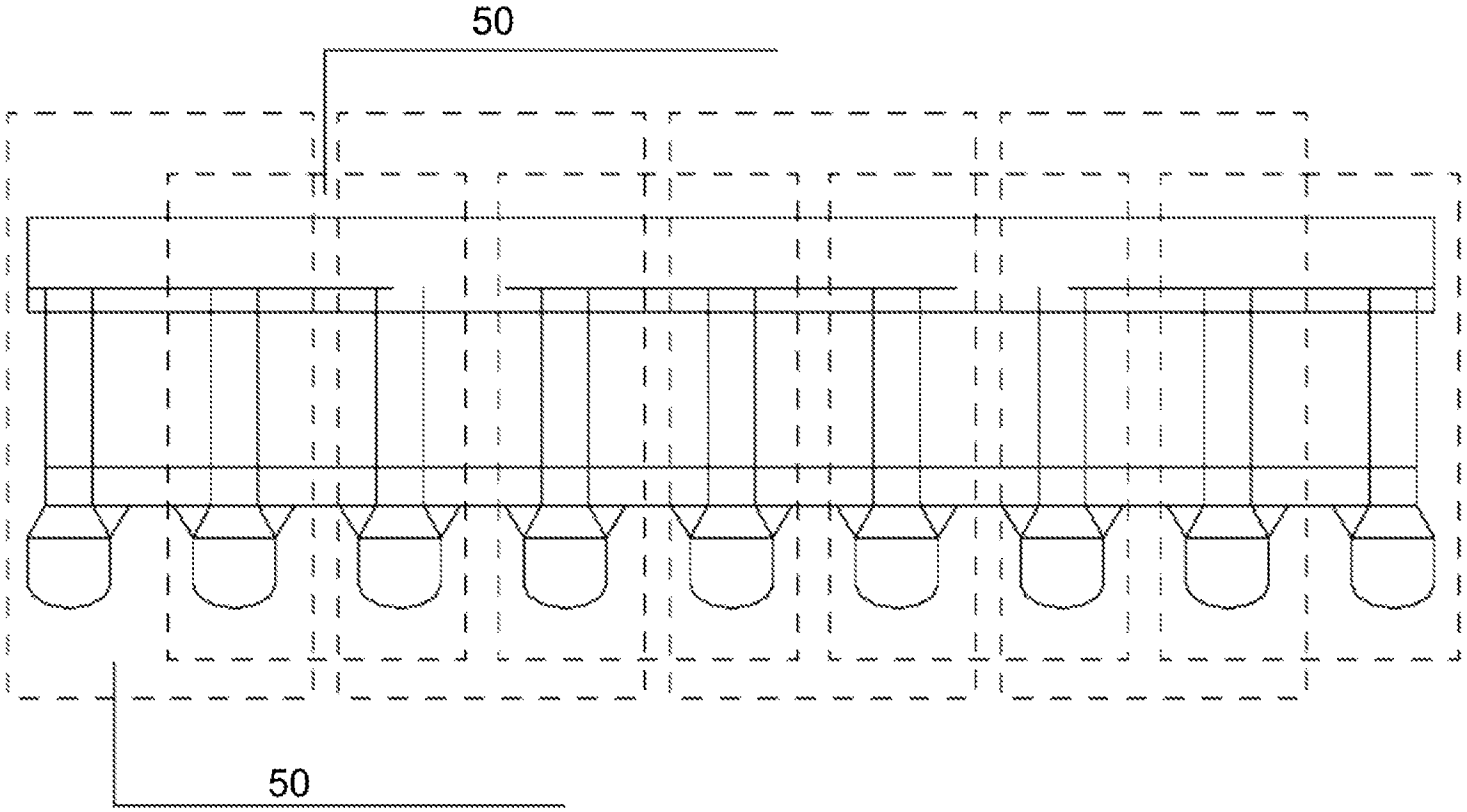
FIG. 18 is a third schematic diagram of the hyperstatic unit of the floating structure in an embodiment of the present disclosure.

The floating structure is a unitary structure at least composed of 5 floating bodies, 25 upright columns and one spatially continuous upper box structure. Referring to what is shown in FIG. 16 to FIG. 18, according to the knowledge of structural mechanics, 2 lower floating bodies, 4 upright columns and corresponding part of the upper box structure (which can be analogized to a semi-submersible platform) can form an airtight hyperstatic spatial structural unit 50, therefore, the floating structure of the present disclosure is, in any direction, a continuous combination of at least four hyperstatic spatial structural units 50, and viewed on the whole, the floating structure of the present disclosure is a combined structure at least composed of 16 hyperstatic spatial structural units 50, therefore, the structure as a whole has quite great redundancy in terms of anti-disintegration.

From the structural composition analysis of the floating structure, it can be found that the lower floating body structures and the intermediate connection structures thereof are both in a large number and arranged in a dispersed manner. When the structure is stressed, each built-up member works synthetically in a relatively "balanced" manner. In the event of encountering the most unfavorable sea conditions that are foreseeable and occurring the most unfavorable accidents, such as collisions, rock striking, stranding, abnormal displacement of goods, etc. that are recorded, even if some members of a certain or even several hyperstatic spatial structural units 50 are damaged and out of service, the remaining structure is still a combined structure composed of the hyperstatic spatial structural units 50, and still can work normally.

In the design of the present disclosure, upon reasonable analysis by retrieving statistical data of various sea conditions and accidents, extreme loads of bad sea conditions and destructive extremums of various recorded accident forms are predicted, and as the recorded samples of the modern shipwreck accidents are enough and typical, it is credible to analyze the accident contour profile and extremum according to these accidents, and it also can be achieved by technicians in the industry. Thus, it can provide a basis for the design of the overall structure of the platform, so as to ensure that the floating structure of the present disclosure will not suffer from continuous destruction of a plurality of local units under extreme conditions, further ensuring that the floating structure of the present disclosure has definite safety performance of integrity of the whole structure under the above conditions.

For the ships and the ocean platforms in the conventional technology, key components, important components, secondary members and the like are classified according to importance of the members and different stressed states. However, various stressed members of the present disclosure are of substantially equivalent importance, and can support each other, without the risk of successive failures and overall collapse of relevant structures due to failure of "soft spot" components.

Distinguished from the semi-submersible platform, damage to any floating body or upright column of the semi-submersible platform will cause water to enter the floating cabin, and lead to stress deterioration of the whole structure, and if not handled timely, it may lead to catastrophic consequences of heeling, breaking or even overturning and sinking.

Detailed Description of Basic Module

An embodiment of the present disclosure provides a basic module of a floating structure. Specifically, more than two basic modules can be connected with each other at sea, so as to form the floating structure (VLFS), which may function as a floating comprehensive support base, for various ships to directly dock, where a deck surface can be equipped with a large loading and unloading machine to provide loading, unloading, transshipment and storage functions. A basic contour profile of the basic module of the floating structure can be selected to be an ultra-flat space structure, mainly including lower floating body structures, an upper structure and intermediate connection structures.

Figure 19:
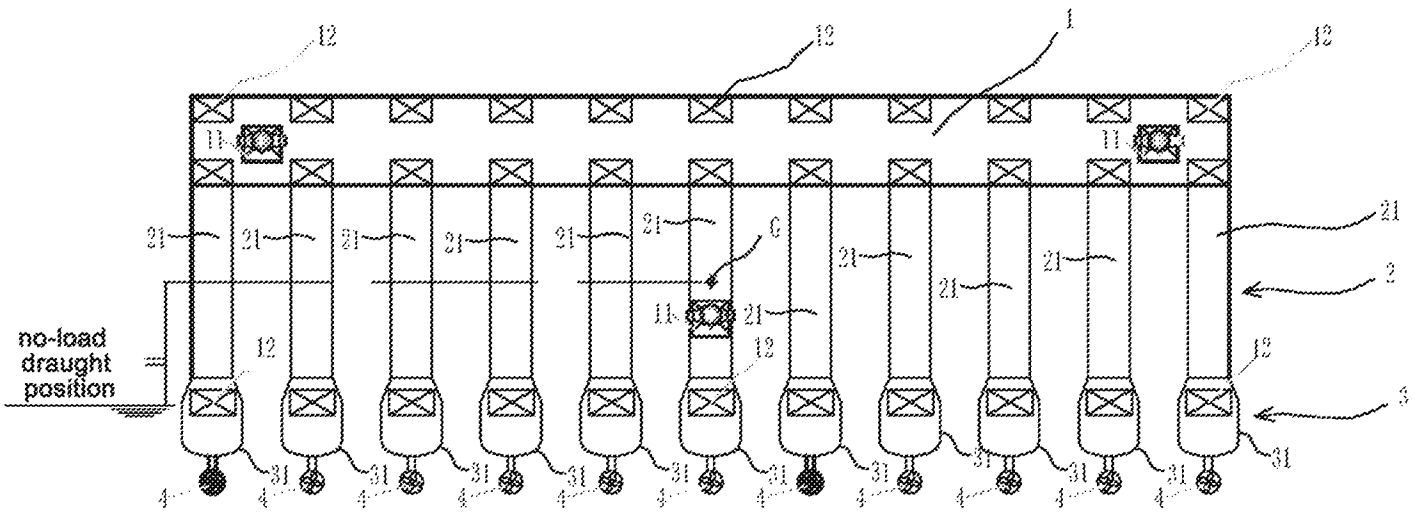
FIG. 19 is a front structural schematic diagram of a basic module of a floating structure in an embodiment of the present disclosure.
Figure 20:
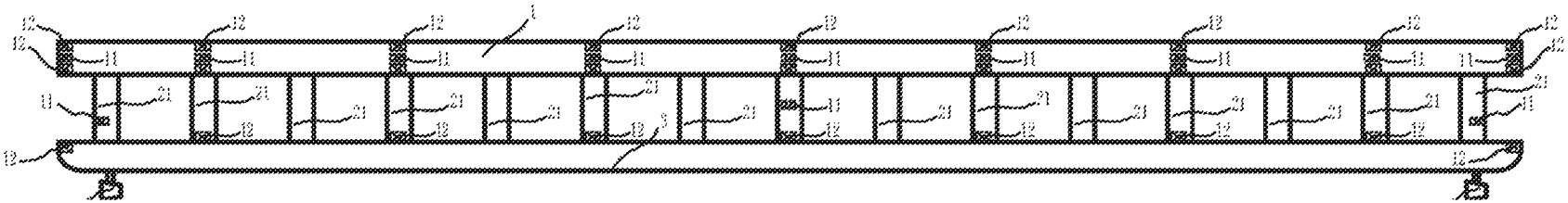
FIG. 20 is a side structural schematic diagram of the basic module of the floating structure in an embodiment of the present disclosure.
Figure 21:
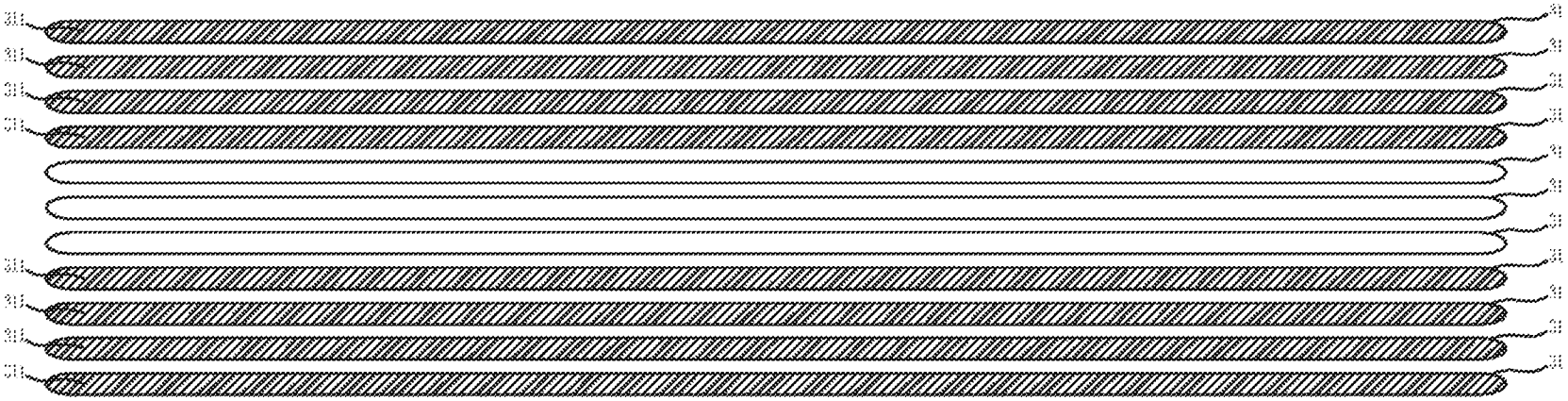
FIG. 21 is a structural schematic diagram of a top section of the basic module of the floating structure in an embodiment of the present disclosure.

Referring to what is shown in FIG. 19 to FIG. 21, the basic module of the floating structure in an embodiment of the present disclosure includes an upper structure 1, intermediate connection structures 2 and multiple lower floating body structures 3. Both length and breadth of the basic module of the floating structure in a horizontal direction can reach to be equal to or greater than 4 times a height (H) from a center of gravity to a still water surface when the basic module of the floating structure is in unloaded state, and it as the whole has an ultra-flat shape contour.

For example, the basic module is a unitary structure at least composed of 5 floating bodies, 25 upright columns (more are shown in the figures) and one spatially continuous upper box structure. According to the knowledge of structural mechanics, 2 lower floating bodies, 4 upright columns and corresponding part of the upper box structure (which can be analogized to a semi-submersible platform) can form an airtight hyperstatic spatial structural unit, therefore, the basic module of the present disclosure is, in any direction, a continuous combination of at least four hyperstatic spatial structural units, and viewed on the whole, the basic module of the present disclosure is a combined structure at least composed of 16 hyperstatic spatial structural units, therefore, the structure as a whole has quite great redundancy in terms of anti-disintegration.

From the structural composition analysis of the basic module, it can be found that the lower floating body structures and the intermediate connection structures thereof are both in a large number and arranged in a dispersed manner. When the structure is stressed, each built-up member works synthetically in a relatively "balanced" manner. In the event of encountering the most unfavorable sea conditions that are foreseeable and occurring the most unfavorable accidents, such as collisions, rock striking, stranding, abnormal displacement of goods, etc. that are recorded, even if some members of a certain or even several hyperstatic spatial structural units are damaged and out of service, the remaining structure is still a combined structure composed of the hyperstatic spatial structural units, and still can work normally.

In the design of the present disclosure, upon reasonable analysis by retrieving statistical data of various sea conditions and accidents, extreme loads of bad sea conditions and destructive extremums of various recorded accident forms are predicted, and as the recorded samples of the modern shipwreck accidents are enough and typical, it is credible to analyze the accident contour profile and extremum according to these accidents, and it also can be achieved by technicians in the industry. Thus, it can provide a basis for the design of the overall structure of the platform, so as to ensure that the basic module of the present disclosure will not suffer from continuous destruction of a plurality of local units under extreme conditions, further ensuring that the basic module of the present disclosure has definite safety performance of integrity of the whole structure under the above conditions.

For the ships and the ocean platforms in the conventional technology, key components, important components, secondary members and the like are classified according to importance of the members and different stressed states. However, various stressed members of the present disclosure are of substantially equivalent importance, and can support each other, without the risk of successive failures and overall collapse of relevant structures due to failure of "soft spot" components.

Distinguished from the semi-submersible platform, damage to any floating body or upright column of the semi-submersible platform will cause water to enter the floating cabin, and lead to stress deterioration of the whole structure, and if not handled timely, it may lead to catastrophic consequences of heeling, breaking or even overturning and sinking.

Referring to what is shown in FIG. 19 to FIG. 20, an upper surface and a lower surface of the upper structure 1 are upper and lower decks, and an intermediate deck also can be added. The upper and lower decks participate in the stress of the overall structure. In an embodiment, the upper structure 1 may be a rigid structure realized by a frame structure, and a plurality of compartments can be selectively formed in the upper structure 1.

The frame structure refers to a structure in which beams and columns are connected to constitute a load-bearing system, that is, the beams and columns forming the frame jointly resist a horizontal load and a vertical load that appear during use.

Referring to what is shown in FIG. 19 to FIG. 20, in an exemplary embodiment, in a height direction, a single layer distribution or a multilayer distribution of at least two layers can be designed inside the upper structure 1. A plurality of compartments can be arranged in each layer, and the compartments may be arranged in a manner according to functional requirements. In the above, main structural supports of each compartment may be at least three upright columns in a vertical direction and horizontal connecting beams in a top portion, and the connecting beams can connect the upright columns respectively in the top portion or a bottom portion. Transverse beams and the upright columns can be connected with connectors, such as branched sleeve joints. The various components can be welded, riveted, bolted or quickly clamped. In this way, a main stable structural support is composed of the transverse beams and the upright columns. Of course, a pole-type bracing or a truss-type support structure also can be added between the transverse beams and the upright columns, such that an overall structure of the upper structure 1 meets the requirements of structural safety level.

Further, a rigid support structure is composed of the transverse beams and the upright columns or other pole-type support structures inside the upper structure, for example, referring to room configuration manners of a building, individual functional compartments are formed by closing them with panels. As a wall panel is a non-bearing structure, lightweight panels can be chosen, for example, aluminum honeycomb panels, composite rock-wool panels, and light steel keel composite walls, but panels with flame retardant effect are preferred. Steel plates or other bearing plates can be chosen for the top plate and the floor.

It should be understood that the beam-column structure of the upper structure 1 may be in any beam-column structural form meeting the requirements of structural safety level. For example, a plurality of vertical or horizontal truss type support structures may be utilized to constitute the upper structure 1, and meanwhile, a plurality of functional compartments are separated.

When the upper structure is realized in the manner of the frame structural formed by the space beams and columns, structural design freedom (or flexibility) of the upper structure 1 will be greatly increased compared with designs of conventional ships and floating body structures, and design and arrangement of the upper functional compartments can be changed flexibly. The modifiable space of the upper structure 1 will be greatly increased, the main bearing structures are beams, columns and other supports (possibly none), and remaining members (split parts between operation compartments, upper and lower plates of the operation compartments, etc.) can be designed as non-main bearing structures, and only bear local functional loads but do not participate in the overall structural stress of the basic module. Due to the above characteristics, all the non-main bearing structures of the basic module can be arbitrarily changed under the premise of satisfying the local functional load without affecting the overall structural stress; non-metallic materials also can be considered for the non-main bearing structures so as to greatly reduce the cost of corrosion protection; it also can be considered to connect the non-main bearing structures to the main bearing structures by means of assembling (non-welding).

In another embodiment, the upper structure 1 also may be a rigid structural layer composed of a box structure, the main bearing structure is a space slab-beam structure, and members such as transverse bulkheads and longitudinal girders in the compartment, and upper and lower decks forming the compartment generally act as stressed structural members to participate in calculation of a total longitudinal strength.

The box structure referred to herein is a space box structure composed of a plurality of mutually constrained plates, and each plate is subjected to a local load, and is subjected to an undetermined distribution bending moment at four sides.

For example, the upper structure 1 may be a space box structure composed of a deck, a surrounding wall and several longitudinal and lateral bulkheads. There may be several layers of decks, for example, a main deck, an intermediate deck, and a lower deck. A main body of the upper structure 1 can be designed to have reserve buoyancy, that is, the main body of the upper structure 1 is watertight or has certain watertightness. The main body of the upper structure 1 may be an integral box structure, or may be a combination of several vertical and horizontal box structures, such as a "田 (a Chinese character)" shape, a "井 (a Chinese character)" shape, and a "Δ" shape.

For example, the structure of the upper structure 1 may be selected to have a vertical and horizontal hybrid skeleton form, main beams in each region have different directions, and at the same time, strong frames with different distances are arranged perpendicular to a length direction of the main beams, all main side wall skeletons are horizontally arranged, and all inner walls use vertical stiffener. As the frame structure is a common structural form of existing ships or offshore basic module compartments, it is not redundantly described herein.

It should be understood that the upper structure 1 also may be selected to be formed by combining both the box structure and the frame structure. For example, longitudinal or horizontal slab beams are added to the frame structure, so as to further improve the structural strength. Of course, various upright columns and transverse beams also can be added, for strengthening, to the structure dominated by the box structure. For another example, the middle of the upper structure 1 adopts a frame structure, while an outer periphery and/or a bottom layer adopts a box structure.

The upper structure 1 of the embodiment of the present disclosure is entirely above the maximum wave height of the water area where it is used, and the plurality of compartments formed in the upper structure 1 may be selected as sealable compartments. In the case of a compartment structure with multiple layers and zones, at least compartments below the middle are normally hermetic, and existing cabin structures can be referred to. Thus, if encountering extreme situations, the upper structure 1 still can remain self-floating when the multiple lower floating bodies 3 fail.

Referring to what is shown in FIG. 19 to FIG. 20, in an embodiment, the intermediate connection structures 2 include connection structures 21 in a first direction intersecting a horizontal plane, the connection structures 21 in the first direction include a plurality of spaced-apart floating bodies that can be regarded as upward extension of the multi-floating body. This part of floating bodies belong to special function floating bodies. Under extreme conditions, when the basic module as a whole heels at an extremely large angle, the plurality of spaced-apart floating bodies included in the connection structures 21 in the first direction are immersed in water, and can provide buoyancy. As the righting arm is quite long, a relatively large righting moment is produced on the whole, which can enable the basic module as a whole to have more reliable stability.

It should be indicated that when the basic module is inclined greatly, the intermediate connection structure intersecting the horizontal plane enters water, which can provide a safe righting force. For example, according to current design calculation and experimental data, when a sum of cross-section areas of the intermediate connection structures intersecting the horizontal plane is greater than 5% of the waterplane area of the multiple lower floating bodies 3 at the static waterline, and a distance from an outermost intermediate connection structure intersecting the horizontal plane to the basic module's center of gravity is greater than 2 times the distance from the basic module's center of gravity to a water surface, the total righting moment of the basic module can be greater than the maximum overturning moment received by the basic module under the combined action of possible wind, waves and the like, and the basic module can be enabled to have the safety against overturning. Regarding the small waterplane characteristic, when the intermediate connection structure according to the present disclosure uses the upright column structure, it is similar to the conventional semi-submersible platform in the aspect of structural appearance, while the difference is that this part of upright column structure is only temporarily submerged into the water when the basic module is heeled greatly or large waves cross the lower floating body structures, but there is no such working condition that the platform as a whole sinks in the vertical direction to make the upright column structure sink in the water continuously.

For example, the basic module of the embodiment of the present disclosure may be selected to be merely provided with the connection structures 21 in the first direction, and a large-area barrier-free water surface operation space can be formed between the floating bodies.

For the intermediate connection structure 2 with small waterplane characteristic in the embodiment of the present disclosure, the plurality of floating bodies of the connection structures 21 in the first direction may be a plurality of floating-body type connection structures intersecting at the water surface, and breadth of sections of these floating-body type connection structures in the horizontal plane is smaller than waterplane breadth of connected pontoons 31. The "breadth" refers to a dimension perpendicular to a length direction of the elongated pontoons 31. The plurality of floating bodies of the connection structures 21 in the first direction may be columnar structures, or a flat-plate type hollowed connection structures extending upward and downward; but in the embodiment of the present disclosure, the plurality of floating bodies of the connection structures 21 in the first direction are spaced apart from each other for wave crossing, reducing an external load received by the platform as a whole, so as to ensure safety. The plurality of floating-body type connection structures referred to in this paragraph should be understood as meaning that each single pontoon 31 is correspondingly connected with more than five floating-body type connection structures that are spaced apart from each other.

The connection structure 21 in the first direction may include a plurality of vertical upright columns, and the upright columns are in a hollowed airtight structure. The upright columns can be divided, in terms of appearance, into round upright columns and square upright columns, equal-section upright columns and variable-section upright columns. The upright columns mostly may be equal-section, round upright columns, and a few may be square upright columns. In the current analysis, the embodiment of the floating-body type connection upright columns have the advantage of bearing a small external load, and have better supporting strength. As the multiple lower floating bodies 3 include a plurality of elongated pontoons 31 arranged in a dispersed manner, the plurality of upright column-type floating bodies of the connection structures 21 in the first direction can be distributed on a plurality of rows, and various upright columns on each row are spaced apart by a certain distance, and an arrangement manner of the upright columns depends on an arrangement manner of individual pontoons 31 in the multiple lower floating bodies 3, and in principle, a plurality of upright columns are connected at intervals on each pontoon 31. A lead angle connection portion can be provided on a front side and a rear side of a joint of the upright column with the upper structure and the multiple lower floating bodies 3, and the lead angle connection portion is a hollowed structure. A standard box-type node structure can also be used at a joint of the upright column with the upper structure and the multiple lower floating bodies 3. Moreover, transport equipment such as elevators or stairs can also be installed inside the upright columns 21 so as to transport personnel or materials to the upper structure.

Figure 22:
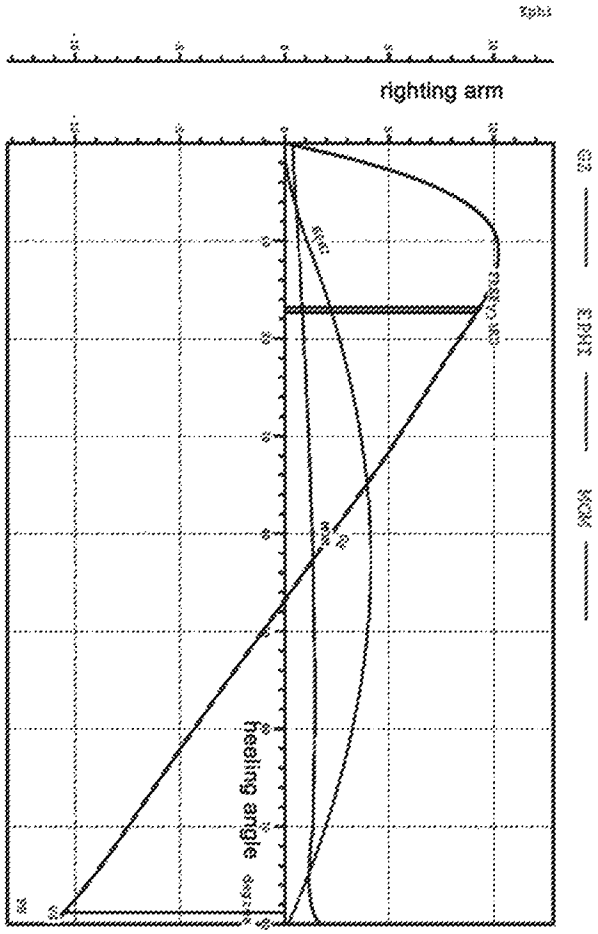
FIG. 22 shows experimental data of overturning test when upright columns of the basic module of the floating structure in an embodiment of the present disclosure provide no buoyancy.

FIG. 22 shows data of overturning test of the basic module when the connection structures 21 in the first direction provide no buoyancy, wherein after a heeling angle exceeds 10 degrees, the righting arm of the basic module will drop rapidly from a positive value, and after the heeling angle exceeds 45 degrees, the righting arm will have a negative value, which instead accelerates overturning of the basic module. In the above, signs are explained as follows:

| sign | meaning | unit |
|---|---|---|
| V3, V4 | water entry | |
| GZ | righting arm | m |
| EPHI | area enclosed by a righting arm curve and a heeling angle coordinate axis | $m^2$ |
| MOM | wind heeling arm when a wind speed is 100 kn | m |
| FREEBOARD | freeboard | |

Figure 23:
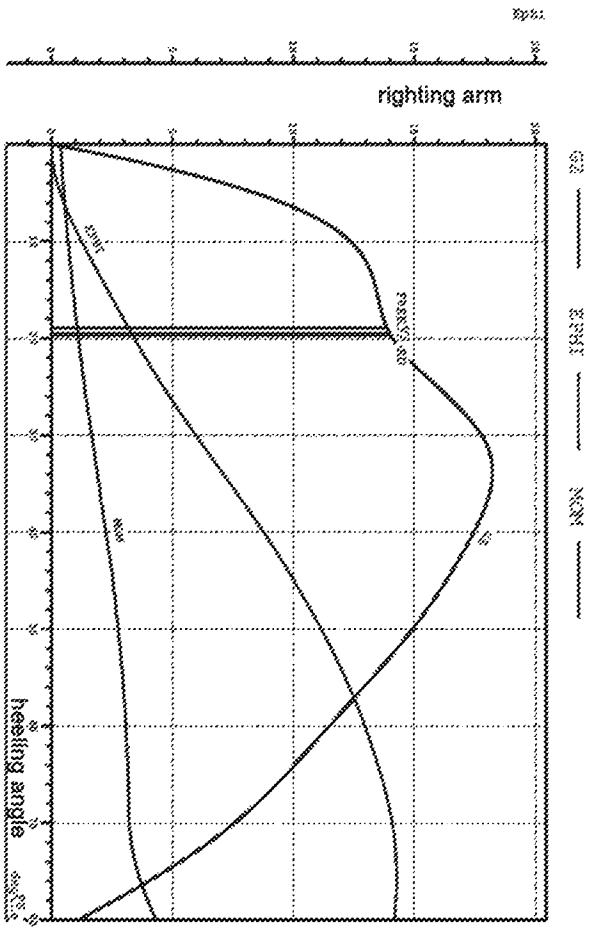
FIG. 23 shows experimental data of overturning test when upright columns of the basic module of the floating structure in an embodiment of the present disclosure provide buoyancy.

Referring to what is shown in FIG. 23, an overall sectional area of the floating-body type connection structure in the embodiment of the present disclosure is about 10% to 30% of the static waterline area of the multiple lower floating bodies 3, which can ensure continuity of upward distribution of the floating bodies, and the righting arm still has a positive value when the maximum inclination appears (the elongated floating bodies at one side all enter the water), ensuring that the basic module still can maintain relatively good anti-overturning property under extreme conditions.

As shown in FIG. 19 to FIG. 21, in an embodiment of the multiple lower floating bodies 3, the multiple lower floating bodies 3 include a plurality of elongated pontoons 31, and further, it may include at least five or more elongated pontoons 31, and these elongated pontoons 31 can be arranged in parallel at an interval of a certain distance. The overall requirement is that a sum of the displacement volumes of various floating bodies is greater than the displacement volume when the basic module is in a full-load state, so as to ensure that the waterline is always located within a height range of the multiple lower floating bodies 3 no matter the basic module is in a no-load state or in a full-load state. In this way, a relatively higher loading capacity is provided to a very large waterplane basic module that is insensitive to load changes. In the embodiment as shown in FIG. 19 to FIG. 21, a plurality of elongated pontoons 31 are all arranged longitudinally along a longitudinal direction of the basic module, and arranged in parallel at an interval of a certain distance. Of course, the multiple lower floating bodies 3 may be in forms of various different shapes by combining a plurality of pontoons 31, or multiple lower floating bodies 3 also may be formed by floating bodies of different shapes intersecting vertically and horizontally, as long as respective pontoons 31 are left with appropriate intervals to eliminate wave effect.

Each pontoon 31 may be mainly composed of a plurality of vertical and horizontal reinforcing structures and a casing grillage to form a watertight housing. The structure needs to ensure watertightness and strength. The maximum height dimension of the section of a single pontoon 31 may be selected to be less than ½ of the maximum wave height dimension of an applicable water area, and the maximum breadth dimension may be selected to be no more than 2 times the maximum height dimension of the section; a clear spacing between various adjacent pontoons 31 of the multiple lower floating bodies 3 may be selected to be greater than 0.5 times the breadth dimension of the section of the pontoon 31 with a larger breadth dimension in two adjacent floating bodies.

Further, a sum of the displacement volumes of various pontoons 31 is selected to be equal to or less than 2 times the equivalent water volume of the full weight when the basic module is fully loaded, such that the static waterline of the basic module is substantially located in an upper half of each pontoon 31. One option is that the displacement volume corresponding to the variable load of the basic module is less than or equal to ¼ of the total volume of various pontoons 31. Within this range, as many floating bodies as possible can be tiled to increase the load of the basic module.

In the specific embodiment as shown in the figures, the multiple lower floating bodies 3 may include a plurality of elongated pontoons 31 located in the same plane (although in the figures, the floating bodies of the same dimension are in the same plane, it also may be the case that the floating bodies are of different dimensions, and they are not necessarily located in the same plane). Various pontoons 31 are substantially the same in diameter and length, and various pontoons 31 are spaced apart by a certain distance. Herein, various pontoons 31 are arranged at intervals in the longitudinal direction along the longitudinal direction of the basic module, herein the number of the pontoons 31 is 11, with one in the middle, and 5 symmetrically arranged on each of two sides. The pontoon 31 may have a section in a circular shape, an elliptical shape, a square shape or other geometrical shapes. Of course, various pontoons 31 may also be of different sizes, for example, the pontoons 31 of different outer contour dimensions are used in combination.

Several outermost pontoons 31 of the multi-floating body are preferably filled therein with a non-absorbent material 311, for example, polystyrene foam, and in the specific embodiment as shown in the figures, four pontoons 31 are filled respectively on the left and right sides, eight pontoons 31 are filled in total, and total buoyancy provided by the eight pontoons 31 is about 1.2 times the displacement equivalent to the dead weight of the whole basic module, such that the eight filled pontoons 31 still will not lose buoyancy when housings of the floating bodies are damaged caused by collision or stranding of the basic module, thus the structure of the basic module will not overturn or sink due to loss of buoyancy of the floating bodies, possessing a great practical value.

It should be understood that the pontoons 31 may not be limited to a strip shape. In another embodiment, the multiple lower floating bodies 3 include a plurality of independent floating bodies arranged in a spatially dispersed manner, and the shape of the floating bodies may be spheroid, ellipsoid and various forms that can be considered to apply to the basic module.

It should be understood that in another embodiment, the multiple lower floating bodies 3 may be a combination or union of floating bodies of many forms. For example, on the basis of the multiple lower floating bodies 3 composed of elongated pontoons, a plurality of independent floating bodies arranged in a spatially dispersed manner are further included, and the shape of the floating bodies may be spheroid, ellipsoid and various forms that can be considered to apply to the basic module.

In addition, each floating body of the connection structure 21 in the first direction can also be filled with a non-absorbent material, so as to ensure that water does not enter when it is damaged, and a righting moment still can be provided. The floating bodies may be all filled with a non-absorbent material, or it is also feasible to merely fill the floating-body type connection structures on the outer peripheral side with the non-absorbent material corresponding to the circumstance of the pontoons 31, thus the safety of the basic module can be greatly improved.

In the large basic module of the embodiment of the present disclosure, the small-waterplane connection structures 21 in the first direction cooperate with the multiple lower floating bodies 3, forming a variable waterplane floating body structure with respect to the waves, thus effectively reducing the wave load.

In an embodiment of the present disclosure, the basic module is equipped with a driving device and a direction control device. Specifically, a plurality of propellers 4 can be arranged on each pontoon 31, and these propellers 4 may be full-revolving propellers. When it is necessary to avoid extreme sea conditions, the basic module can steer and navigate fast, and a navigational speed can reach 10 knots; the combined effect of the plurality of full-revolving propellers 4 can realize a dynamic positioning function.

The basic module provided in an embodiment of the present disclosure includes the upper structure 1 that is rigid as a whole, the intermediate connection structures 2 and the multiple lower floating bodies 3, and it generally can be analogized to an I-shaped section. The upper structure can be equivalent to an upper flange of the I-shaped section; the multiple lower floating bodies 3 are equivalent to a lower flange of the I-shaped section, and the intermediate connection structure 2 is equivalent to a web of the I-shaped section. Through reasonable structural design, for example, the sectional area of the multiple lower floating bodies 3 and the sectional area of the upper structure 1 have roughly equivalent contribution to the cross-section moment of inertia of a neutral axis of the basic module, the moment of inertia of the section itself of the multiple lower floating bodies 3 and the moment of inertia of the section itself of the upper structure 1 are roughly equivalent, and the neutral axis of the present basic module structure can be designed in a middle position of the basic module structure, such that the upper structure 1 and the multiple lower floating bodies 3 (steel) both can function with the maximum efficiency, and obtain the maximum strength (including resisting combined effects such as tension, compression, bending, shearing, and torsion) with the smallest amount of steel used, greatly improving the utilization ratio of structural materials (steel).

The scale of a single basic module in a length direction is more than 400 meters, and upon scientific and reasonable design, its scale can reach about 600-800 meters, the basic module itself is a floating structure, and a floating structure (VLFS) of the kilometer level can be realized just by splicing two basic modules once.

Referring to what is shown in FIG. 19 to FIG. 20, in an exemplary embodiment, a bow portion, a stern portion and/or a broadside of each basic module are selected to be provided with more than two cable traction devices 11 for connection. As shown in FIG. 19 and FIG. 20, it is selected to provide two cable traction devices 11 respectively at end faces of the bow portion and the stern portion of the upper structure 1. For example, the cable traction device 11 mainly includes components such as a hoist, a locking device, and a cable 13. It is selected to provide one cable traction device 11 respectively in lower portions of the connection structures 21 in the first direction of the bow portion and the stern portion, so as to form a cable traction system with a triangular layout on the end faces of the bow portion and the stern portion of the basic module. It should be understood that a variety of other combinations also may be selected for the layout manner of the cable traction system. As shown in FIG. 20, a transverse cable traction system also can be formed at the broadside with reference to the above manner.

Referring to what is shown in FIG. 19 to FIG. 20, in an exemplary embodiment, the bow portion, the stern portion and/or the broadside of the basic module are provided with connection devices 12 for connection and separation between the modules. Magnetic connection devices or mechanical connection devices, or a combination of the two may be selected as the connection devices 12. The connection devices 12 are selected to be provided on the bow portion, the stern portion and/or the broadside of the upper structure 1 or the lower floating body structures 3, or a combination of the two, then rigid connection between the basic modules can be realized. It should be understood that the number and location of the connection devices 12 further may have a variety of options, and articulated connection can be realized as desired.

Figure 31:
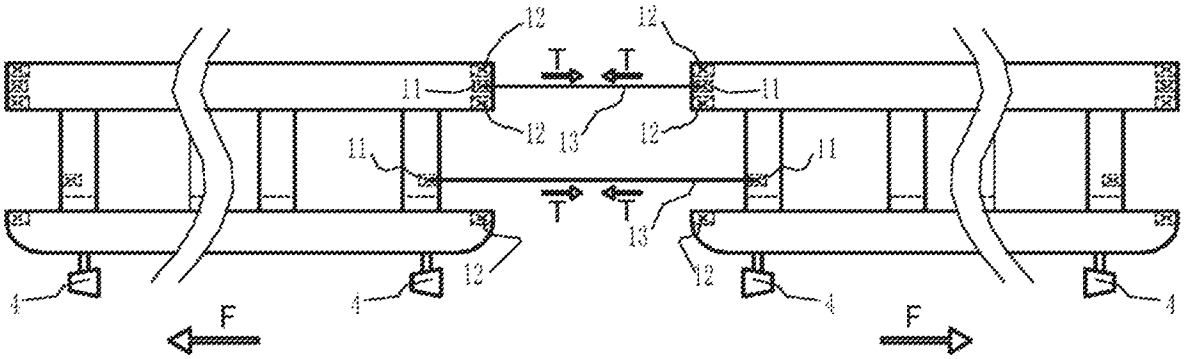
FIG. 31 is a first diagram of a step of splicing the basic modules of the floating structure in an embodiment of the present disclosure.
Figure 32:
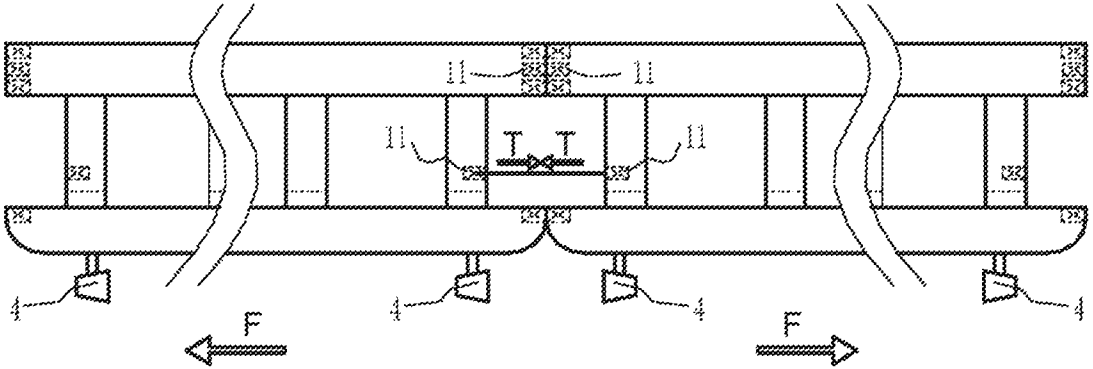
FIG. 32 is a second diagram of the step of splicing the basic modules of the floating structure in an embodiment of the present disclosure.

Referring to what is shown in FIG. 31 to FIG. 32, in the process of connecting the basic modules, first, the cable traction devices 11 of the two basic modules are connected by the cables 13; next, the full-revolving propelling devices 4 of the two basic modules propel along opposite directions, then the cables 13 begin to tension, restricting the two basic modules from getting away from each other; subsequently, the hoist is started, and the cables 13 continue to be tightened so that a tightening force T is greater than a reverse propulsive force F, and the two basic modules get close to each other until various connection devices 12 on the two basic modules are butted against each other, and the respective connection devices 12 are locked to each other.

In the connection process, the full-revolving propelling devices 4 of the two basic modules are required to always propel along opposite directions, so that the cables are always maintained in tension, and by controlling the tightening force T of the cable traction device 11 and the reverse propulsive force F of the propellers 4, it is realized that the two basic modules get close to each other under controlled conditions, and positioning and guiding between the basic modules can be realized, such that a contact load between the basic modules with huge mass is minimized, preventing the contact load from causing damage to the module structure.

Figure 24:
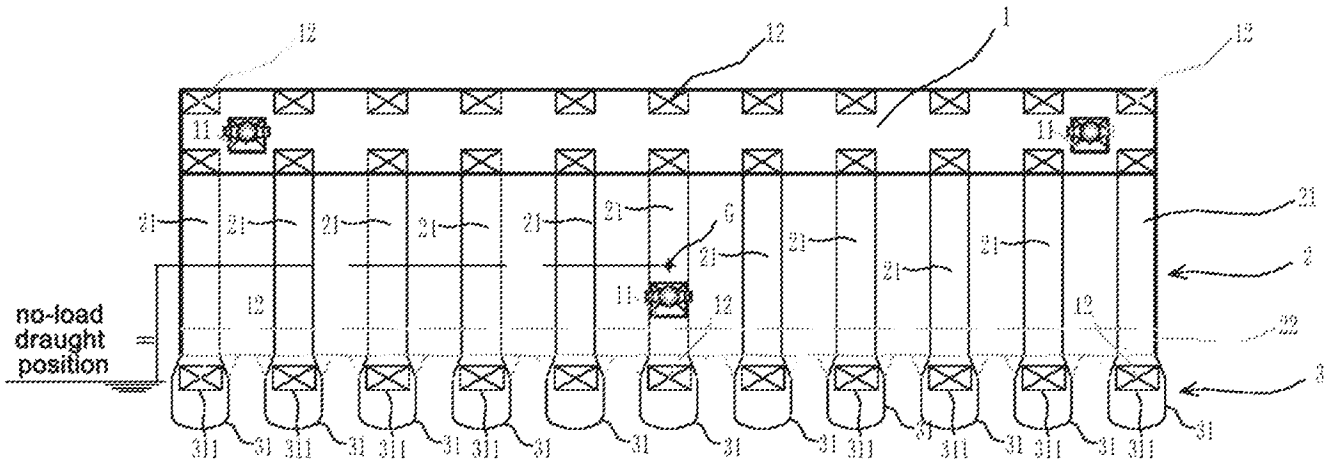
FIG. 24 is a front structural schematic diagram of the basic module of the large offshore floating platform exemplified according to the basic module of the floating structure in an embodiment of the present disclosure.
Figure 25:
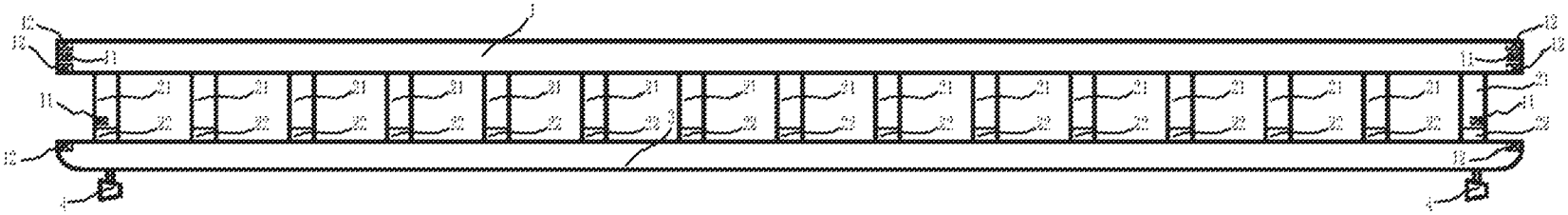
FIG. 25 is a side structural schematic diagram of the basic module of the large offshore floating platform exemplified according to the basic module of the floating structure in an embodiment of the present disclosure.
Figure 26:
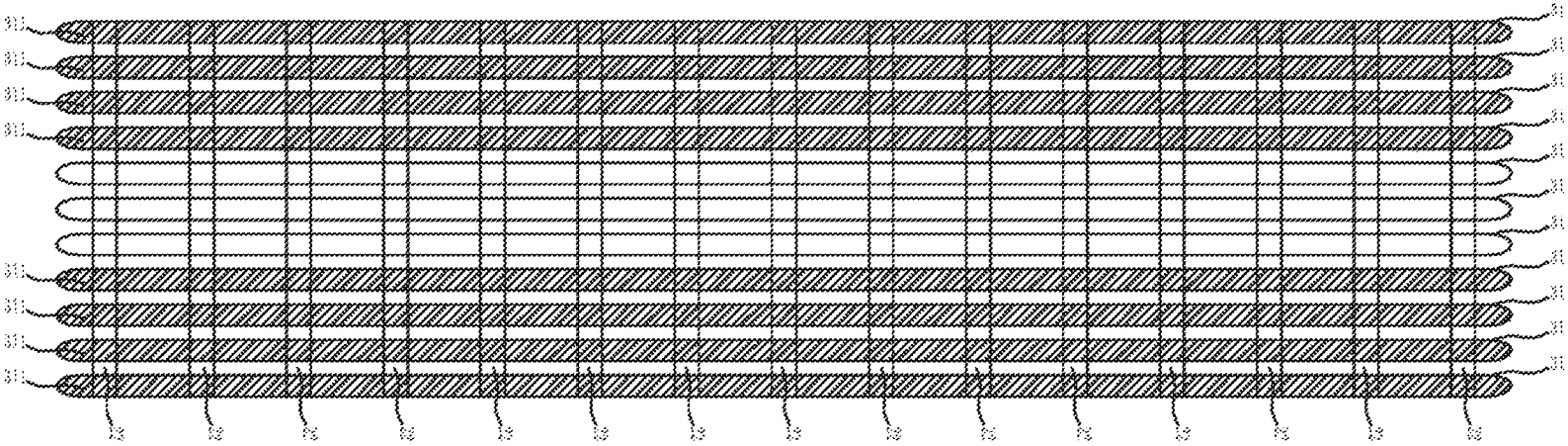
FIG. 26 is a structural schematic diagram of a top section of the basic module of the large offshore floating platform exemplified according to the basic module of the floating structure in an embodiment of the present disclosure.
Figure 27:
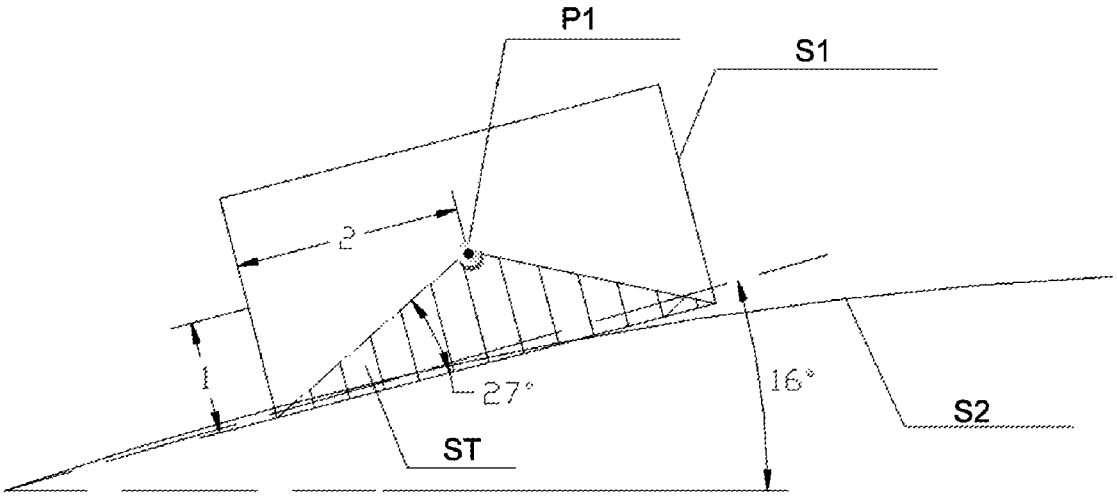
FIG. 27 is a schematic diagram of stability analysis of the basic module of the floating structure, exemplified as being entirely disposed transversely on a wave surface of waves, in an embodiment of the present disclosure, wherein P1 means position of center of gravity of floating structure, S1 means outer contour of transverse section of floating structure, ST means stable triangle, and S2 means wave surface position of the waves (corresponding to maximum wave steepness)
Figure 28:
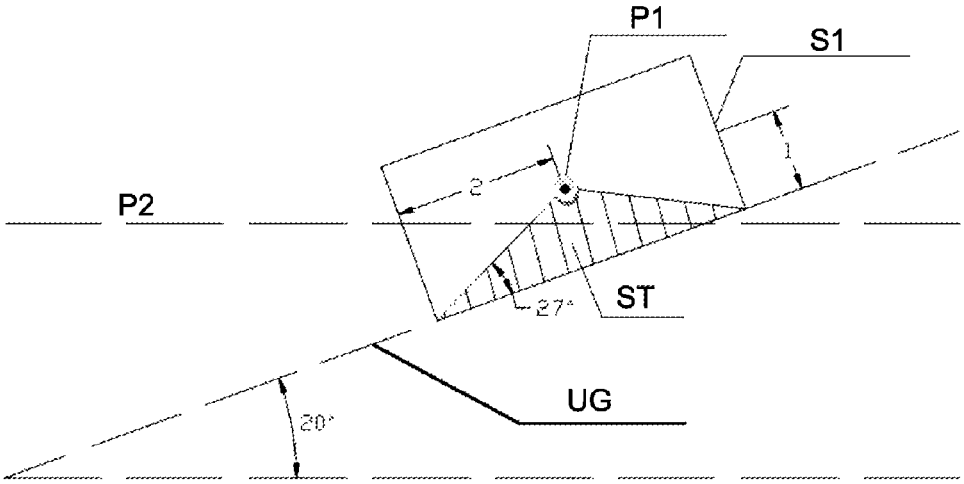
FIG. 28 is a schematic diagram of stability analysis of the basic module of the floating structure in an embodiment of the present disclosure, exemplified as being in a stranded condition wherein P1 means position of center of gravity of floating structure, S1 means outer contour of transverse section of floating structure, ST means stable triangle, and P2 means waterplane position, and UG means underwater gradient.
Figure 29:
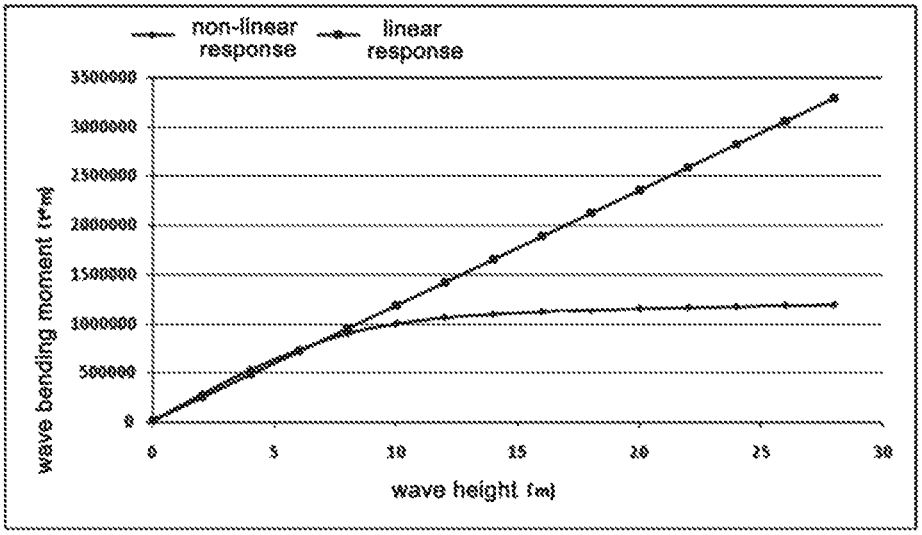
FIG. 29 is a schematic diagram exemplifying wave load analysis of the basic module of the floating structure in an embodiment of the present disclosure.
Figure 30:
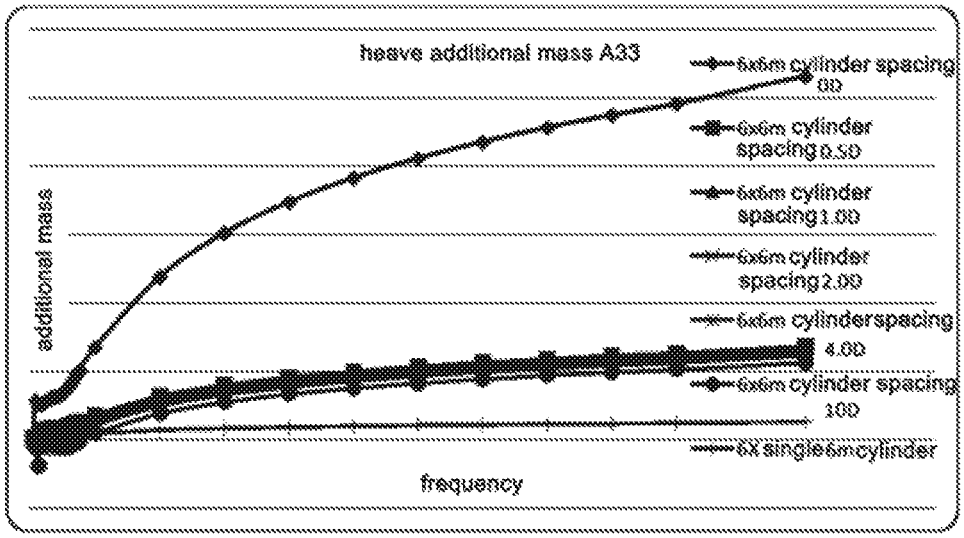
FIG. 30 is a schematic diagram exemplifying heaving analysis of the basic module of the floating structure in an embodiment of the present disclosure.

As shown in FIG. 24 to FIG. 26, in another embodiment of the present disclosure, it is distinguished from the above embodiment in that the intermediate connection structures 2 further have connection structures 22 in a second direction, and the connection structures 22 in the second direction are beam structures horizontally provided, which may be formed by welding steel plates, and a shifting board or a reinforced ribbed plate may be disposed inside. For further example, in an embodiment as shown in FIG. 19 to FIG. 21, a plurality of connection structures 22 in the second direction may be connected between adjacent pontoons 31, and a plurality of connection structures 22 in the second direction may be arranged at intervals along a longitudinal direction of the pontoons 31. A connection rod perpendicular to an extending direction of the pontoons 31 may be included, and a connection rod that intersects the extending direction of the pontoons 31 also may be included. The connection structures 22 in the second direction may be connection rods in a hollowed airtight structure, and a sectional shape of the connection rods may be a waterdrop shape, a wing shape or other streamline shape, and the sectional shape of the connection rods may be parallel to the horizontal plane so as to reduce resistance during navigation. The connection rods may be integrally connected above each of the pontoons 31, and can be fixedly connected by means of welding, riveting or screwing. Of course, they also can integrally penetrate each pontoon 31 and be connected to structural beams in each pontoon 31. The connection rods may also be replaced by connection structures such as connection wings. The connection rods not only can be connected perpendicular to each pontoon 31, but also can be connected thereto in a manner of being inclined to the pontoons 31, in this way, structural stability of the multiple lower floating bodies 3 can be improved by the connection structures 22 in the second direction.

Referring to FIG. 19 to FIG. 21, a specific application example provided in the present disclosure is as follows:

As exemplified in the figures, a statistical value of the maximum wave height that may occur in the sea area where the basic module is used is about 22 meters. The upper structure of the basic module is designed as a box structure with three layers of decks, forming a strength deck of this basic module. For example, as shown in the figures, the upper structure may have a length of 600 meters, a breadth of 151 meters, and a height of 13 meters. An upper surface complete deck of 90600 square meters and an upper cabin of 271800 square meters can be provided.

The multiple lower floating bodies 3 of the basic module are selected to be provided with 11 pontoons 31 (or called as elongated floating bodies) of the same shape that are independent from each other and longitudinally arranged, providing buoyancy for the whole basic module. For example, as shown in the figures, the cross section of each pontoon 31 of the multiple lower floating bodies 3 can be designed with the same rounded rectangular shape, each pontoon 31 may have a length of 600 meters, a height of 11.5 meters, and a maximum breadth of 8.8 meters, and a spacing between the pontoons 31 may be 6 meters. An outer edge distribution breadth of 11 pontoons 31 may be 151 meters, and the multi-floating body provides a displacement volume of about 667000 cubic meters in total. A sum of the waterline areas of the multi-floating body may be 57800 square meters. A maximum displacement of the basic module is about 410000 tons, in which the dead weight is about 190000 tons, and a design load capacity is about 200000 tons. In the design full-load state, the draught is about 7.3 meters, and the draught is about 4.8 meters under unloaded state. The draught change is about 2.5 meters between unloaded state and full load state. Under unloaded state, the height H from the basic module's center of gravity G to the still water surface is about 25 meters. The distribution dimension of the multi-floating body of this basic module in the breadth direction is equal to 6.04 times the height from the basic module's center of gravity to the still water surface under unloaded state.

When the design wave (which is modified sine wave) height is 22 meters and the wavelength is 621 meters, a predicted value of a maximum total longitudinal bending moment of the floating bodies is about 9.76E10NM. A maximum structural stress of a midship is about 220 MP (an allowable stress is 320 MP), and an overall structural deflection is about 1/500, satisfying the condition of "rigid body".

The connection structures 21 in the first direction are hollowed rectangular upright column bodies with rounded angles, with a length of about 10 meters, a breadth of about 6 meters, and a height of about 28 meters. A single cross-section area thereof may be 60 square meters, and each elongated floating body is equidistantly distributed with 15 connection structures 21 in the first direction, 11 floating bodies in total having 165 connection structures in the first direction, with a total cross-section area of about 9900 square meters, which is 17.1% of the waterplane area of the multi-floating body.

A single pontoon 31 of this basic module has a volume of 60720 cubic meters, and the displacement volume of full weight of the basic module is 410000 cubic meters, therefore, inner spaces of eight outermost pontoons 31 are all filled with the non-absorbent material 311, which has a displacement volume of approximately 485760 cubic meters, greater than the equivalent water volume of the full weight of the basic module.

As shown in FIG. 20, a driving device and a direction control device 4 can be provided respectively in a bow portion and a stern portion of each pontoon 31. Specifically as shown in the figure, a set of electrical propulsion rudder propeller may be provided in the bow portion and the stern portion respectively, for example, 22 sets in total, providing an excellent driving power and an omnidirectional control capability for the basic module.

Another Specific Embodiment

1. Overview

FIG. 24, FIG. 25 and FIG. 26 show application of an offshore basic module, wherein this basic module is designed to be suitable for offshore navigation, and the large offshore basic module is propelled by 22 full-revolving propellers 4, can be loaded with large objects, helicopters, containers, etc. on an outdoor upper deck or other decks, and also can provide oil reserves, refrigerated cargo reserves, personnel living facilities, etc.

As exemplified in the figures, a statistical value of the maximum wave height that may occur in the sea area where the basic module is used is about 22 meters. The upper structure of the basic module is designed as a box structure with three layers of decks to form strength decks of the basic module. For example, as shown in the figures, the upper structure may have a length of 600 meters, a breadth of 151 meters, and a height of 13 meters. An upper surface complete deck of 90600 square meters and an upper cabin of 271800 square meters can be provided.

The multiple lower floating bodies 3 of the basic module are selected to be provided with 11 pontoons 31 (or called as elongated floating bodies) of the same shape that are independent from each other and longitudinally arranged, providing buoyancy for the whole basic module. For example, as shown in the figures, the cross section of each pontoon 31 of the multiple lower floating bodies 3 can be designed with the same rounded rectangular shape, each pontoon 31 may have a length of 600 meters, a height of 11.5 meters, and a maximum breadth of 8.8 meters. A spacing between the pontoons 31 may be 6 meters. An outer edge distribution breadth of 11 pontoons 31 may be 151 meters, and the multi-floating body provides a displacement volume of about 667000 cubic meters in total. A sum of the waterline areas of the multi-floating body may be 57800 square meters. A maximum displacement of the basic module is about 410000 tons, in which the dead weight is about 200000 tons, and a design load capacity is about 200000 tons. In the design full-load state, the draught is about 7.5 meters, and the draught is about 5 meters under unloaded state. The draught change is about 2.5 meters between unloaded state and full load state. Under unloaded state, the height H from the basic module's center of gravity G to the still water surface is about 25 meters. The distribution dimension of the multi-floating body of this basic module in the breadth direction is equal to 6.04 times the height from the basic module's center of gravity to the still water surface under unloaded state.

When the design wave (which is modified sine wave) height is 22 meters and the wavelength is 621 meters, a predicted value of a maximum total longitudinal bending moment of the floating bodies is about 9.76E10NM. A maximum structural stress of a midship is about 220 MP (an allowable stress is 320 MP), and an overall structural deflection is about 1/500, satisfying the condition of "rigid body".

The connection structures 21 in the first direction are hollowed rectangular upright column bodies with rounded angles, with a length of about 10 meters, a breadth of about 6 meters, and a height of about 28 meters. A single cross-section area thereof may be 60 square meters, and each elongated floating body is equidistantly distributed with 15 connection structures 21 in the first direction, 11 floating bodies in total having 165 connection structures in the first direction, with a total cross-section area of about 9900 square meters, which is 17.1% of the waterplane area of the multi-floating body. The intermediate connection structures 2 further have connection structures 22 in the second direction, and the connection structures 22 in the second direction are beam structures horizontally provided, which may be formed by welding steel plates, and a shifting board or a reinforced ribbed plate may be disposed inside.

A single pontoon 31 of this basic module has a volume of 60720 cubic meters, and the displacement volume of full weight of the basic module is 410000 cubic meters, therefore, inner spaces of eight outermost pontoons 31 are all filled with the non-absorbent material 311, which has a displacement volume of approximately 485760 cubic meters, greater than the equivalent water volume of the full weight of the basic module.

As shown in FIG. 20, a driving device and a direction control device 4 can be provided respectively in a bow portion and a stern portion of each pontoon 31. Specifically as shown in the figure, a set of electrical propulsion rudder propeller may be provided in the bow portion and the stern portion respectively, for example, 22 sets in total, providing an excellent driving power and an omnidirectional control capability for the basic module.

Unless otherwise defined, terms used in the present disclosure are all commonly understood by those skilled in the art. The embodiments described in the present disclosure are for illustrative purposes only, and are not intended to limit the scope of protection of the present disclosure, and various other alternatives, modifications and improvements can be made by those skilled in the art within the scope of the present disclosure, therefore, the present disclosure is not limited to the above embodiments, but is only limited by the claims.

What is claimed is:

1. A floating structure, comprising multiple lower floating bodies, an upper structure and intermediate connection structures, wherein the multiple lower floating bodies comprise more than three elongated floating bodies horizontally arranged, the elongated floating bodies being spaced apart by a certain distance, and a sum of displacement volumes of the elongated floating bodies being greater than a displacement volume when the floating structure is in a full-load state;

wherein the upper structure is a frame structure or a box structure; and wherein the intermediate connection structures at least comprise connection structures in a first direction, with the first direction intersecting a horizontal plane; the connection structures in the first direction comprise a plurality of first floating bodies that extend upward and provide reserve buoyancy, the connection structures in the first direction are correspondingly connected with more than three single elongated floating bodies, a horizontal-direction sectional breadth of each of the first floating bodies of the connection structures in the first direction being smaller than a breadth of corresponding elongated floating bodies; and the intermediate connection structures are connected with the multiple lower floating bodies and the upper structure.

2. The floating structure according to claim 1, wherein an outer contour dimension of the multiple lower floating bodies is greater than 150 meters in at least one direction.

3. The floating structure according to claim 1, wherein a maximum height dimension of a section of a single floating body in the multiple lower floating bodies is smaller than ½ of a maximum wave height dimension of an applicable water area, and a maximum breadth dimension is no larger than 2 times the maximum height dimension of the section; a clear spacing between adjacent floating bodies of multiple floating bodies is greater than 0.5 times a sectional breadth dimension of one floating body of two adjacent floating bodies which has a larger breadth dimension.

4. The floating structure according to claim 1, wherein a total volume of the elongated floating bodies in the multiple lower floating bodies is less than 2 times an equivalent water volume of full weight when the floating structure is fully loaded.

5. The floating structure according to claim 1, wherein length and breadth distribution dimensions of the multiple lower floating bodies of the floating structure in the horizontal plane are equal to or greater than 4 times a height from a center of gravity to a still water surface when the floating structure is in an unloaded state.

6. The floating structure according to claim 1, wherein the floating structure is provided with a driving device and a direction control device.

7. The floating structure according to claim 6, wherein the elongated floating bodies have second floating bodies which are located at an outer side in the multiple lower floating bodies and provided therein with a plurality of watertight compartments or internally filled with a non-absorbent material, a sum of displacement volumes of the second floating bodies is greater than an equivalent water volume when the floating structure is fully loaded; and/or the first floating bodies have third floating bodies which are located at an outer side of the intermediate connection structures and internally provided with a plurality of watertight compartments or internally filled with the non-absorbent material.

8. The floating structure according to claim 2, wherein the floating structure is provided with a driving device and a direction control device.

9. The floating structure according to claim 3, wherein the floating structure is provided with a driving device and a direction control device.

10. The floating structure according to claim 4, wherein the floating structure is provided with a driving device and a direction control device.

11. The floating structure according to claim 5, wherein the floating structure is provided with a driving device and a direction control device.

* * * * *